US010831150B2

(12) United States Patent
Hirayama et al.

(10) Patent No.: US 10,831,150 B2
(45) **Date of Patent: *Nov. 10, 2020**

(54) CARTRIDGE AND IMAGE FORMING APPARATUS

(71) Applicant: CANON KABUSHIKI KAISHA, Tokyo (JP)

(72) Inventors: Akinobu Hirayama, Susono (JP); Takahito Ueno, Mishima (JP); Toshiaki Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/743,525

(22) Filed: Jan. 15, 2020

(65) Prior Publication Data

US 2020/0150582 A1 May 14, 2020

Related U.S. Application Data

(60) Division of application No. 16/278,869, filed on Feb. 19, 2019, now Pat. No. 10,558,165, which is a continuation of application No. PCT/JP2016/075737, filed on Aug. 26, 2016.

(51) Int. Cl.

| | |
|---|---|
| ***G03G 21/10*** | (2006.01) |
| ***G03G 21/18*** | (2006.01) |
| ***G03G 21/00*** | (2006.01) |

(52) U.S. Cl.

CPC ..... *G03G 21/181* (2013.01); *G03G 21/0005* (2013.01); *G03G 21/105* (2013.01); *G03G 21/1814* (2013.01); *G03G 21/1839* (2013.01)

(58) Field of Classification Search

CPC .. G03G 21/0005; G03G 21/10; G03G 21/105; G03G 21/181; G03G 21/1814; G03G 21/1839; G03G 21/1857

See application file for complete search history.

(56) References Cited

U.S. PATENT DOCUMENTS

| | | | |
|---|---|---|---|
| 5,678,139 | A | 10/1997 | Nomura et al. |
| 5,870,652 | A | 2/1999 | Kanamori et al. |
| 6,385,416 | B1 | 5/2002 | Horikawa et al. |

(Continued)

FOREIGN PATENT DOCUMENTS

| | | | |
|---|---|---|---|
| JP | 4928/1984 | U | 8/1985 |
| JP | S60-117321 | U | 8/1985 |

(Continued)

OTHER PUBLICATIONS

Dec. 11, 2017 Office Action in Taiwanese Patent Application No. 105127508.

(Continued)

*Primary Examiner* — Sophia S Chen
(74) *Attorney, Agent, or Firm* — Venable LLP

(57) ABSTRACT

A cartridge includes a photosensitive member, a discharge opening for discharging a developer removed from the photosensitive member, toward a loosening member provided in the main assembly of a apparatus; a vibration imparting member for imparting vibration to the loosening member. The vibration imparting member is movable between a first position for imparting the vibration to the loosening member and a second position retracted from the first position.

16 Claims, 58 Drawing Sheets

(56) References Cited

U.S. PATENT DOCUMENTS

| | | | |
|---|---|---|---|
| 6,608,980 | B2 | 8/2003 | Murayama et al. |
| 6,714,752 | B2 | 3/2004 | Ueno et al. |
| 6,823,153 | B2 | 11/2004 | Ueno et al. |
| 6,829,455 | B2 | 12/2004 | Yasumoto et al. |
| 6,834,175 | B2 | 12/2004 | Murayama et al. |
| 6,898,391 | B2 | 5/2005 | Numagami et al. |
| 6,912,365 | B2 | 6/2005 | Ueno et al. |
| 6,954,600 | B2 | 10/2005 | Fujita et al. |
| 6,954,601 | B2 | 10/2005 | Ueno et al. |
| 6,968,146 | B1 | 11/2005 | Fujita et al. |
| 6,970,668 | B2 | 11/2005 | Ueno et al. |
| 6,978,099 | B2 | 12/2005 | Ueno et al. |
| 7,003,247 | B2 | 2/2006 | Koishi et al. |
| 7,062,200 | B2 | 6/2006 | Ueno et al. |
| 7,092,658 | B2 | 8/2006 | Yasumoto et al. |
| 7,139,502 | B2 | 11/2006 | Koishi et al. |
| 7,158,749 | B2 | 1/2007 | Ueno et al. |
| 7,164,875 | B2 | 1/2007 | Miyabe et al. |
| 7,174,122 | B2 | 2/2007 | Fujita et al. |
| 7,184,690 | B2 | 2/2007 | Ueno et al. |
| 7,209,682 | B2 | 4/2007 | Numagami et al. |
| 7,248,810 | B2 | 7/2007 | Miyabe et al. |
| 7,315,710 | B2 | 1/2008 | Ueno et al. |
| 7,366,452 | B2 | 4/2008 | Fujita et al. |
| 7,440,715 | B2 | 10/2008 | Numagami et al. |
| 7,450,877 | B2 | 11/2008 | Miyabe et al. |
| 7,457,566 | B2 | 11/2008 | Koishi et al. |
| 7,483,646 | B2 | 1/2009 | Ueno et al. |
| 7,630,665 | B2 | 12/2009 | Ueno et al. |
| 7,702,251 | B2 | 4/2010 | Miyabe et al. |
| 7,720,408 | B2 | 5/2010 | Ueno et al. |
| 7,720,412 | B2 | 5/2010 | Anan et al. |
| 7,813,668 | B2 | 10/2010 | Ueno et al. |
| 7,945,185 | B2 | 5/2011 | Miyabe et al. |
| 8,034,525 | B2 | 10/2011 | Matsumoto et al. |
| 8,155,554 | B2 | 4/2012 | Miyabe et al. |
| 8,229,320 | B2 | 7/2012 | Kimizuka et al. |
| 8,233,821 | B2 | 7/2012 | Miyabe et al. |
| 8,270,879 | B2 | 9/2012 | Numata et al. |
| 8,275,286 | B2 | 9/2012 | Ueno et al. |
| 8,280,278 | B2 | 10/2012 | Ueno et al. |
| 8,280,296 | B2 | 10/2012 | Ichikawa et al. |
| 8,295,734 | B2 | 10/2012 | Ueno et al. |
| 8,369,748 | B2 | 2/2013 | Ueno et al. |
| 8,391,748 | B2 | 3/2013 | Miyabe et al. |
| 8,401,441 | B2 | 3/2013 | Uneme et al. |
| 8,422,914 | B2 | 4/2013 | Hayashi et al. |
| 8,433,219 | B2 | 4/2013 | Miyabe et al. |
| 8,452,210 | B2 | 5/2013 | Ueno et al. |
| 8,484,411 | B1 | 7/2013 | Miyabe et al. |
| 8,494,399 | B2 | 7/2013 | Miyabe et al. |
| 8,503,916 | B2 | 8/2013 | Anan et al. |
| 8,521,060 | B2 | 8/2013 | Numata et al. |
| 8,532,533 | B2 | 9/2013 | Ueno et al. |
| 8,630,564 | B2 | 1/2014 | Ueno et al. |
| 8,670,688 | B2 | 3/2014 | Ueno et al. |
| 8,676,090 | B1 | 3/2014 | Ueno et al. |
| 8,682,215 | B1 | 3/2014 | Ueno et al. |
| 8,687,994 | B2 | 4/2014 | Nakamura et al. |
| 8,688,017 | B2 | 4/2014 | Shimizu et al. |
| 8,874,004 | B2 | 10/2014 | Takasaka et al. |
| 9,014,599 | B2 | 4/2015 | Ota |
| 9,052,638 | B2 | 6/2015 | Matsumaru et al. |
| 9,069,289 | B2 | 6/2015 | Batori et al. |
| 9,116,466 | B2 | 8/2015 | Makiguchi et al. |
| 9,164,424 | B2 | 10/2015 | Nakamura et al. |
| 9,164,430 | B2 | 10/2015 | Murakami et al. |
| 9,176,468 | B2 | 11/2015 | Ueno et al. |
| 9,182,733 | B2 | 11/2015 | Horikawa et al. |
| 9,188,906 | B2 | 11/2015 | Batori et al. |
| 9,229,371 | B2 | 1/2016 | Murakami et al. |
| 9,354,552 | B2 | 5/2016 | Takeuchi |
| 9,395,646 | B2 | 7/2016 | Tarui |
| 9,465,318 | B2 | 10/2016 | Takeuchi et al. |
| 9,477,201 | B2 | 10/2016 | Miyabe et al. |
| 9,494,890 | B2 | 11/2016 | Komatsu et al. |
| 9,594,343 | B2 | 3/2017 | Miyabe et al. |
| 9,599,932 | B2 | 3/2017 | Takeuchi et al. |
| 9,678,471 | B2 | 6/2017 | Ueno et al. |
| 9,684,261 | B2 | 6/2017 | Miyabe et al. |
| 9,733,614 | B2 | 8/2017 | Ueno et al. |
| 9,746,826 | B2 | 8/2017 | Ueno et al. |
| 9,772,602 | B2 | 9/2017 | Ueno et al. |
| 9,817,333 | B2 | 11/2017 | Morioka et al. |
| 9,836,015 | B2 | 12/2017 | Morioka et al. |
| 9,836,021 | B2 | 12/2017 | Ueno et al. |
| 9,841,724 | B2 | 12/2017 | Morioka et al. |
| 9,841,727 | B2 | 12/2017 | Ueno et al. |
| 9,841,728 | B2 | 12/2017 | Ueno et al. |
| 9,841,729 | B2 | 12/2017 | Ueno et al. |
| 9,846,408 | B2 | 12/2017 | Ueno et al. |
| 9,851,685 | B2 | 12/2017 | Morioka et al. |
| 9,851,688 | B2 | 12/2017 | Morioka et al. |
| 9,857,764 | B2 | 1/2018 | Ueno et al. |
| 9,857,765 | B2 | 1/2018 | Ueno et al. |
| 9,857,766 | B2 | 1/2018 | Morioka et al. |
| 9,864,331 | B2 | 1/2018 | Ueno et al. |
| 9,864,333 | B2 | 1/2018 | Ueno et al. |
| 9,869,960 | B2 | 1/2018 | Ueno et al. |
| 9,874,846 | B2 | 1/2018 | Ueno et al. |
| 9,874,854 | B2 | 1/2018 | Ueno et al. |
| 9,886,002 | B2 | 2/2018 | Morioka et al. |
| 9,939,776 | B2 | 4/2018 | Morioka et al. |
| 9,989,892 | B2 | 6/2018 | Takeuchi et al. |
| 10,095,161 | B2 | 10/2018 | Takeuchi et al. |
| 10,095,179 | B2 | 10/2018 | Miyabe et al. |
| 10,168,665 | B2 | 1/2019 | Miyabe et al. |
| 10,209,670 | B2 | 2/2019 | Ueno et al. |
| 10,429,794 | B2 | 10/2019 | Ueno et al. |
| 10,558,165 | B2 * | 2/2020 | Hirayama ..... G03G 21/105 |
| 2007/0160388 | A1 | 7/2007 | Yoshimura et al. |
| 2007/0274743 | A1 | 11/2007 | Tamura et al. |
| 2009/0291375 | A1 | 11/2009 | Fujisaki et al. |
| 2011/0038649 | A1 | 2/2011 | Miyabe et al. |
| 2012/0230734 | A1 | 9/2012 | Shimizu et al. |
| 2013/0170867 | A1 | 7/2013 | Acosta et al. |
| 2013/0287448 | A1 | 10/2013 | Baker et al. |
| 2014/0376953 | A1 | 12/2014 | Kakuta et al. |
| 2016/0170370 | A1 | 6/2016 | Shimizu et al. |
| 2016/0274536 | A1 | 9/2016 | Ueno et al. |
| 2016/0370757 | A1 | 12/2016 | Sato et al. |
| 2017/0329279 | A1 | 11/2017 | Hirayama et al. |
| 2018/0039226 | A1 | 2/2018 | Takeuchi et al. |
| 2018/0113415 | A1 | 4/2018 | Morioka et al. |
| 2018/0348700 | A1 | 12/2018 | Hirayama et al. |
| 2018/0364640 | A1 | 12/2018 | Ueno et al. |
| 2019/0079448 | A1 | 3/2019 | Miyabe et al. |
| 2019/0155204 | A1 | 5/2019 | Miyabe et al. |
| 2019/0204779 | A1 | 7/2019 | Takeuchi et al. |

FOREIGN PATENT DOCUMENTS

| | | | |
|---|---|---|---|
| JP | H11-119619 | A | 4/1994 |
| JP | H11-030936 | A | 2/1999 |
| JP | H11-133828 | A | 5/1999 |
| JP | H11-149237 | A | 6/1999 |
| JP | 2004-361564 | A | 12/2004 |
| JP | 2007-232821 | A | 9/2007 |
| JP | 2014052475 | A | 3/2014 |
| KR | 10-0135906 | A | 1/1998 |
| RU | 2 573 044 | C2 | 11/2014 |

OTHER PUBLICATIONS

International Search Report and Written Opinion of the International Searching Authority in International Patent Application No. PCT/JP2016/075737, dated Nov. 29, 2016.

Co-pending U.S. Appl. Nos. 16/134,392; 16/189,147; 16/234,808; and 16/297,888.

English translation of Japanese Patent Application Pub. No. U60-117321.

English translation of Japanese Patent Application Pub. No. 11-149237.

(56) References Cited

OTHER PUBLICATIONS

English translation of Japanese Patent Application Pub. No. 2004-361564.
English translation of Japanese Patent Application Pub. No. 11-30936.
English translation of Japanese Patent Application Pub. No. 11-119619.
English translation of Japanese Patent Application Pub. No. 2007-232821.
Examination Report in Australian Patent Application No. 2016420646, dated Aug. 21, 2019.
Oct. 8, 2019 Office Action in Russian Patent Application No. 2019108101 (with English translation).
Mar. 13, 2020 Office Action in Taiwanese Patent Application No. 107120392.
Feb. 28, 2020 Office Action in Colombian Patent Application No. NC2019/0002091 (with English translation).
Apr. 3, 2020 Communication in European Patent Application No. 16 91 4248.
Apr. 6, 2020 Notice of Allowance in Korean Patent Application No. 10-2019-7008638.
Jul. 2, 2020 Notice of Allowance in Australian Patent Application No. 2016420646.

* cited by examiner (a)

(b)

(a)

(b)

(c)

(a)

(b)

(a)

(b)

(c)

(a)

(b)

(c)

(a)

(b)

(c)

(a)

(b)

(a)

(b)

(a)

(b)

(a)

(b)

(a)

(b)

(a)

(b)

CARTRIDGE AND IMAGE FORMING APPARATUS

This application is a divisional of application Ser. No. 16/278,869, filed Feb. 19, 2019.

TECHNICAL FIELD

The present invention relates to a cartridge usable with an image forming apparatus of an electrophotographic type.

BACKGROUND ART

In an electrophotographic type image forming apparatus, a structure is known in which the rotatable elements such as a photosensitive drum or developing roller relating to image formation are contained in the cartridge which is detachably mountable to a main assembly of the image forming apparatus.

Such an image forming apparatus requires maintenance operations for some elements. In order to facilitate the maintenance operation for various process means, the above-described photosensitive drum, charging means, developing means, cleaning means and so on are contained in a frame to form a cartridge. By making the cartridge detachable and mountable relative to the image forming apparatus, the maintenance operations are easy.

In such a cartridge type device, a structure is known in which untransferred toner (residual toner) resulting from a cleaning process during the image forming operation is retained in the cartridge.

In addition, Japanese Laid-open Patent Application 2014-52475 discloses a structure in which residual toner resulting in the cleaning process during the image forming operation is fed into a residual toner accommodating portion provided in the main assembly.

SUMMARY OF THE INVENTION

Problem to be Solved

Accordingly, it is an object of the present invention to provide a further development of the prior-art.

Means for Solving the Problem

A typical structure is a cartridge detachably mountable to a main assembly of an electrophotographic image forming apparatus, said main assembly including a loosening member for loosening a developer, said cartridge comprising a photosensitive member; a discharge opening configured to discharge a developer removed from said photosensitive member, toward the loosening member; and a vibration imparting member configured to impart vibration to said loosening member, wherein said vibration imparting member is movable between a first position for imparting the vibration to said loosening member and a second position retracted from the first position.

Effect of the Invention

A further development of the prior-art is provided.

BRIEF DESCRIPTION OF THE DRAWINGS

Parts (a) and (b) of FIG. 1 are partially sectional views illustrating engagement between a residual toner discharging portion and a main assembly portion according to an embodiment.

Figure 7:
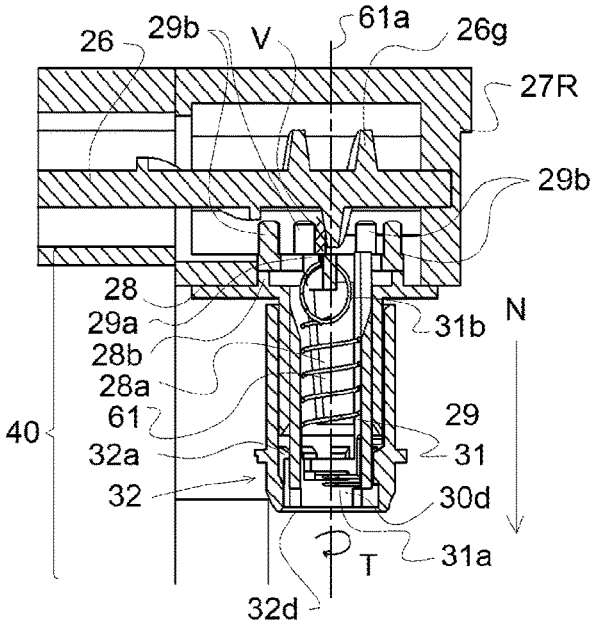
Figure 7:
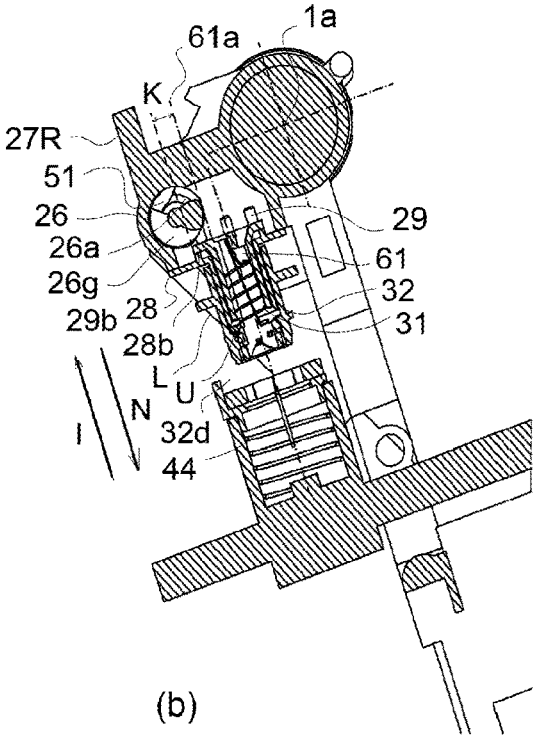
Figure 7:
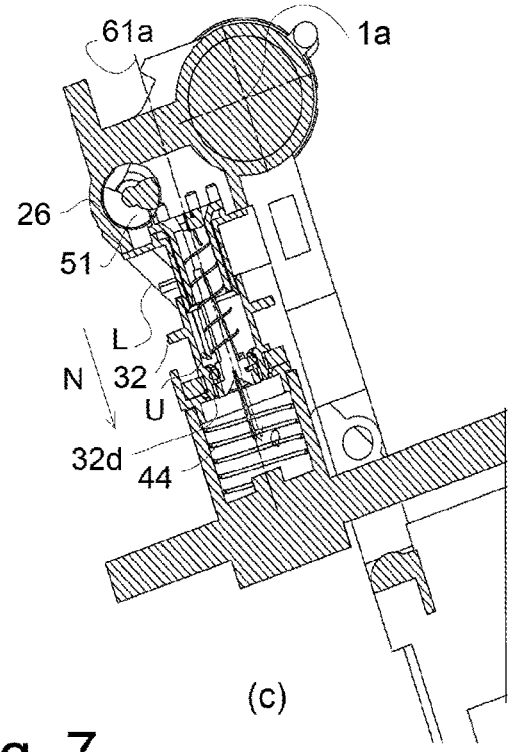

Parts (a), (b) and (c) of FIG. 7 are sectional views illustrating a position, in a cross-sectional plane, of a feeding screw in the process cartridge of the embodiment.

Figure 8:
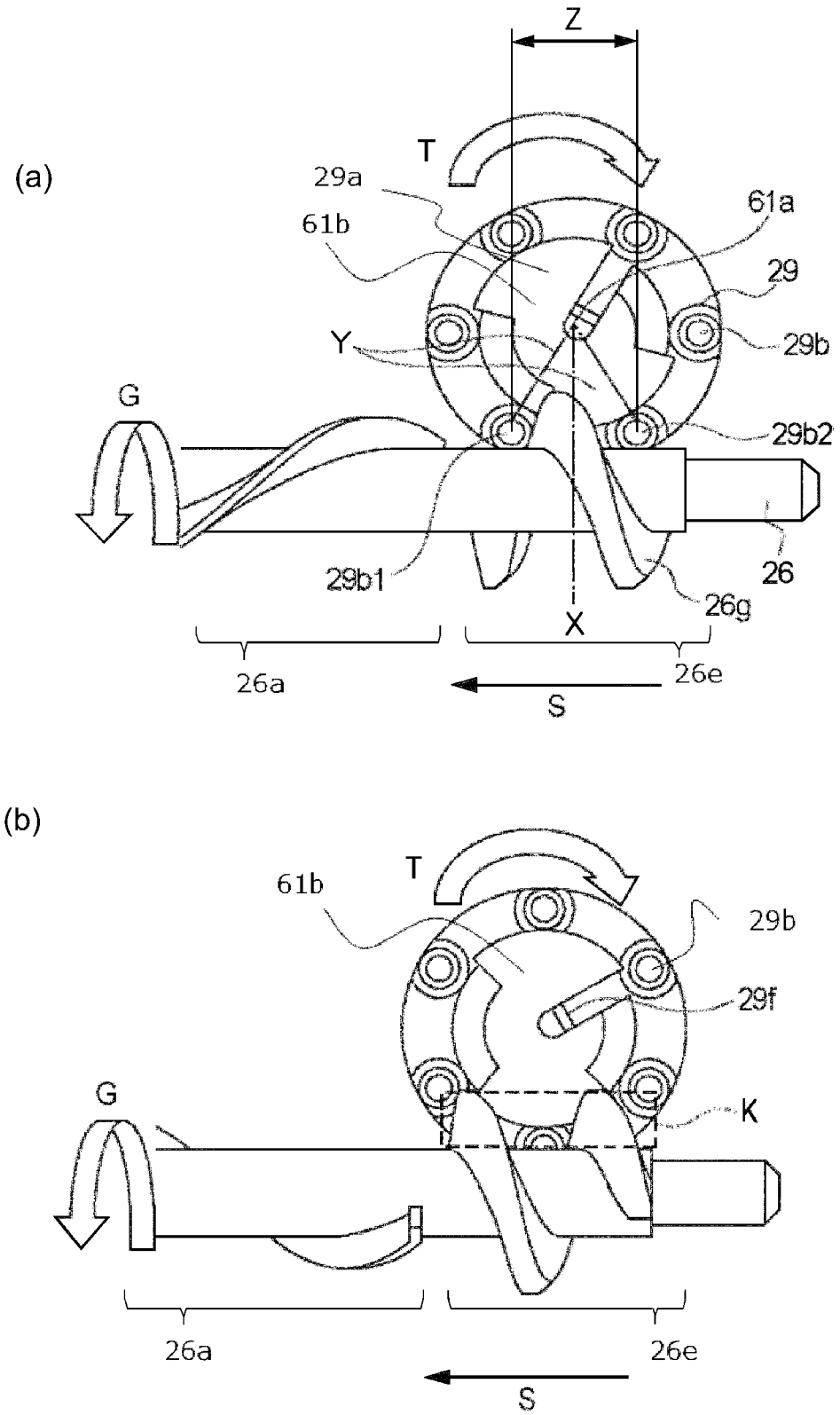

Parts (a) and (b) of FIG. 8 are illustrations of engagement between the feeding screw of the process cartridge and a coupling in the embodiment.

Figure 9:
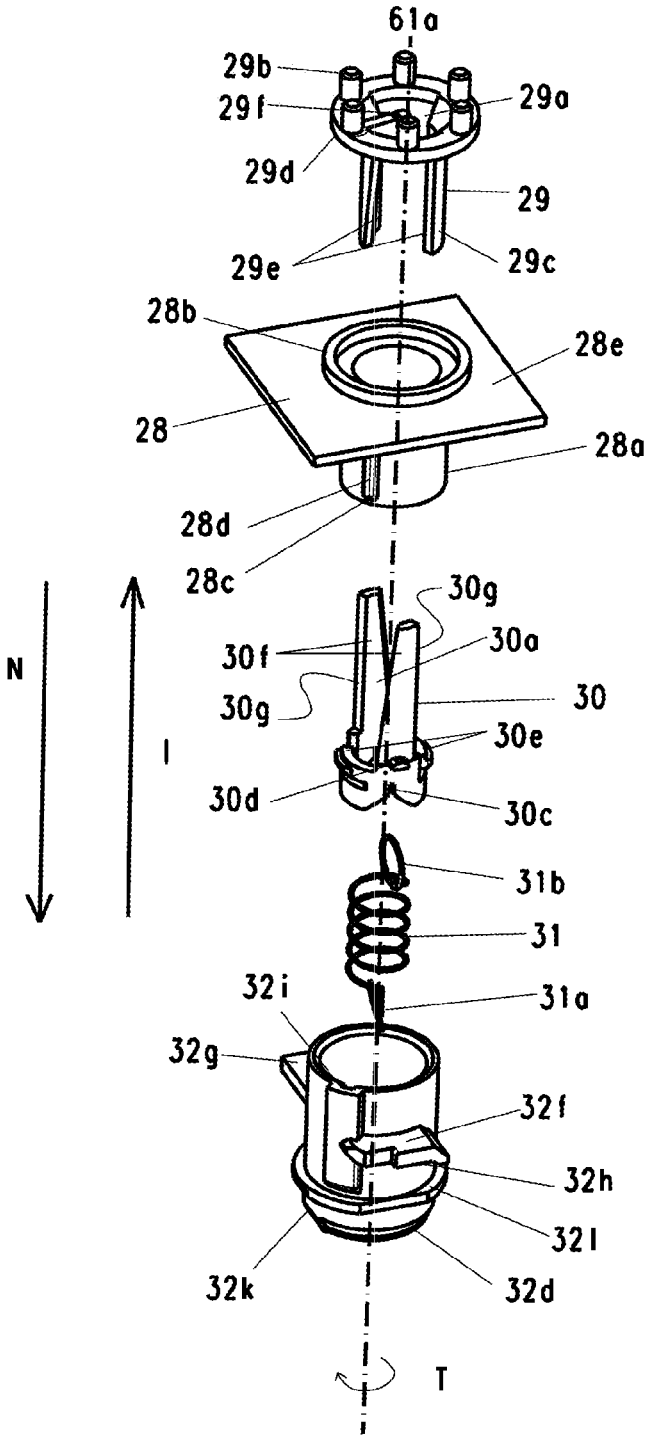

FIG. 9 is an illustration of the residual toner discharging portion of the process cartridge in the embodiment.

Figure 10:
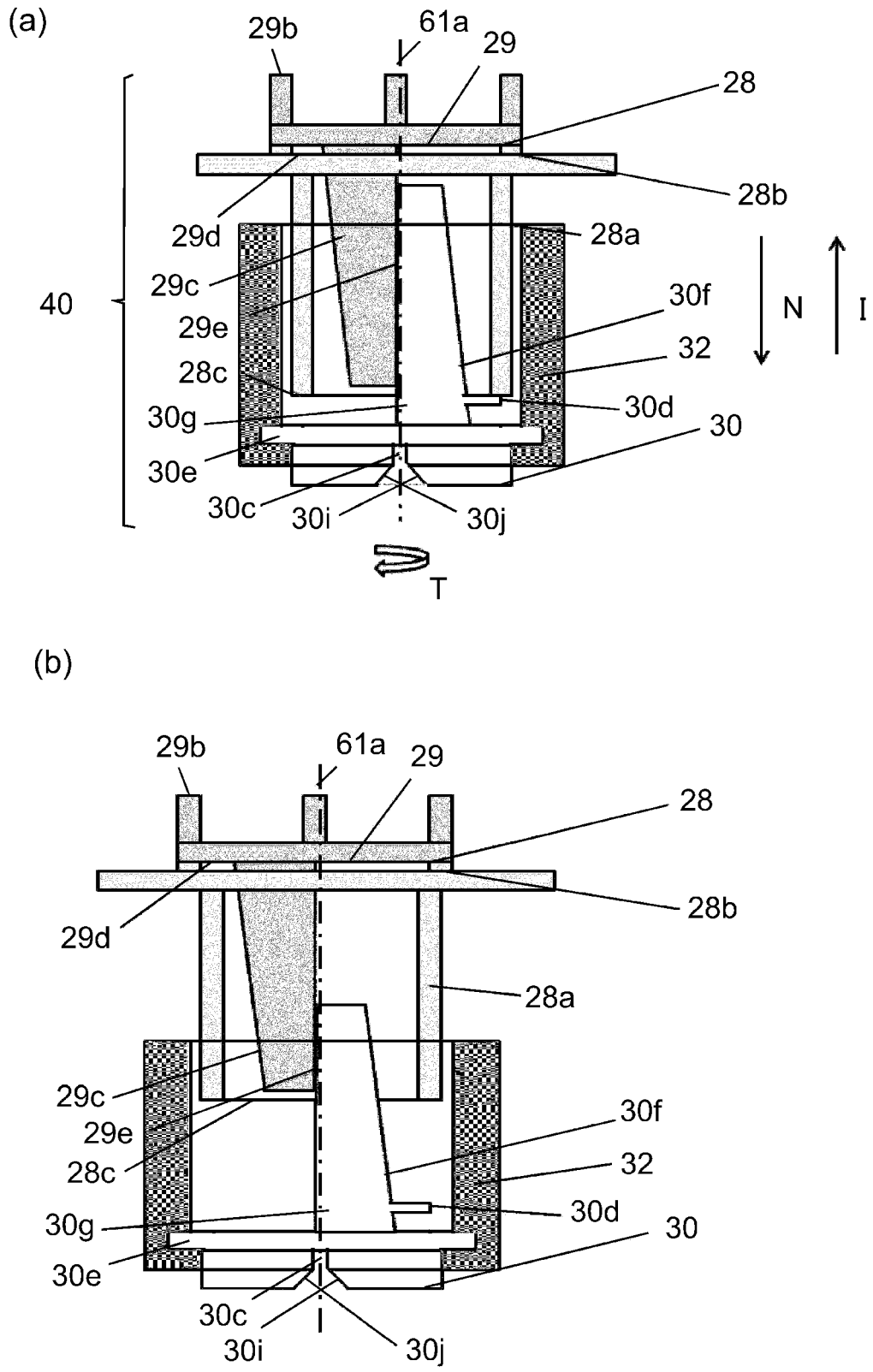

Parts (a) and (b) of FIG. 10 are sectional views residual toner discharging portion of the process cartridge in the embodiment.

Figure 11:
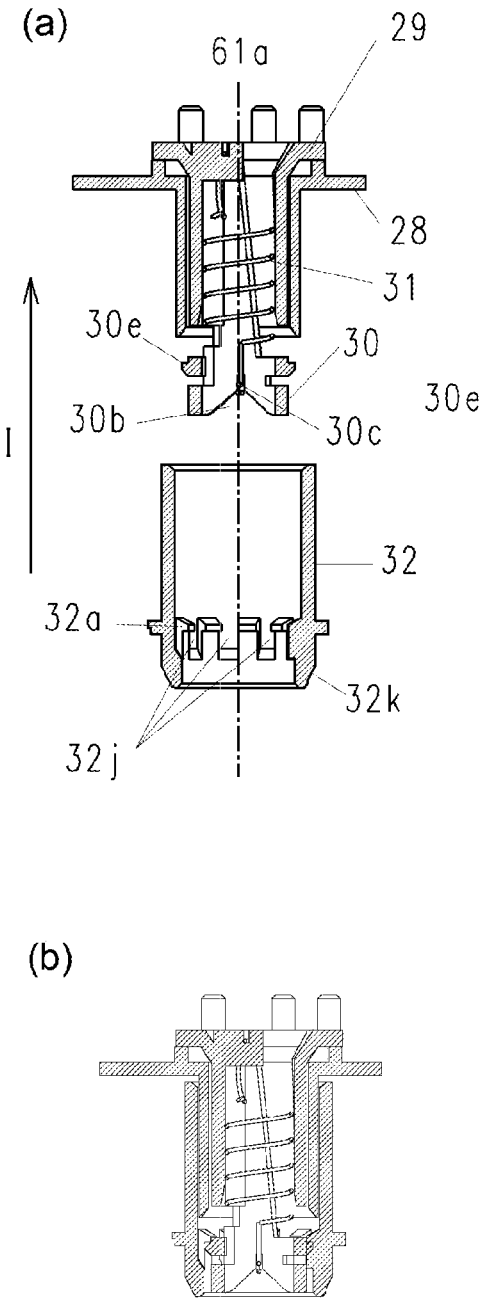

Parts (a) and (b) of FIG. 11 illustrate assembling of a residual toner connecting member in the embodiment.

Figure 12:
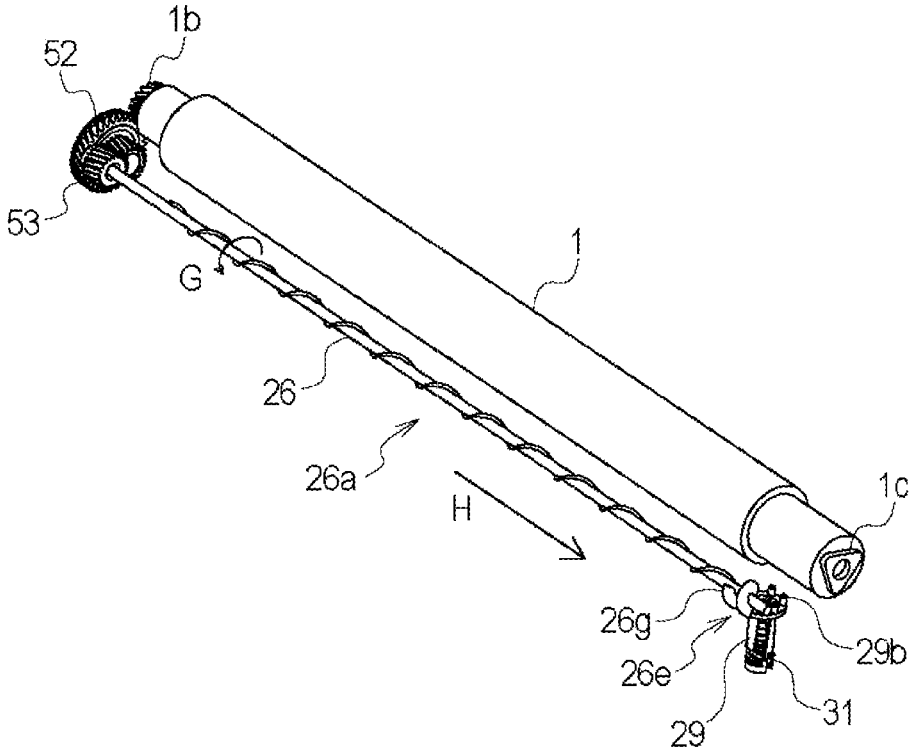

FIG. 12 illustrates parts constituting a driving connection structure of the residual toner discharging portion in the embodiment.

Figure 13:
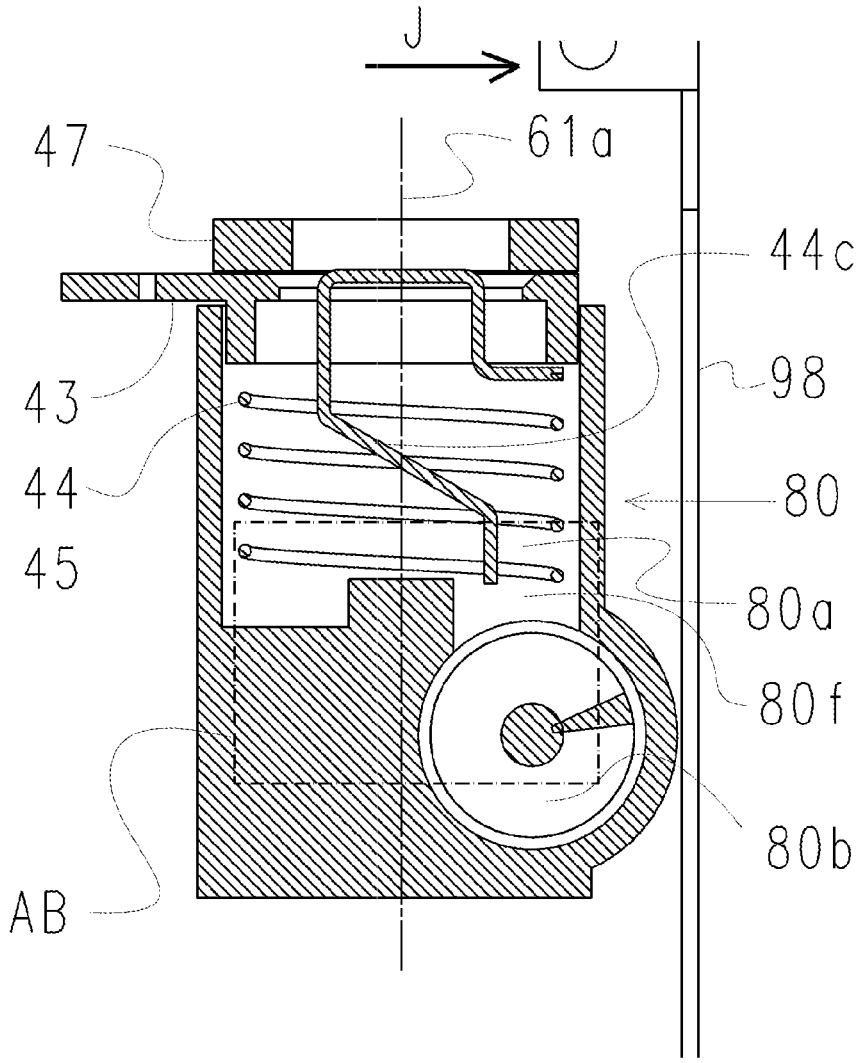

FIG. 13 illustrates an inserting direction of the process cartridge into the image forming apparatus in the embodiment.

Figure 14:
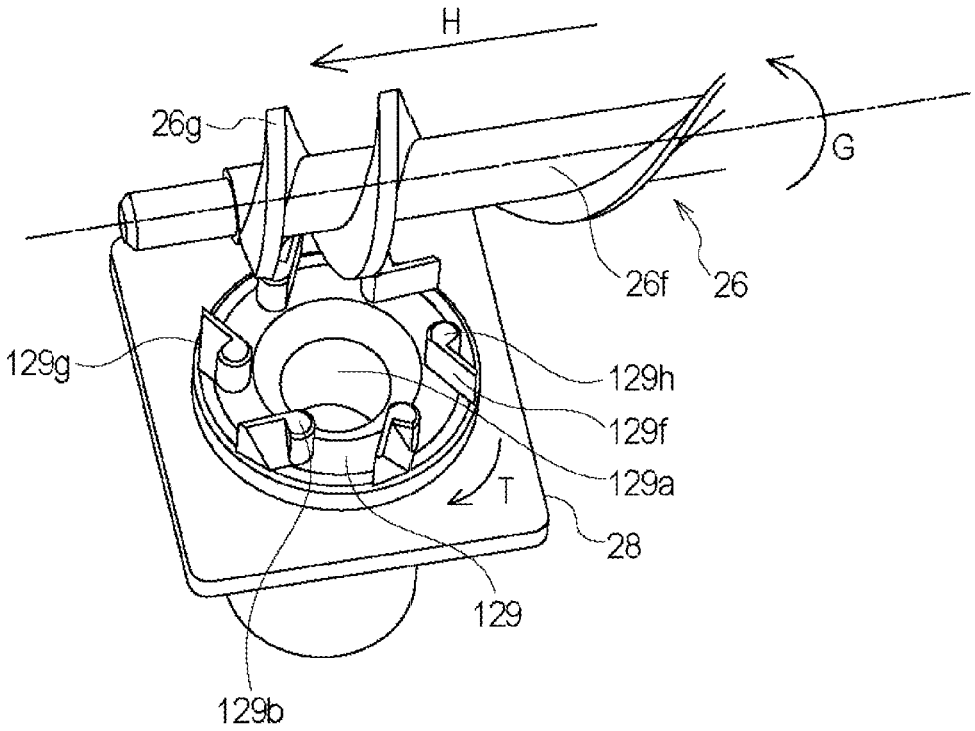

FIG. 14 is a perspective view illustrating a coupling of another example in the embodiment.

Figure 15:
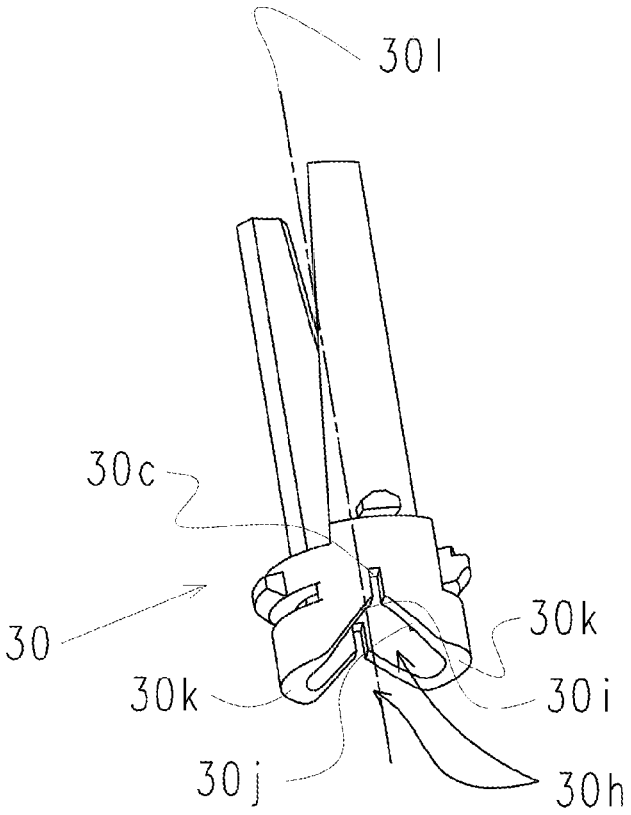

FIG. 15 is a perspective view of a vibration member in the embodiment.

Figure 16:
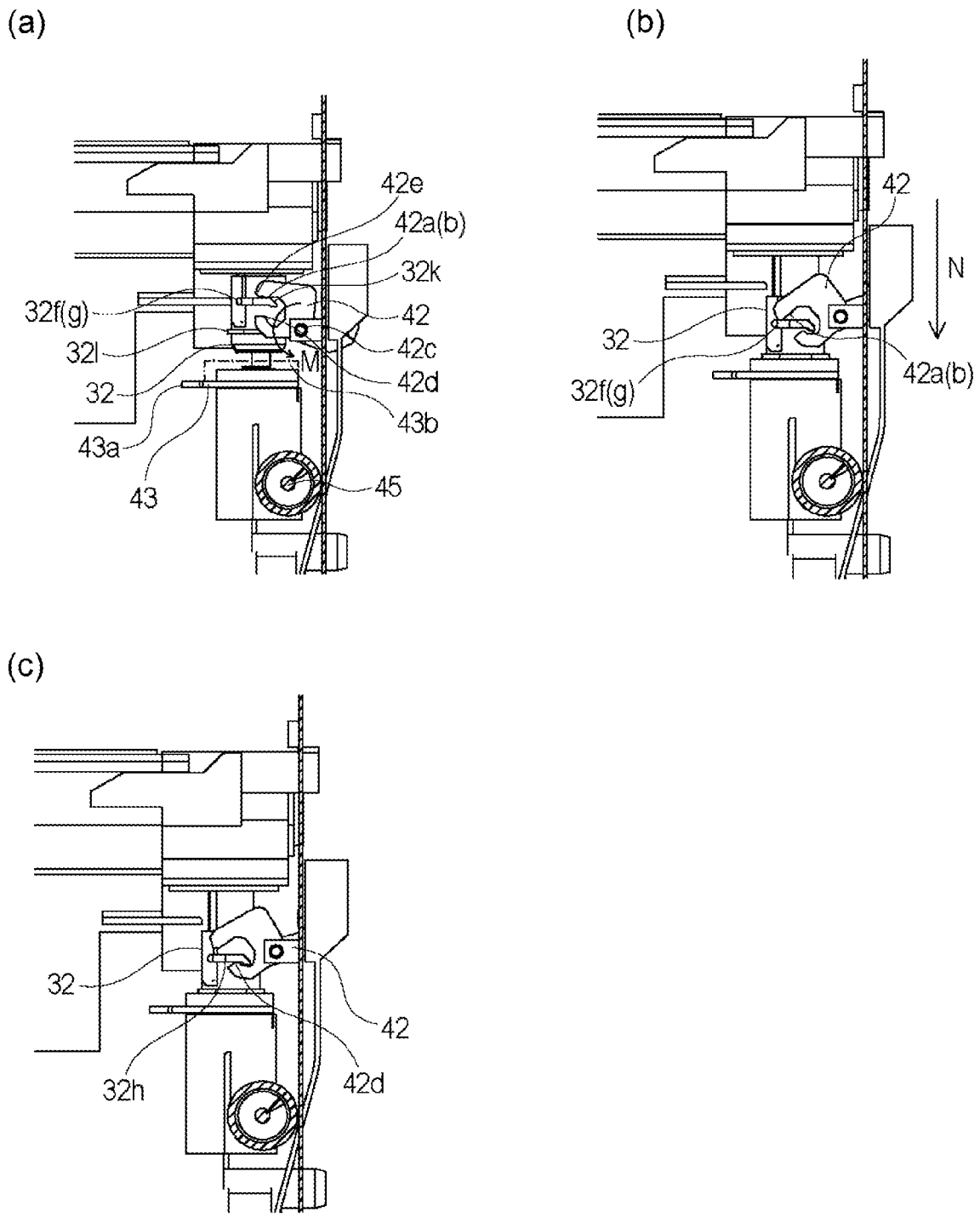

Parts (a), (b) and (c) of FIG. 16 are perspective views illustrating a connecting method of the residual toner discharging portion in the embodiment.

Figure 17:
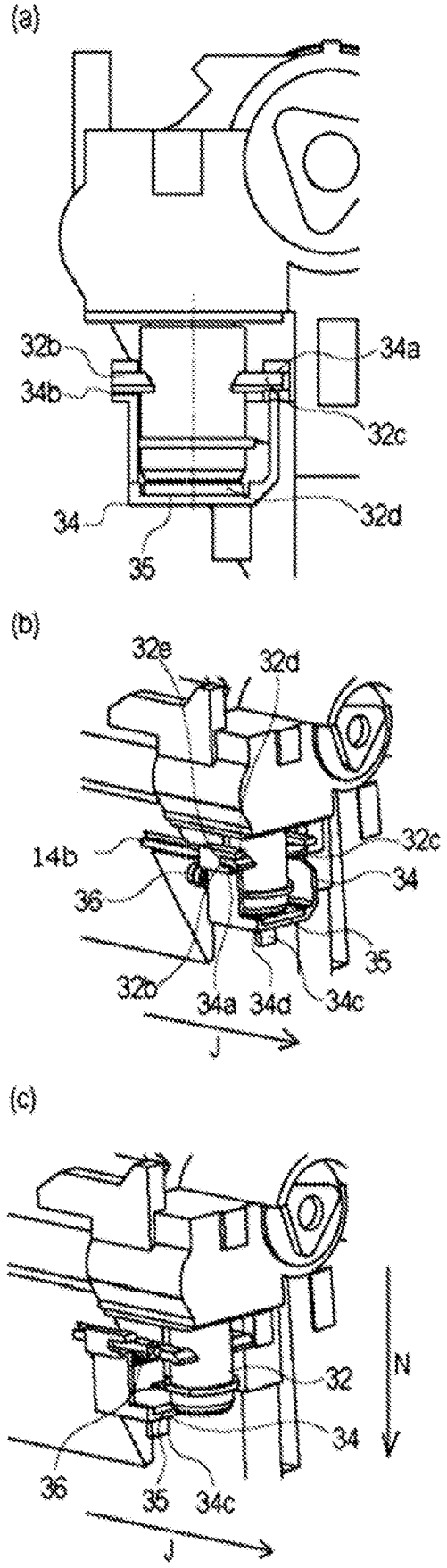

Parts (a), (b) and (c) of FIG. 17 are perspective views illustrating a structure of a shutter for a residual toner discharge opening in the embodiment.

Figure 18:
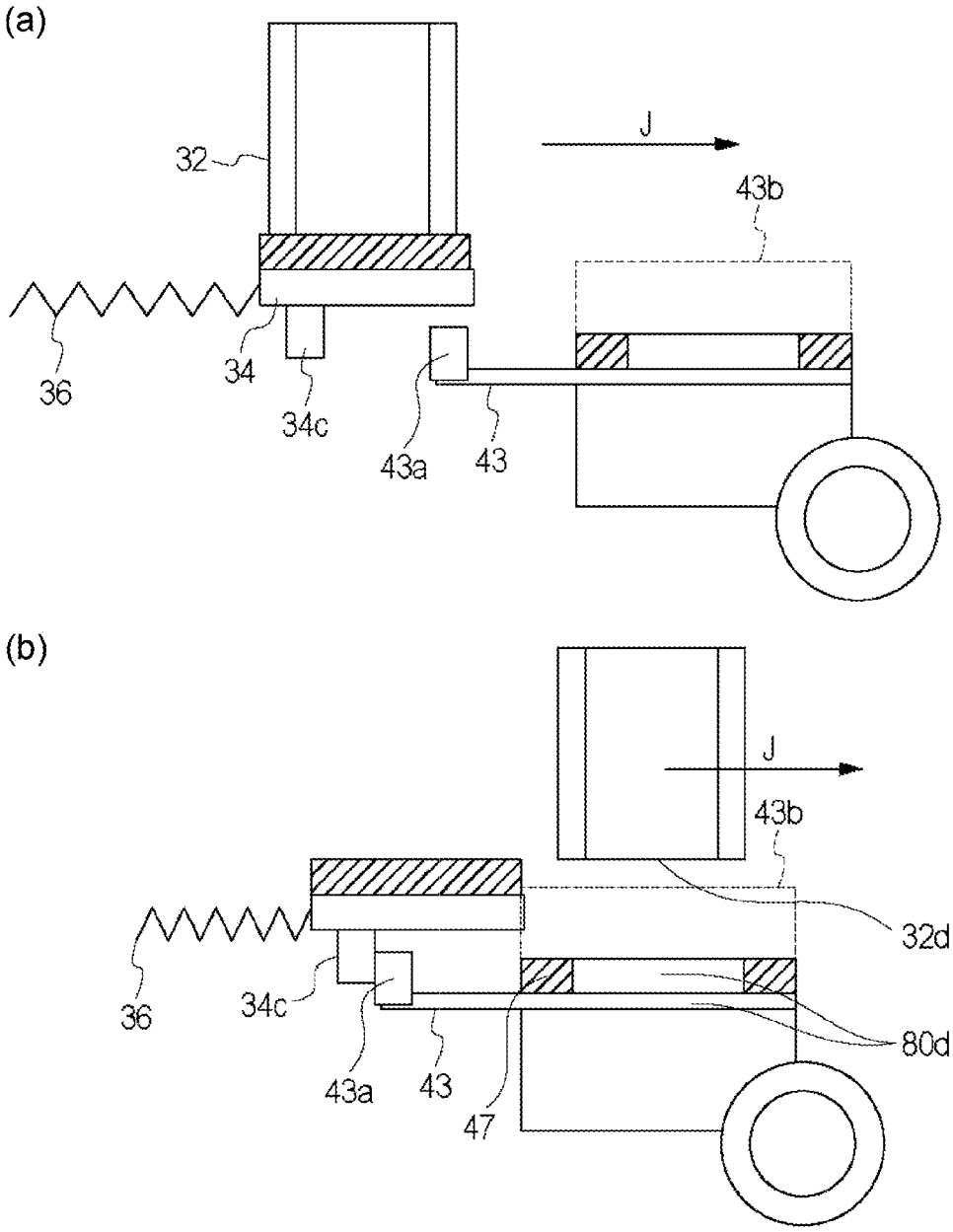

Parts (a) and (b) of FIG. 18 are sectional views illustrating motion of the shutter for the residual toner discharging portion at the time of mounting into the main assembly of the apparatus, in the embodiment.

Figure 19:
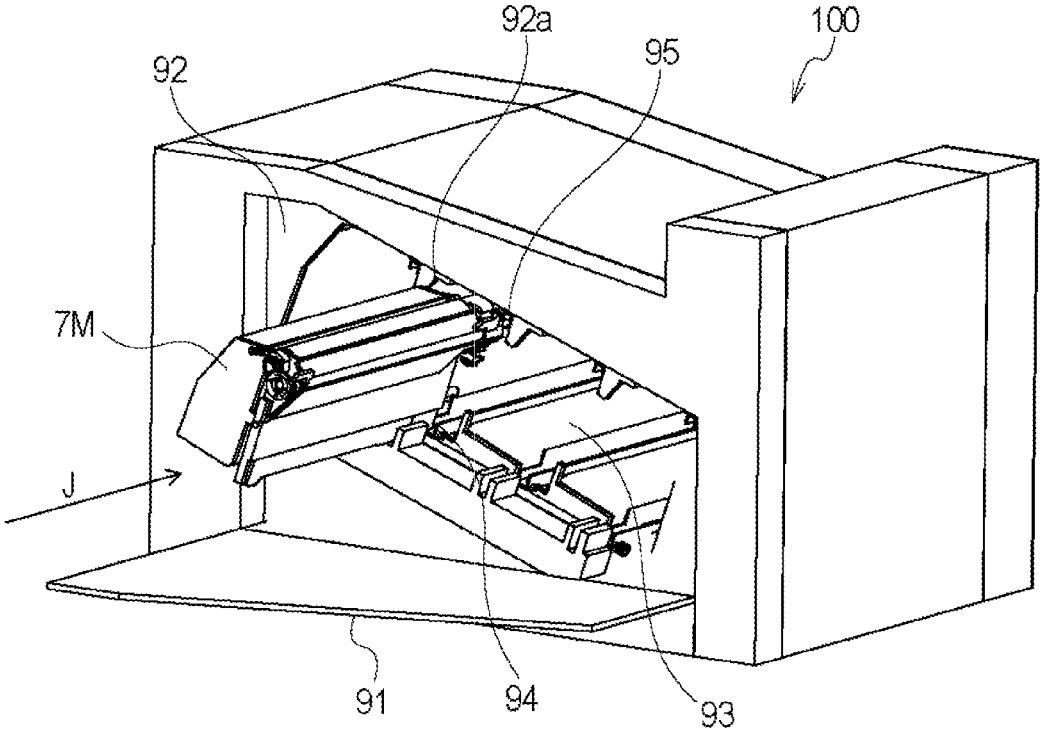

FIG. 19 is a perspective view illustrating an open state of a front door of the main assembly in the embodiment.

Figure 20:
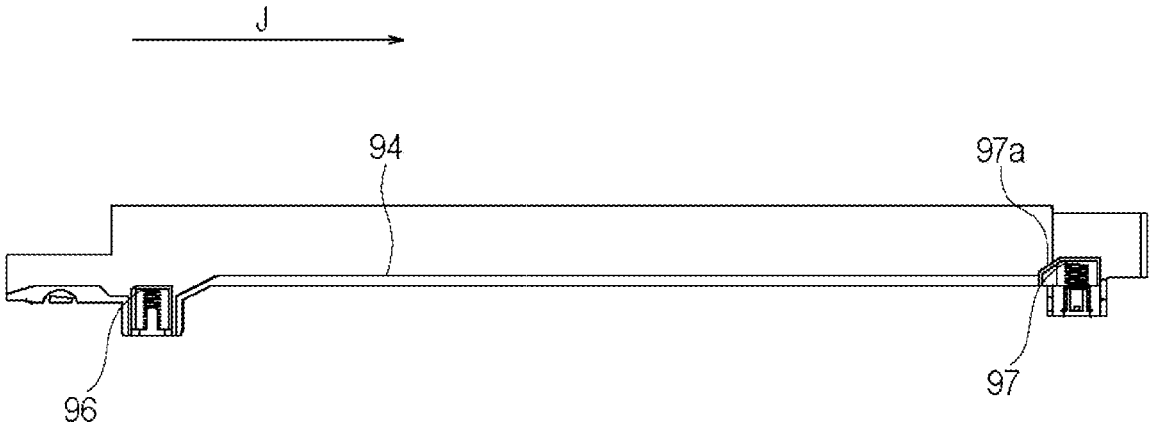

FIG. 20 is a sectional view illustrating a configuration of a lower guide of the main assembly, for the cartridge in the embodiment.

Figure 21:
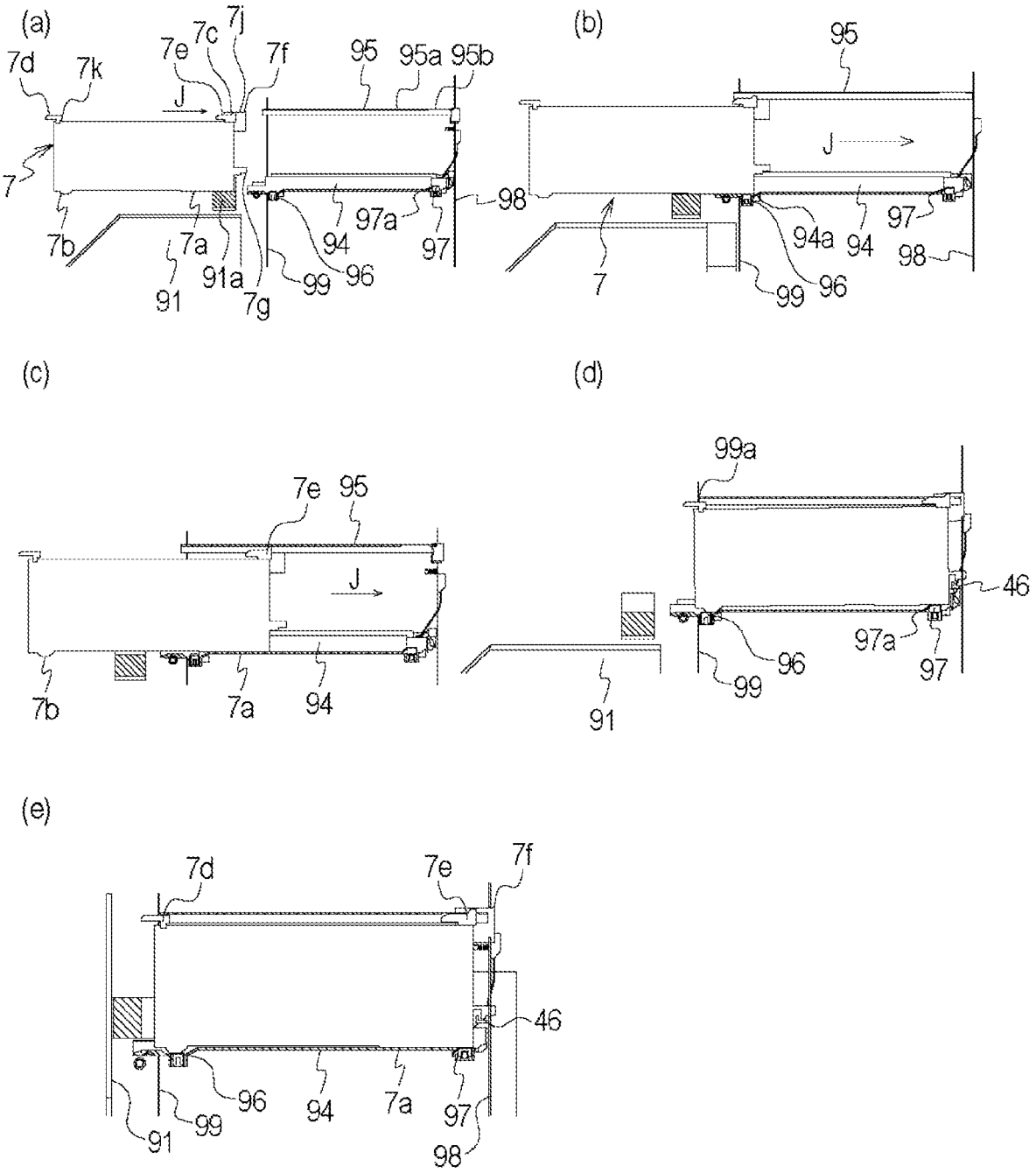

Part (a), (b), (c), (d) and (e) of FIG. 21 are sectional views illustrating a track of the process cartridge mounting into the main assembly of the apparatus in the embodiment.

Figure 22:
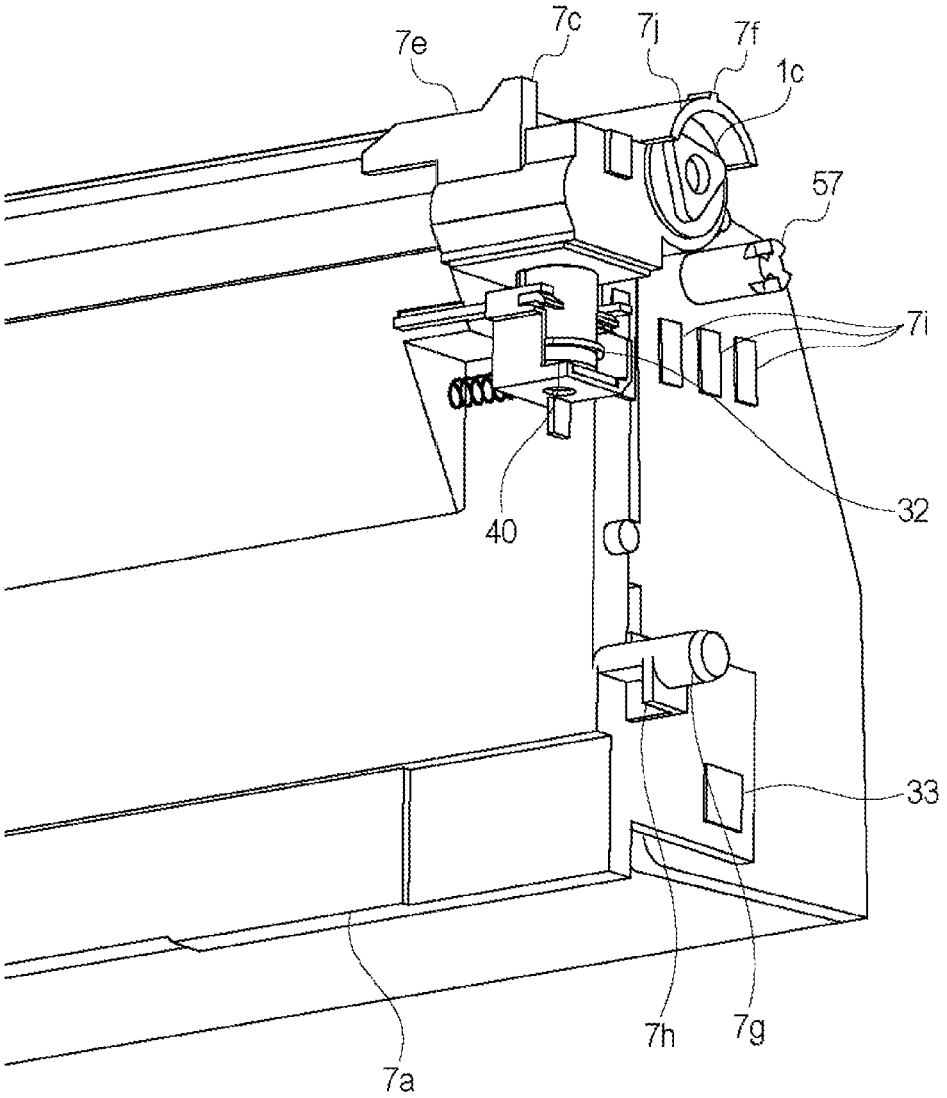

FIG. 22 is a perspective view illustrating a structure of a rear side with respect to a mounting direction of the process cartridge in the embodiment.

Figure 23:
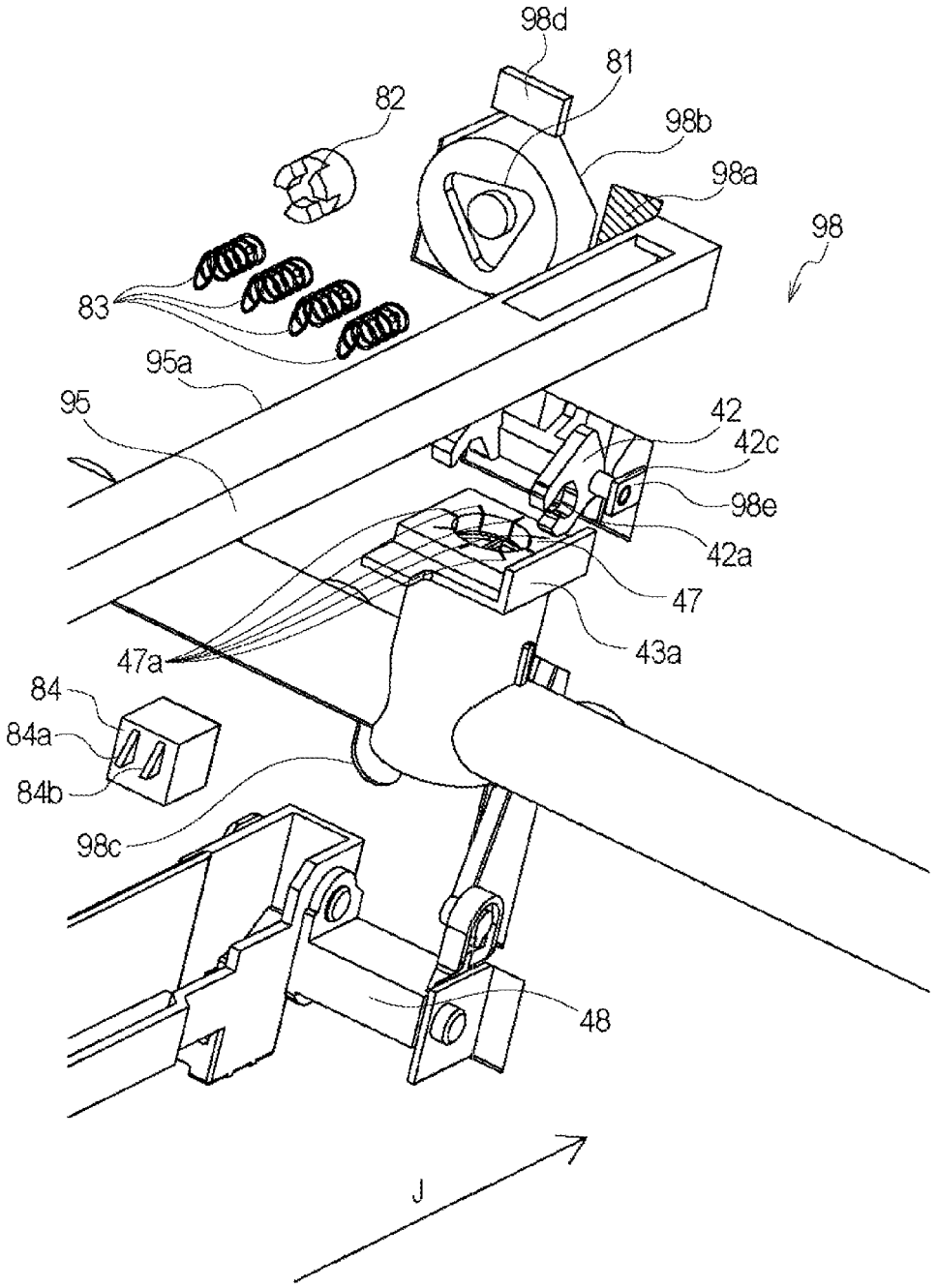

FIG. 23 is a perspective view illustrating a structure of the rear side of the main assembly with respect to the mounting direction of the process cartridge.

Figure 24:
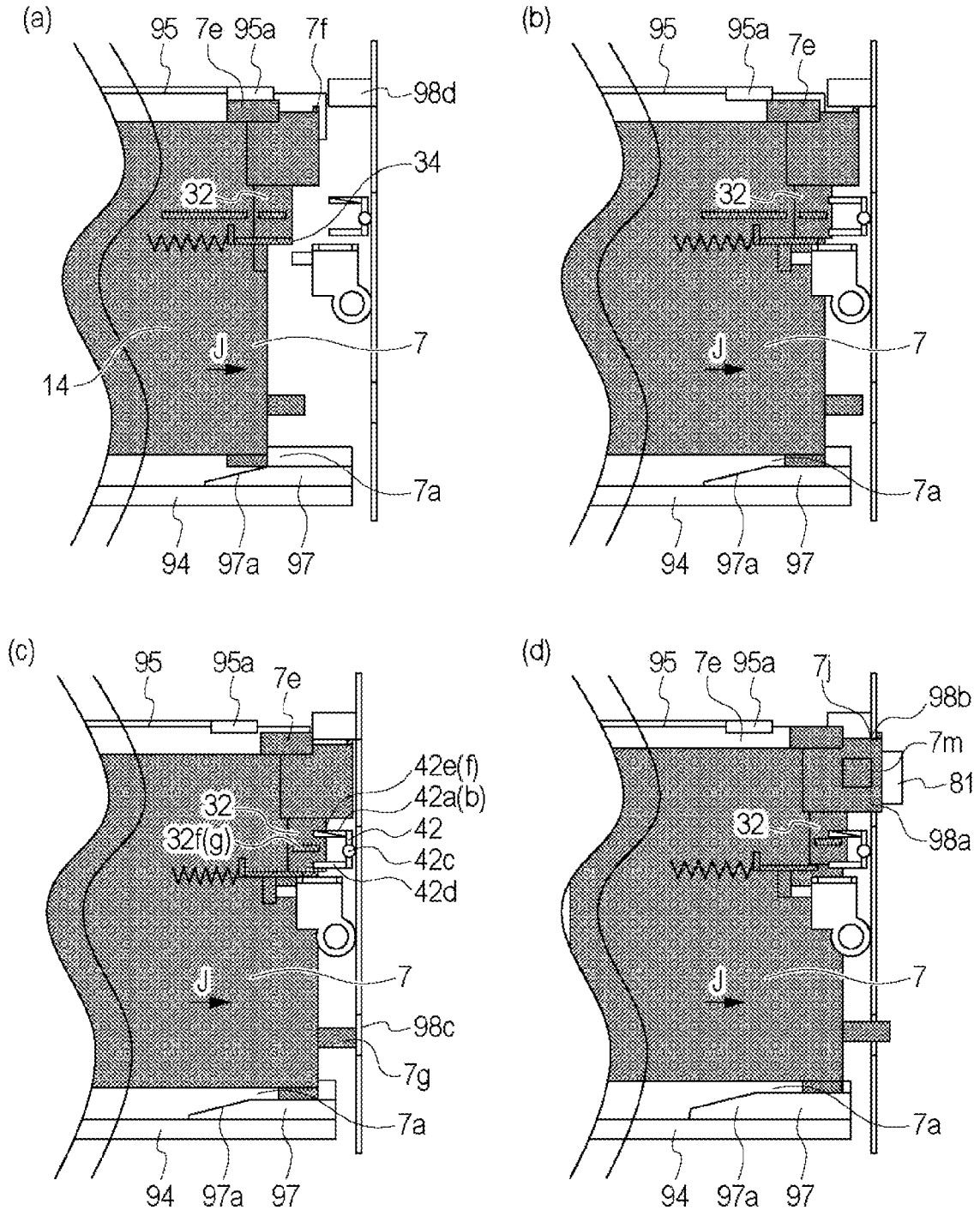

Part (a), (b), (c) and (d) of FIG. 24 are schematic views illustrating movement of the process cartridge to the completion of insertion to the rear side of the main assembly in the embodiment.

Figure 25:
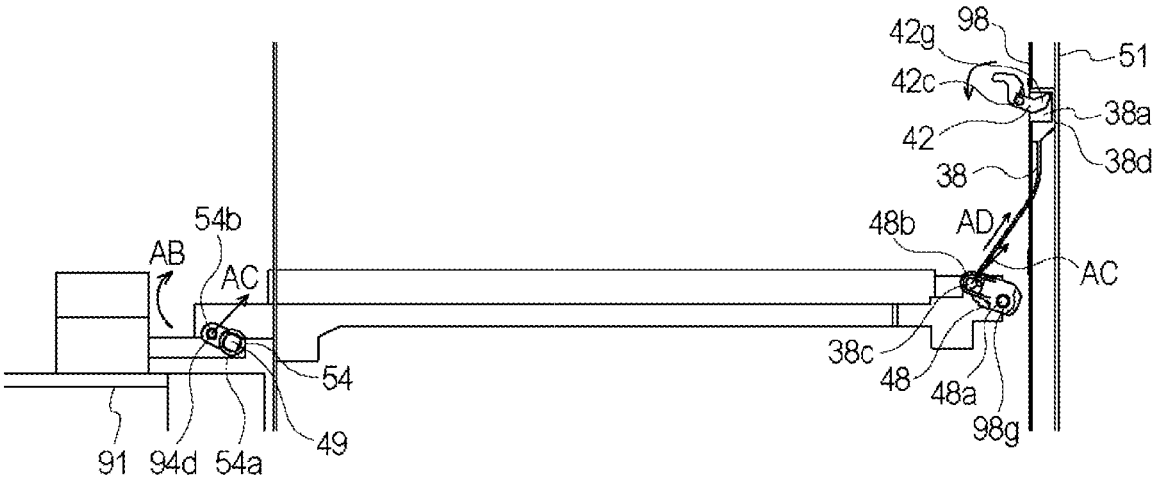
Figure 25:
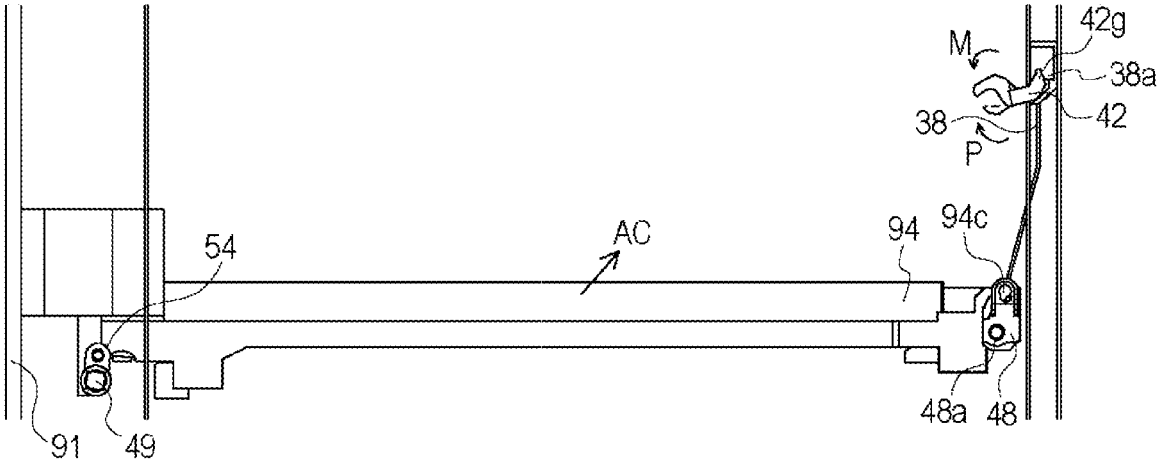

Parts (a) and (b) of FIG. 25 are schematic sectional views of an arm and a link structure of a front door.

Figure 26:
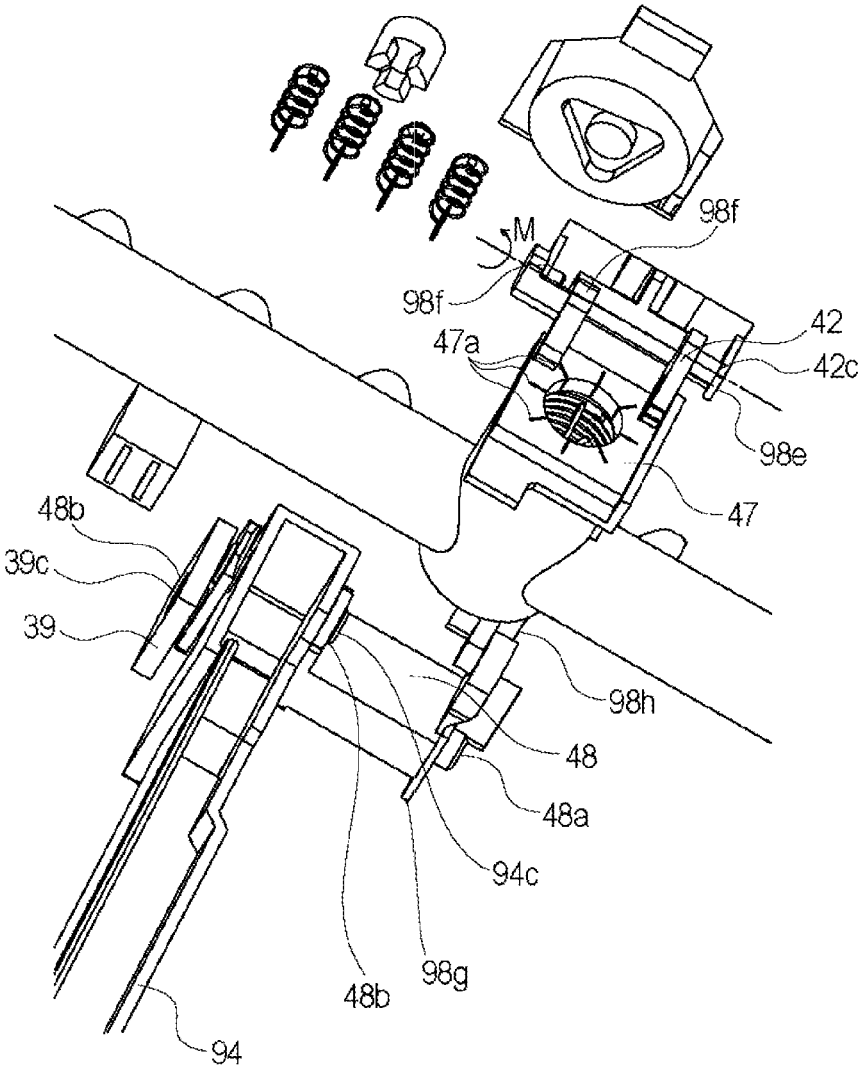

FIG. 26 is a perspective view illustrating a support structure for the front door link part in the rear side with respect to the mounting direction in the embodiment.

Figure 27:
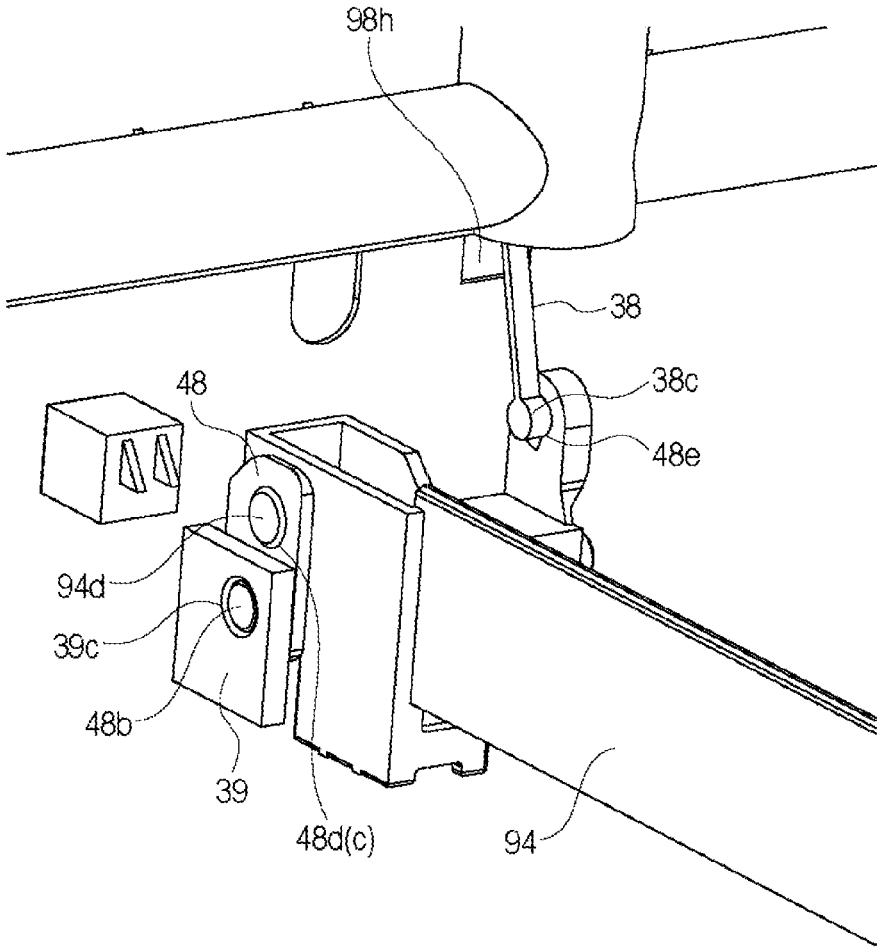

FIG. 27 is a perspective view of a support structure for the front door link part of the rear side with respect to the mounting direction, as seen in another direction, in the embodiment.

Figure 28:
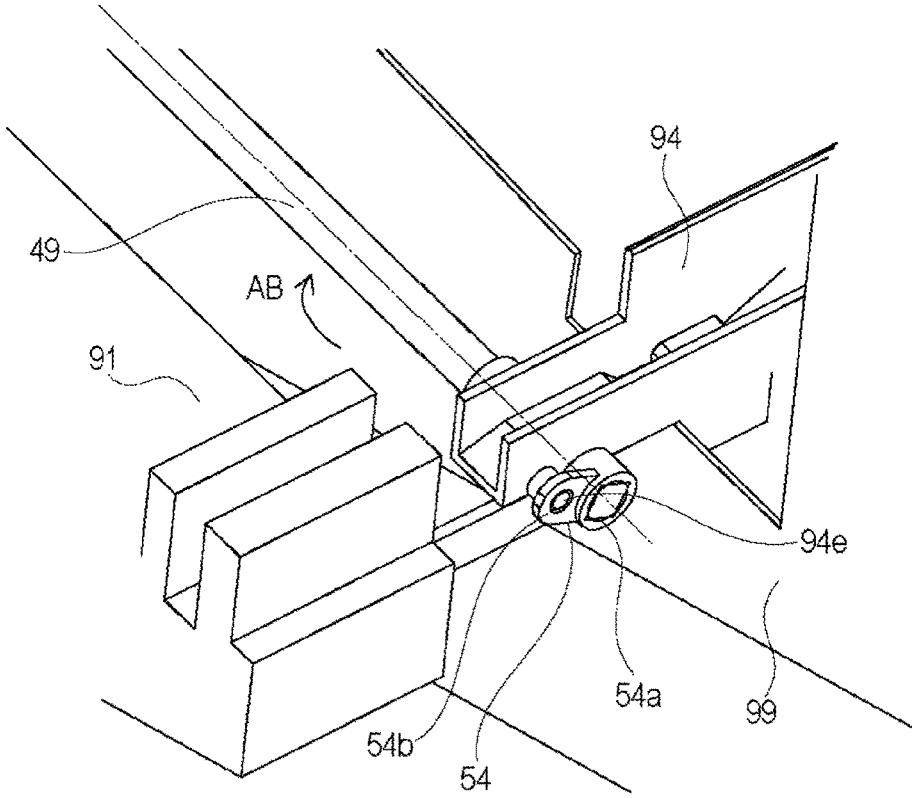

FIG. 28 is a perspective view illustrating the support structure of a front door link part of a front side with respect to the mounting direction at the time when the front door is open, in the embodiment.

Figure 29:
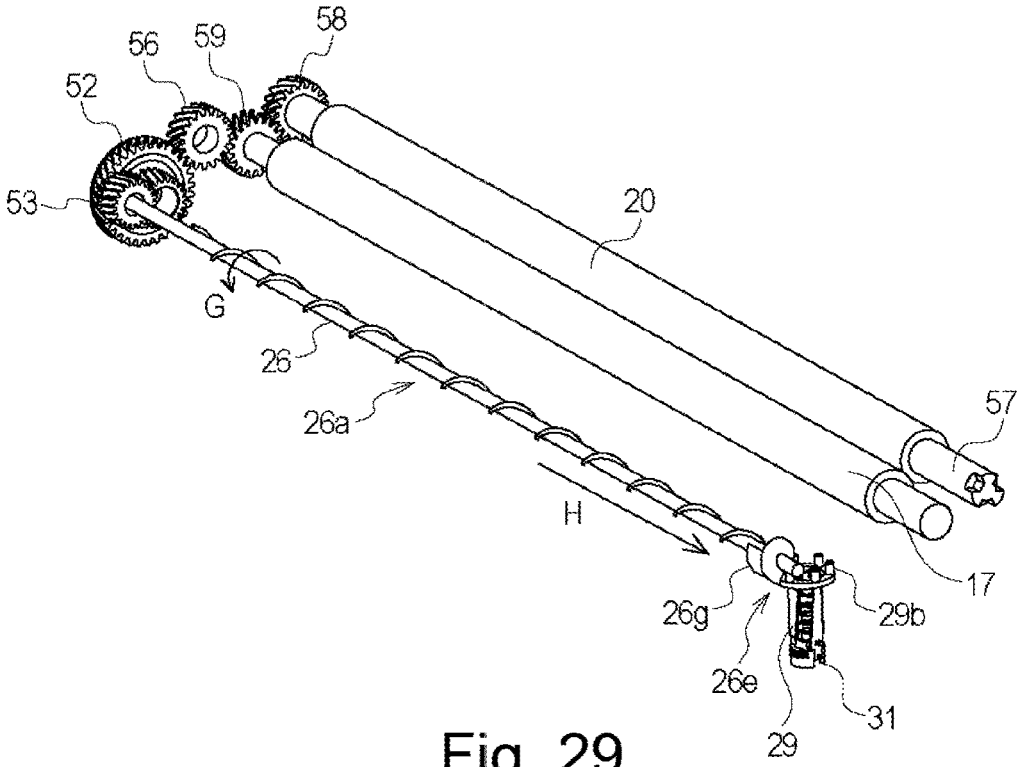

FIG. 29 is a part view illustrating a driving connection from a developing roller to a residual toner discharging portion in another structure in this embodiment.

Figure 30:
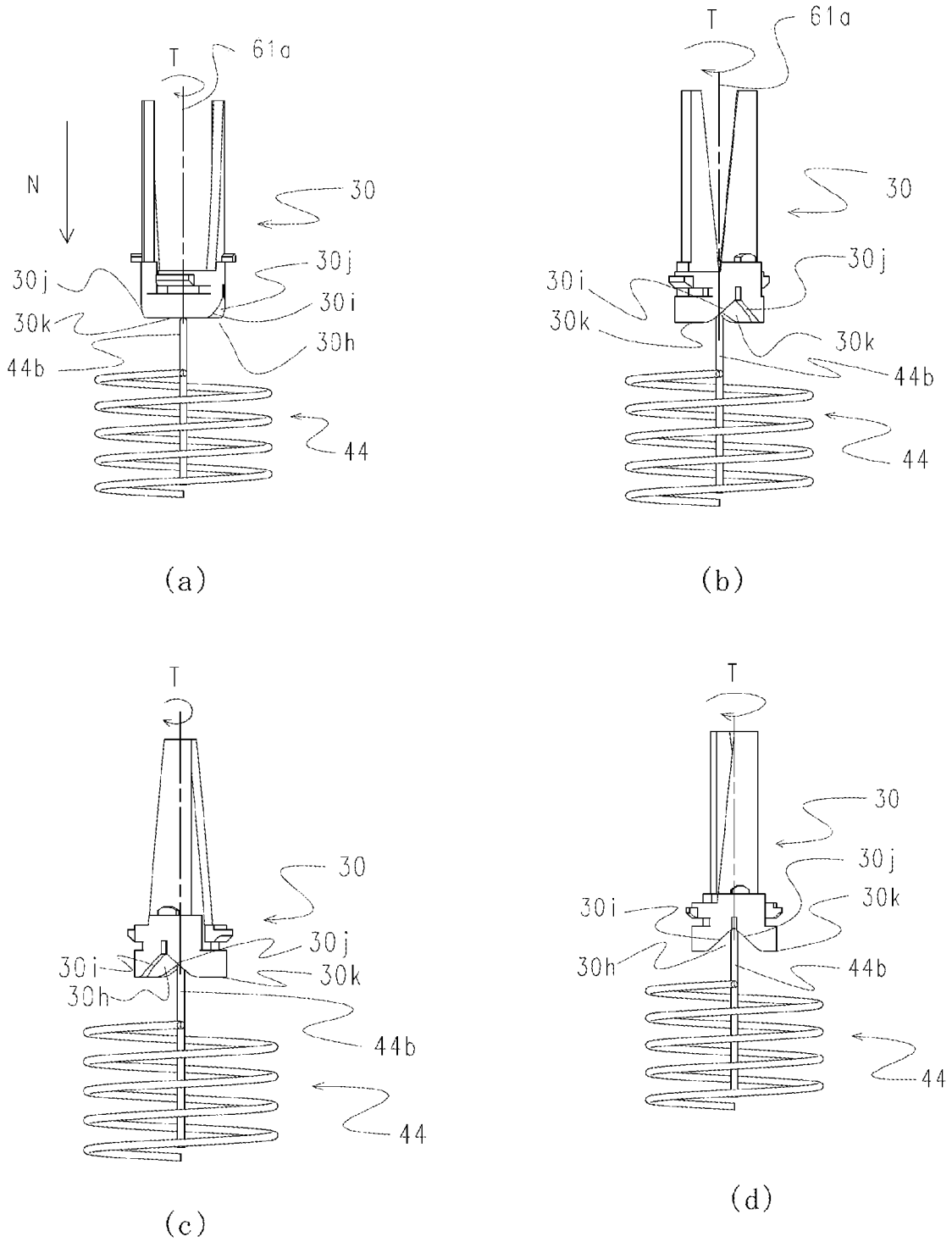

Part (a), (b), (c) and (d) of FIG. 30 are schematic views illustrating the transmission of the vibration of a second coupling member to the vibration member according to the embodiment.

Figure 31:
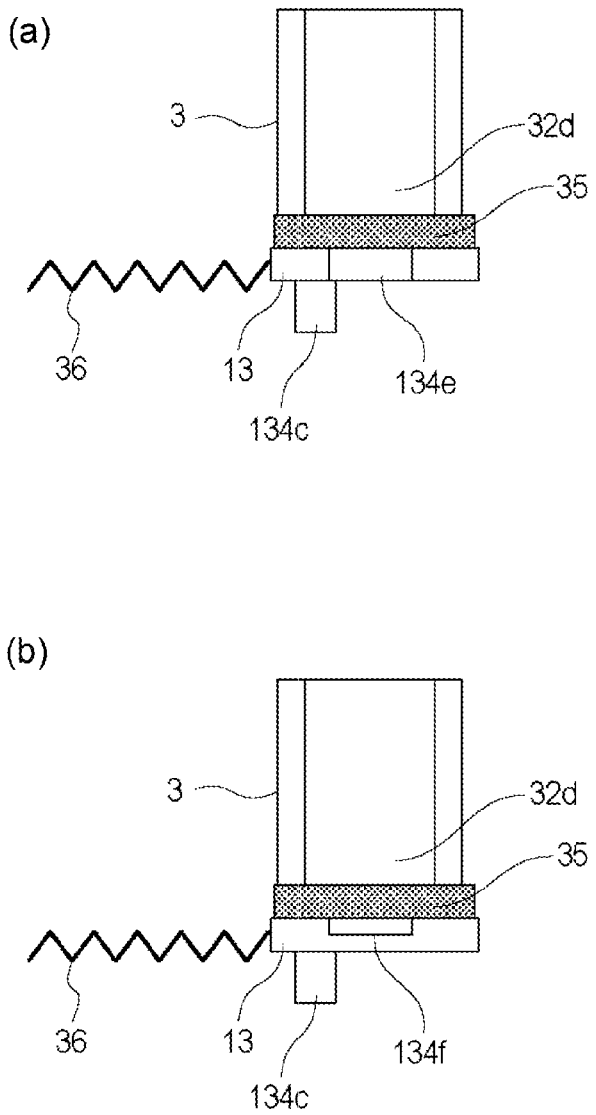

Parts (a) and (b) of FIG. 31 are sectional views illustrating the state in which the residual toner discharging portion is closed by the shutter, according to Embodiment 2 of the present invention.

Figure 32:
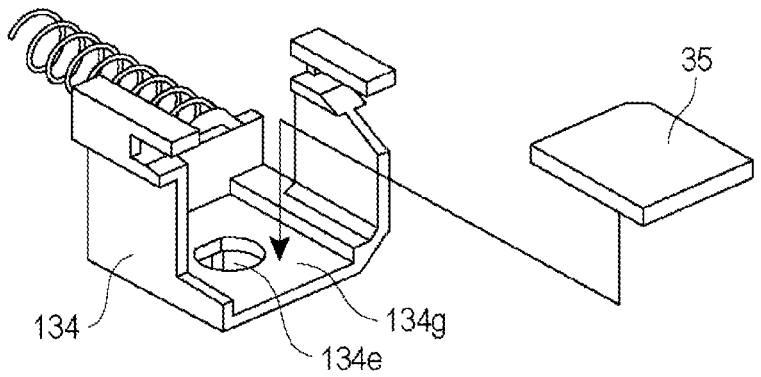

FIG. 32 is an exploded perspective views of a shutter and an elastic sealing member in Embodiment 2.

Figure 33:
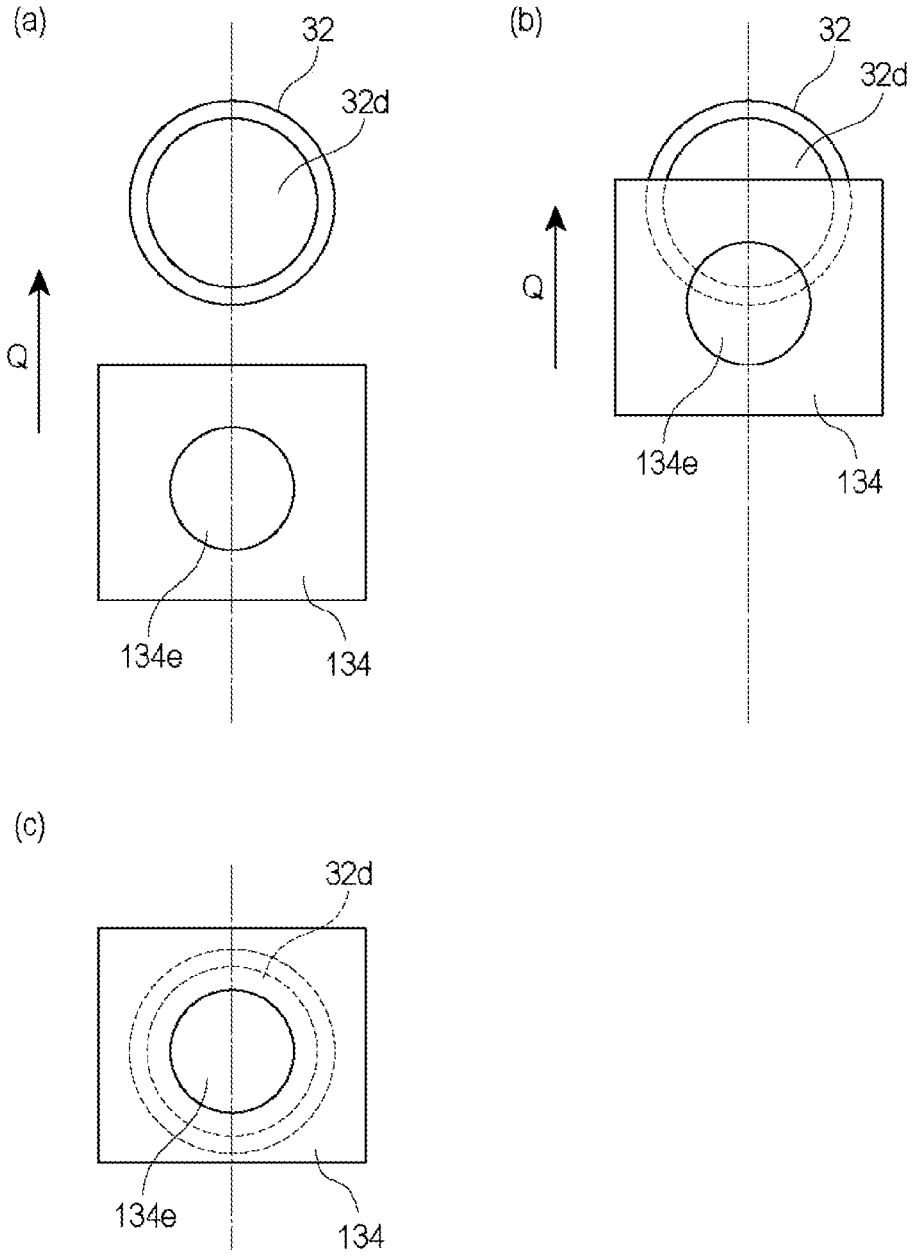

Parts (a), (b) and (c) of FIG. 33 are schematic views of a relationship at the time when the shutter closes the residual toner discharging portion, as seen from the shutter, in Embodiment 2.

Figure 34:
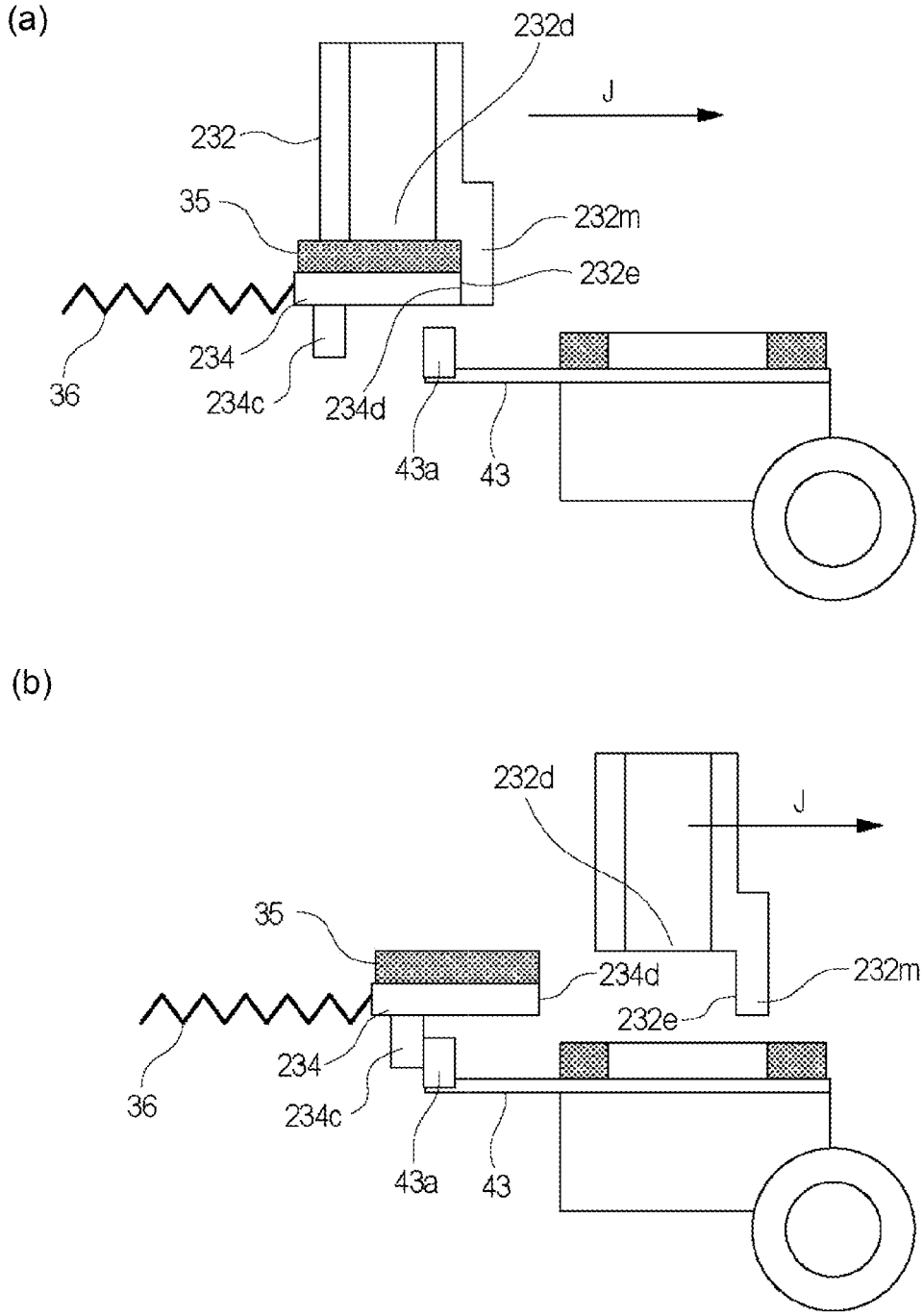

Parts (a) and (b) of FIG. 34 are sectional views illustrating motion of the shutter for the residual toner discharging portion at the time of mounting into the main assembly of the apparatus, according to Embodiment 3.

Figure 35:
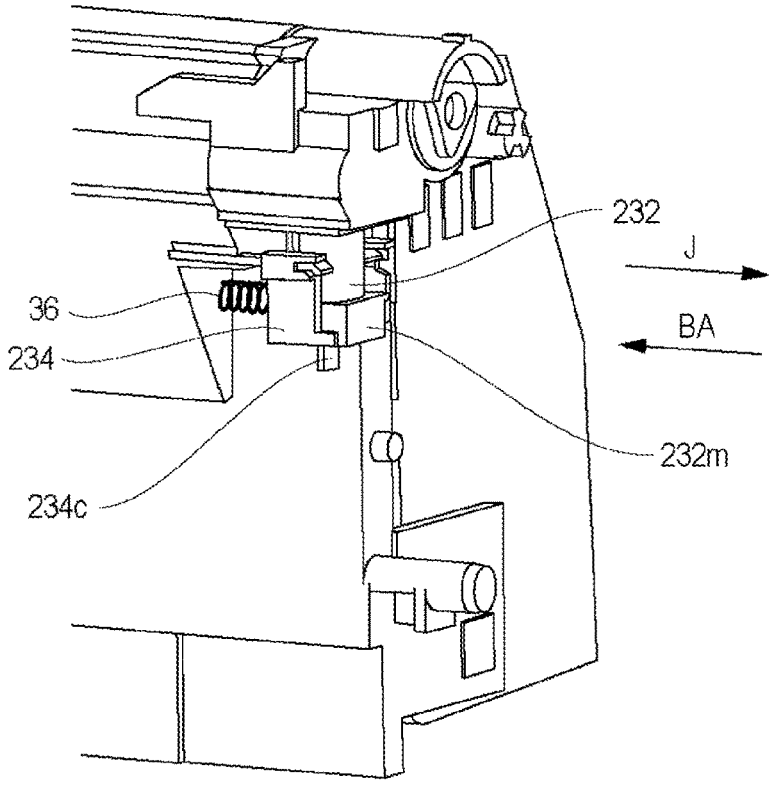

FIG. 35 is a perspective view illustrating a positional relation between the residual toner connecting member and the shutter in Embodiment 3.

Figure 36:
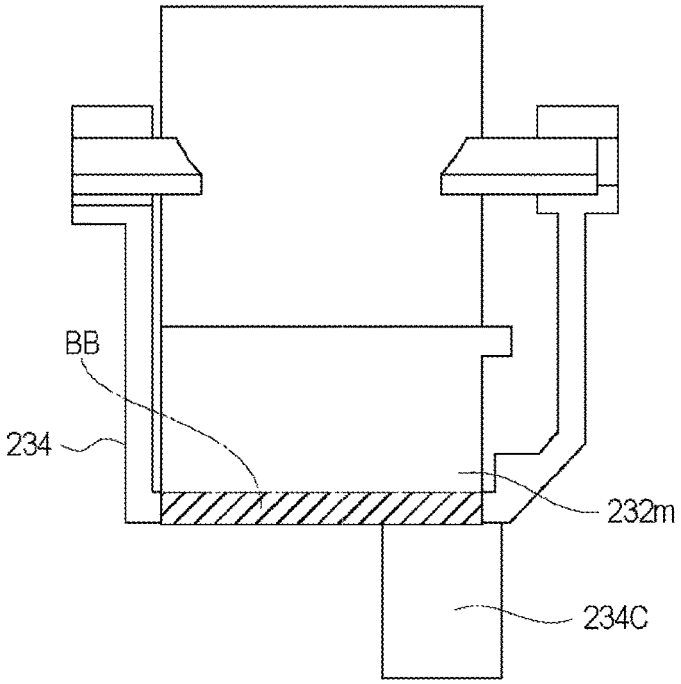

FIG. 36 is a side view illustrating a positional relation between a wall portion of the residual toner connecting member and the shutter in Embodiment 3.

Figure 37:
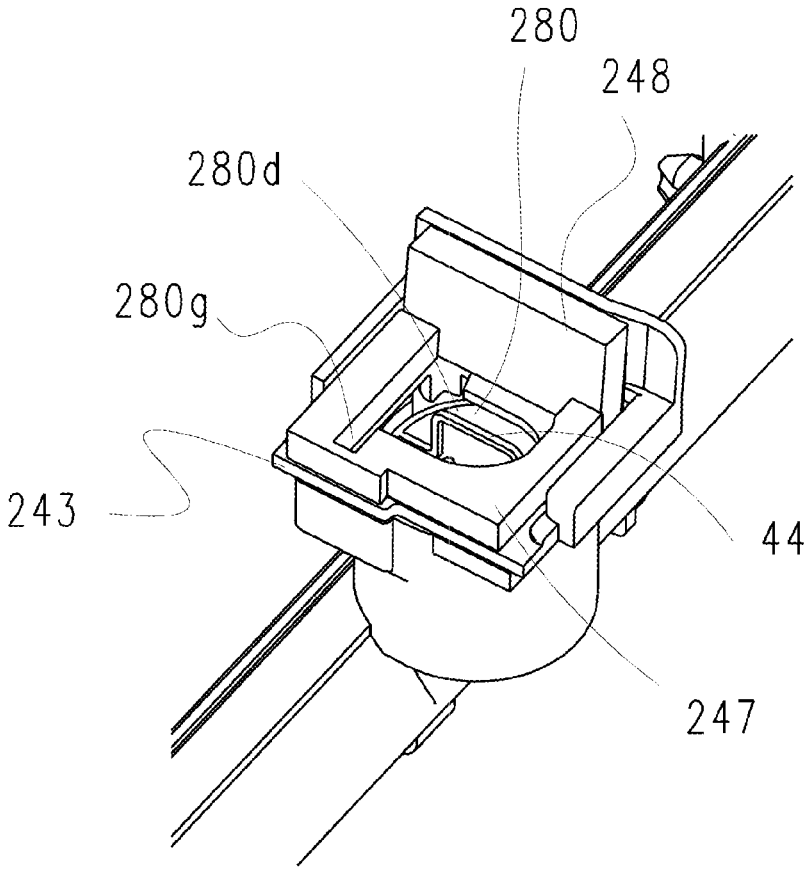

FIG. 37 is an outer appearance illustrating a main assembly structure according to Embodiment 3.

Figure 38:
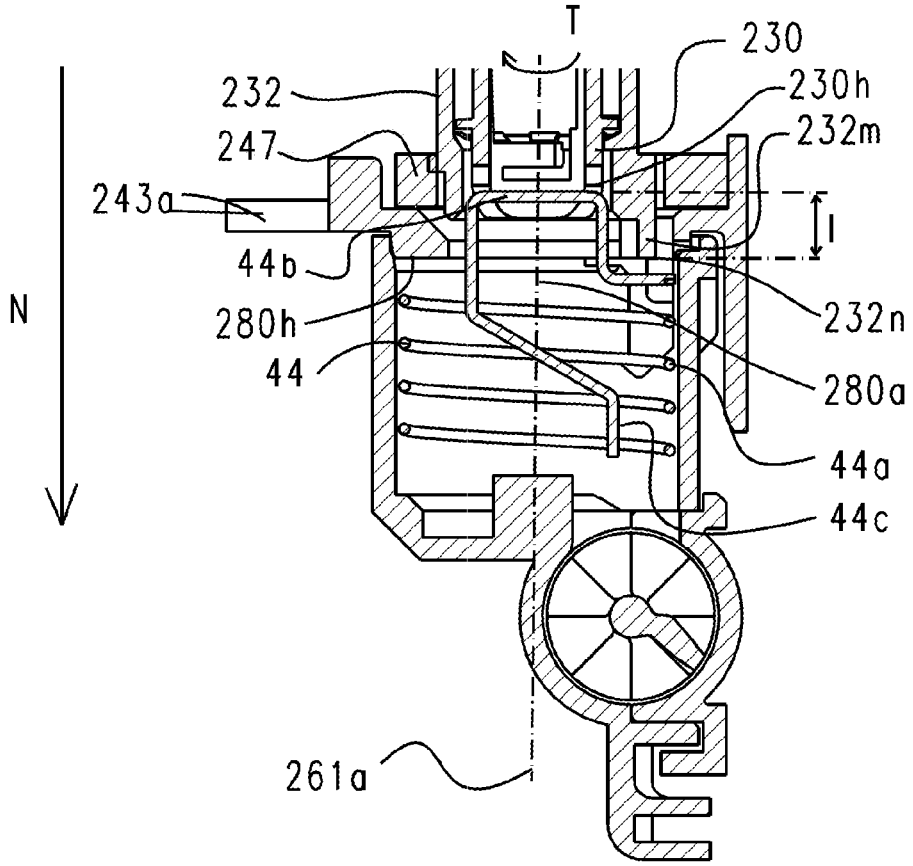

FIG. 38 is a sectional view illustrating engagement between the main assembly and the cartridge in Embodiment 3.

Figure 39:
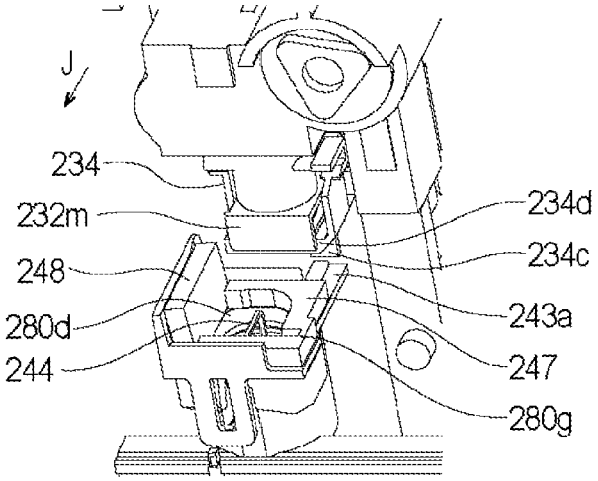
Figure 39:
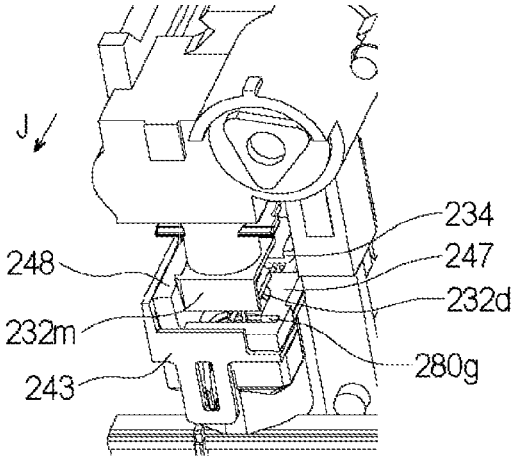
Figure 39:
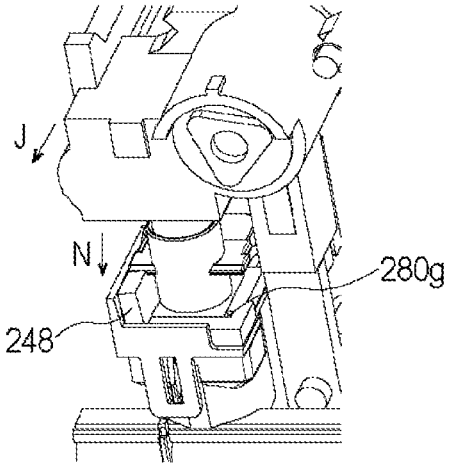

Parts (a), (b) and (c) of FIG. 39 illustrate an inserting operation of the process cartridge in Embodiment 3.

Figure 40:
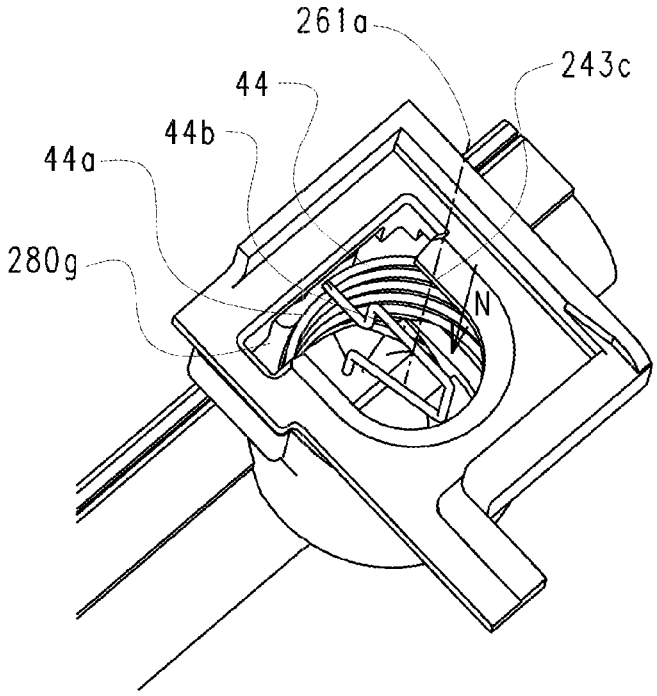

FIG. 40 is an outer appearance of a main assembly residual toner receiving opening in which a main assembly reception sealing member and a longitudinal seal are removed from a spring stopper, in Embodiment 3.

Figure 41:
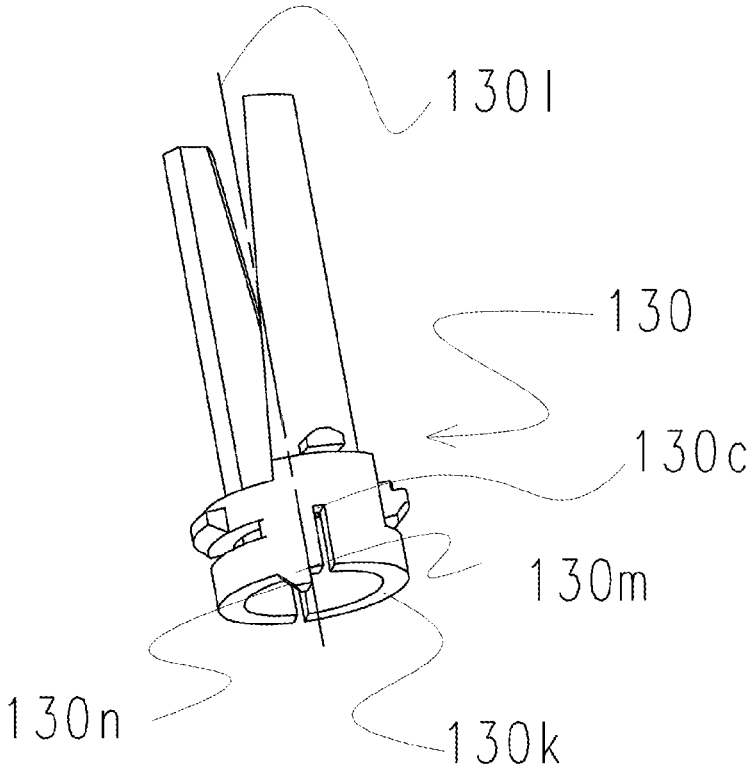

FIG. 41 is a perspective view illustrating another example of the vibration member according to the embodiment.

Figure 42:
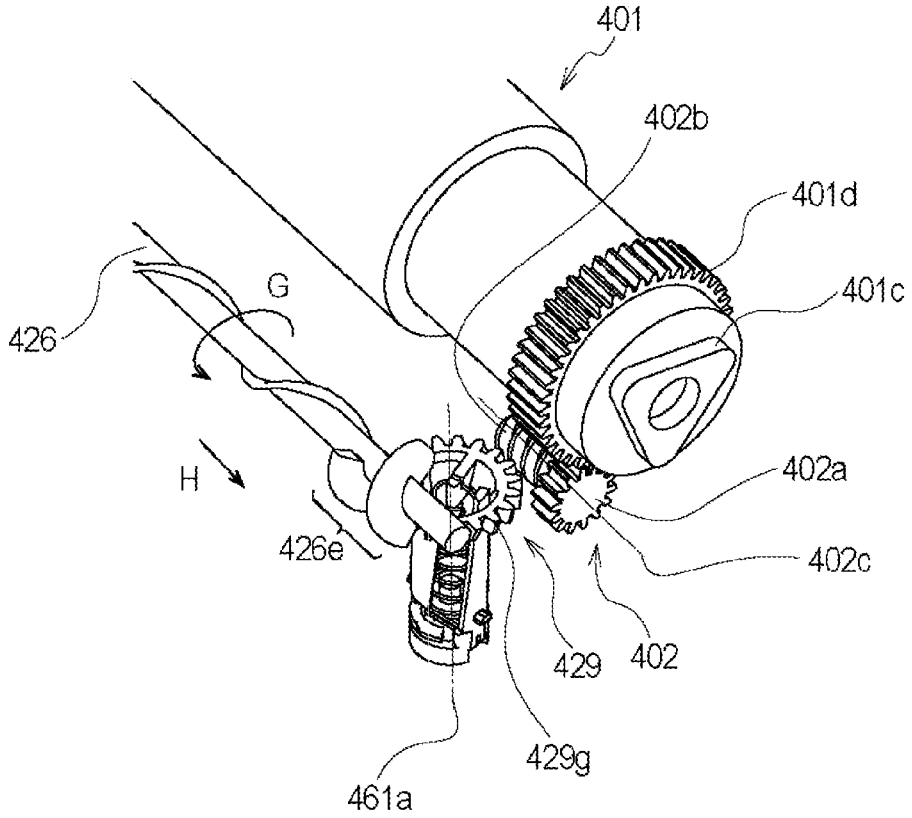

FIG. 42 is a schematic view illustrating a drive transmission structure for transmission from the feeding screw to a first coupling in Embodiment 4.

Figure 43:
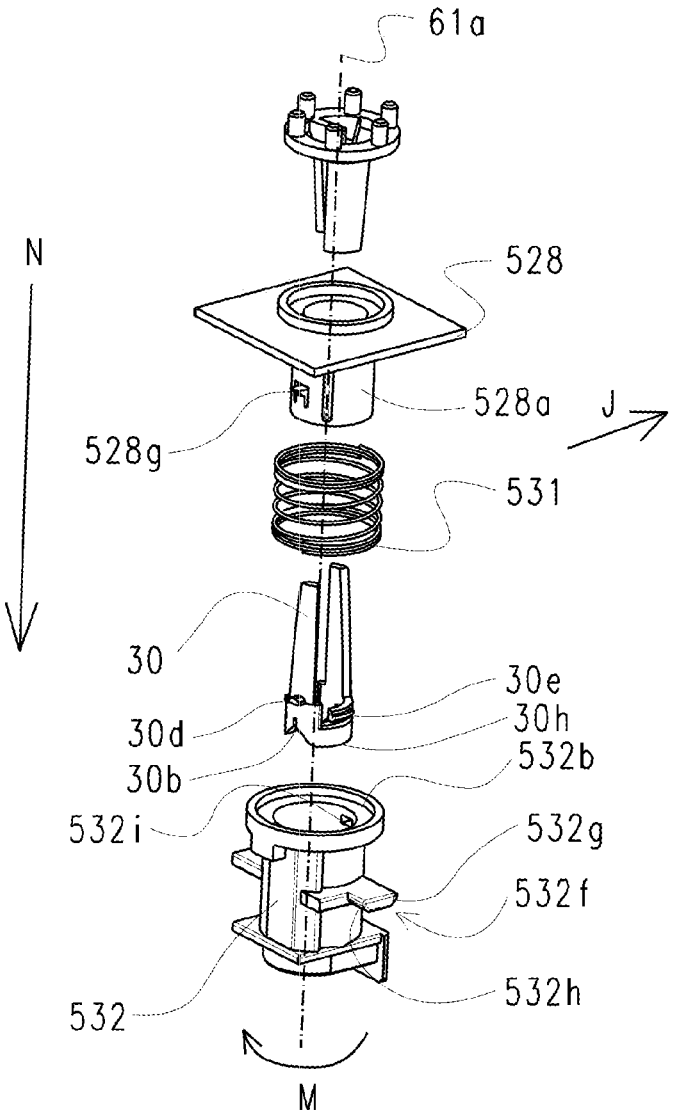

FIG. 43 is an exploded view illustrating a structure of a residual toner connecting portion in Embodiment 5.

Figure 44:
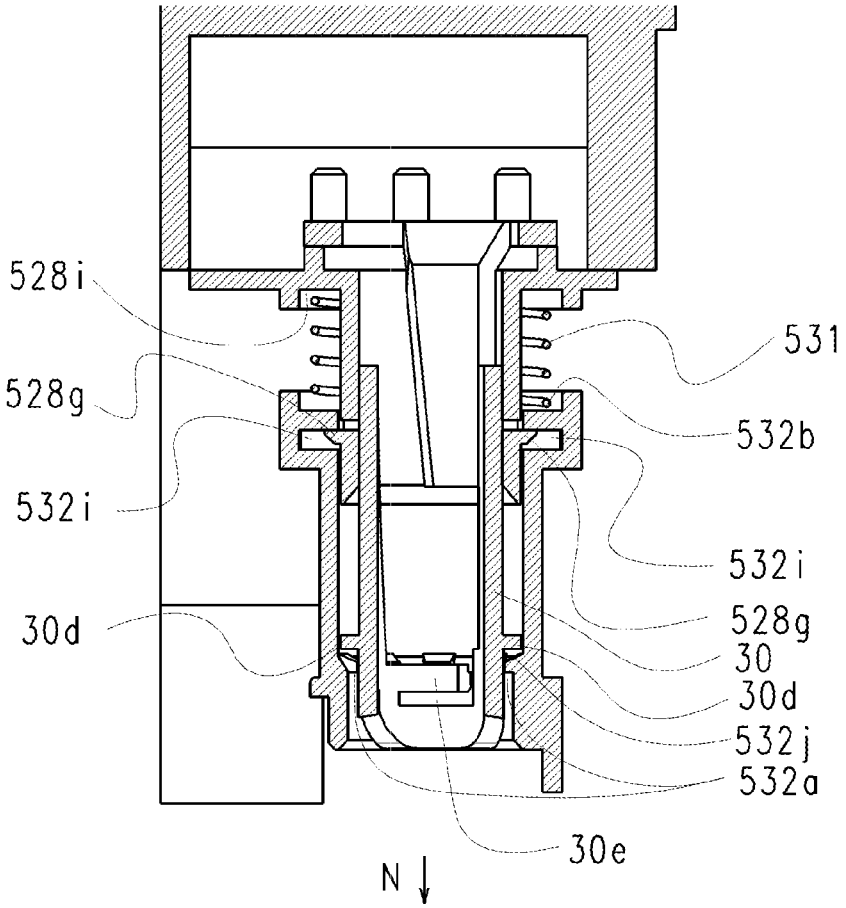

FIG. 44 is a sectional view illustrating of a structure of a residual toner connecting portion in Embodiment 5.

Figure 45:
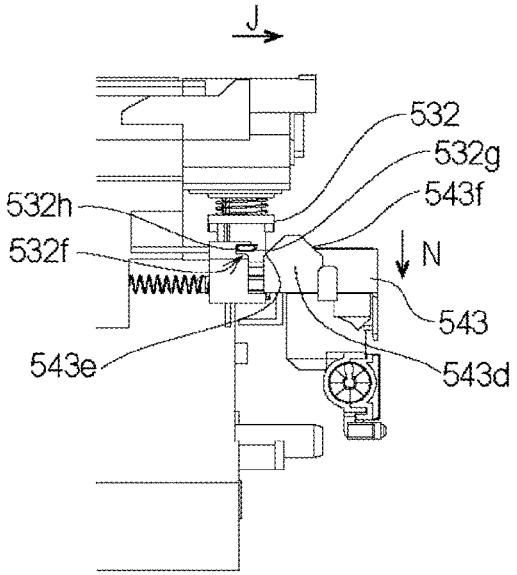
Figure 45:
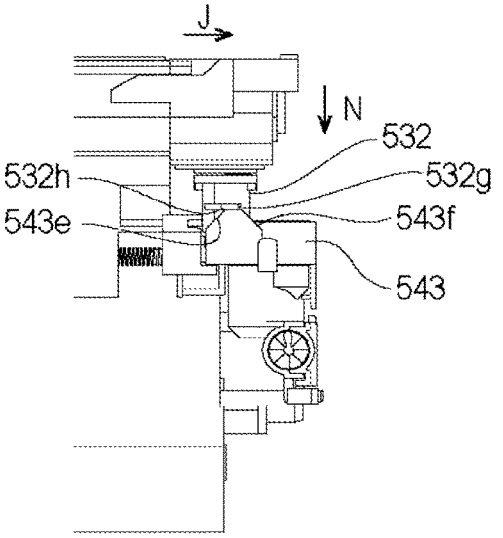
Figure 45:
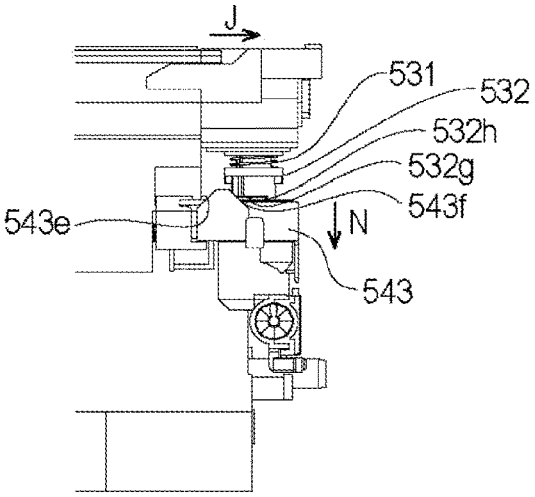

Parts (a), (b) and (c) of FIG. 45 are cartridge mounting views illustrating a connecting method between the residual toner connecting portion and the main assembly in Embodiment 5.

Figure 46:
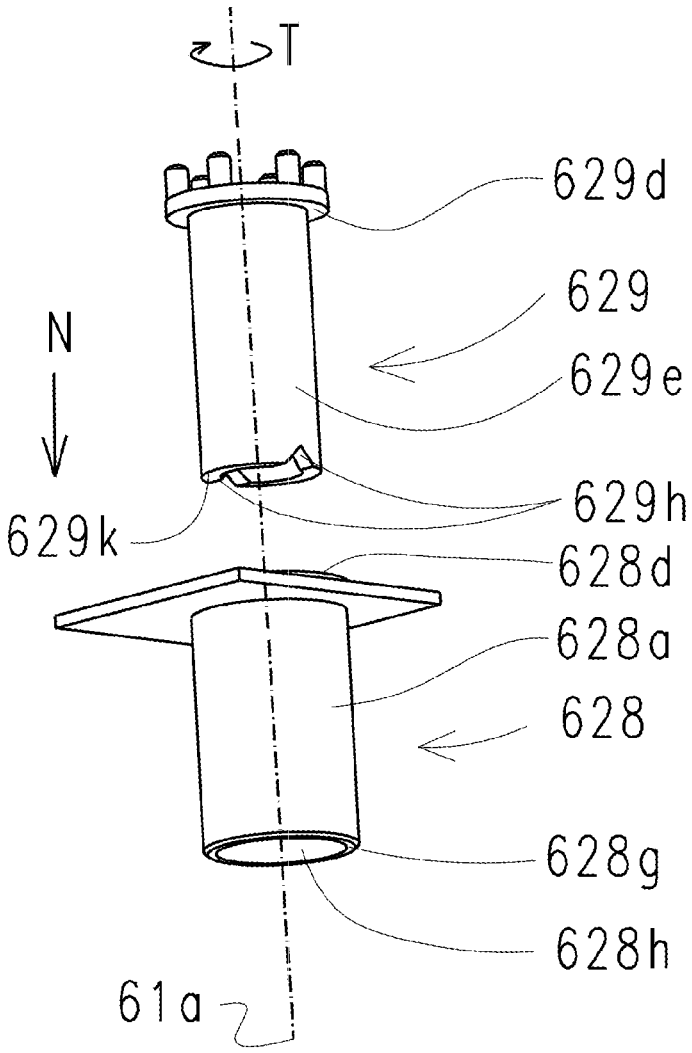

FIG. 46 is an exploded view of parts in Embodiment 6.

Figure 47:
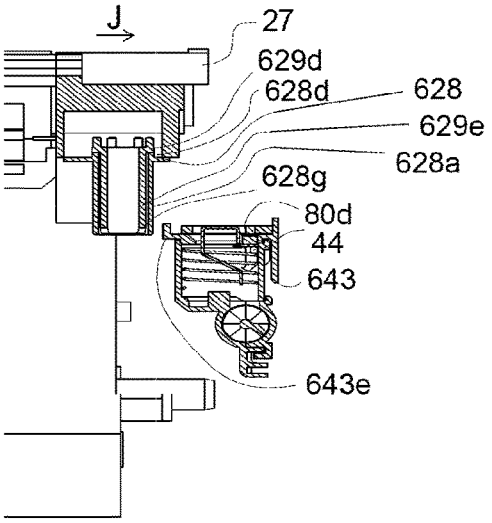
Figure 47:
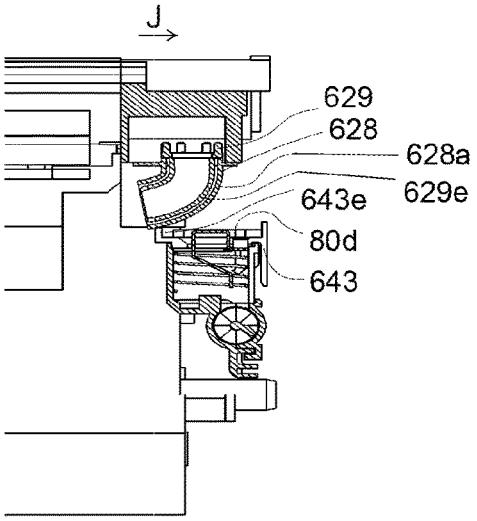
Figure 47:
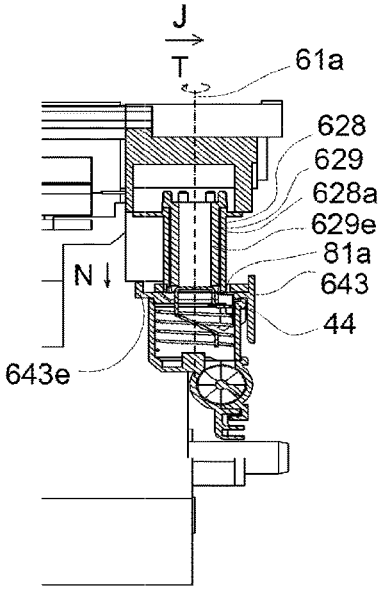

Parts (a), (b) and (c) of FIG. 47 are sectional views of mounting, illustrating a connecting method between the residual toner connecting portion and the main assembly in Embodiment 6.

Figure 48:
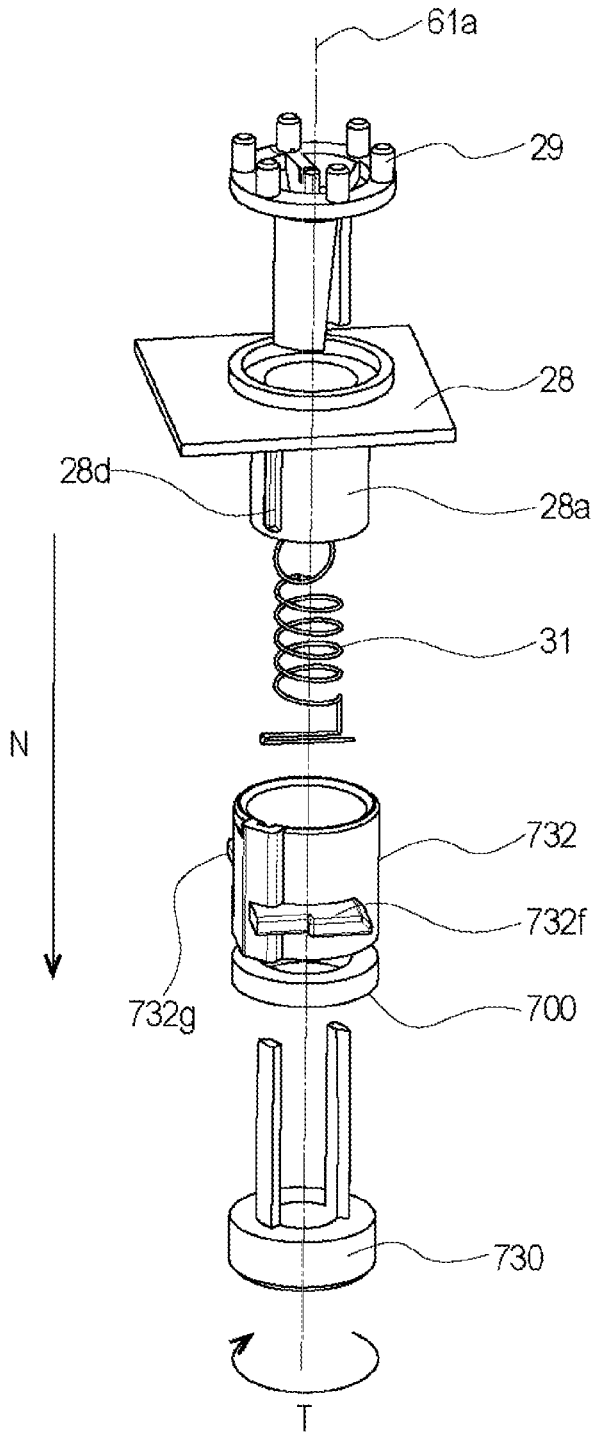

FIG. 48 is an exploded view illustrating mounting of the residual toner connecting portion and other parts in Embodiment 7.

Figure 49:
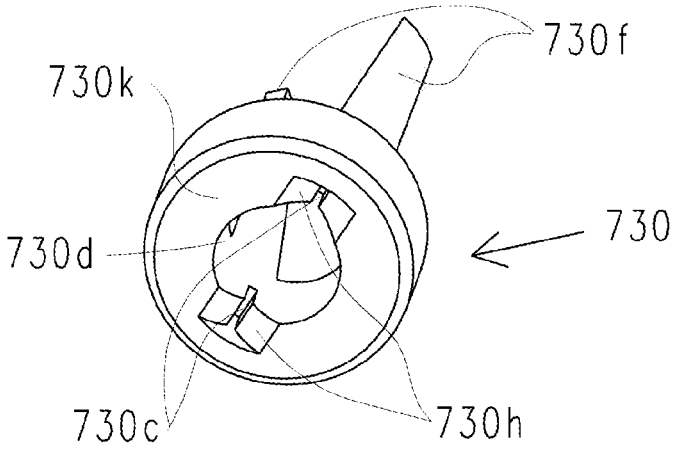
Figure 50:
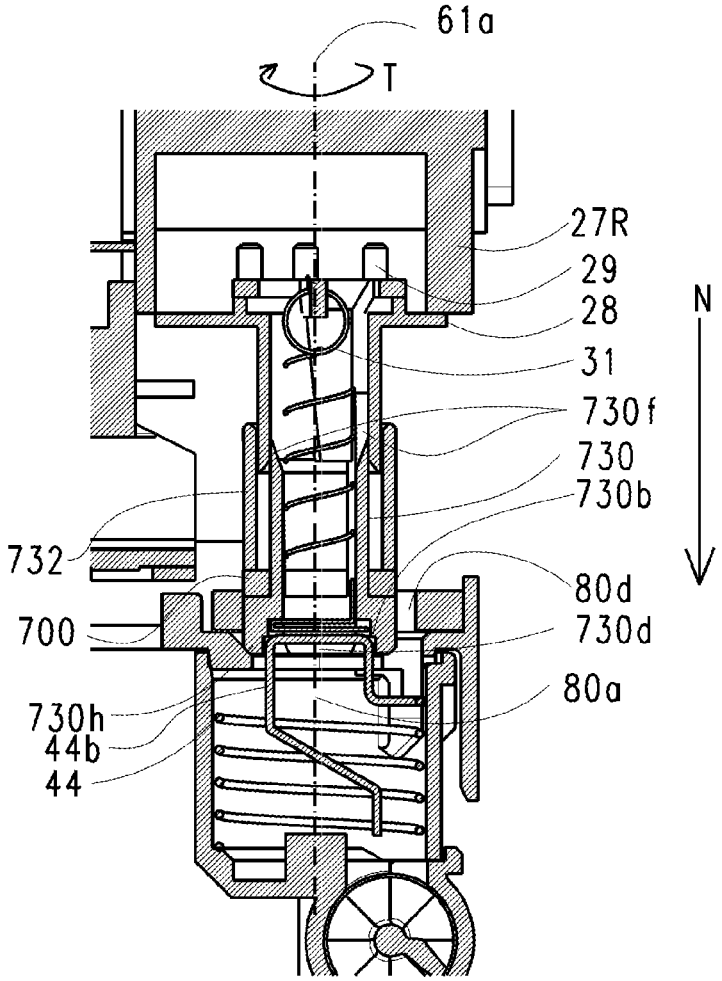

FIG. 49 is an outer appearance illustrating a configuration of a second coupling in Embodiment 7, and FIG. 50 is a sectional view illustrating the connection with the main assembly 100 in this embodiment.

FIG. 50 is a sectional view illustrating the connection with the main assembly 100 in Embodiment 7.

Figure 51:
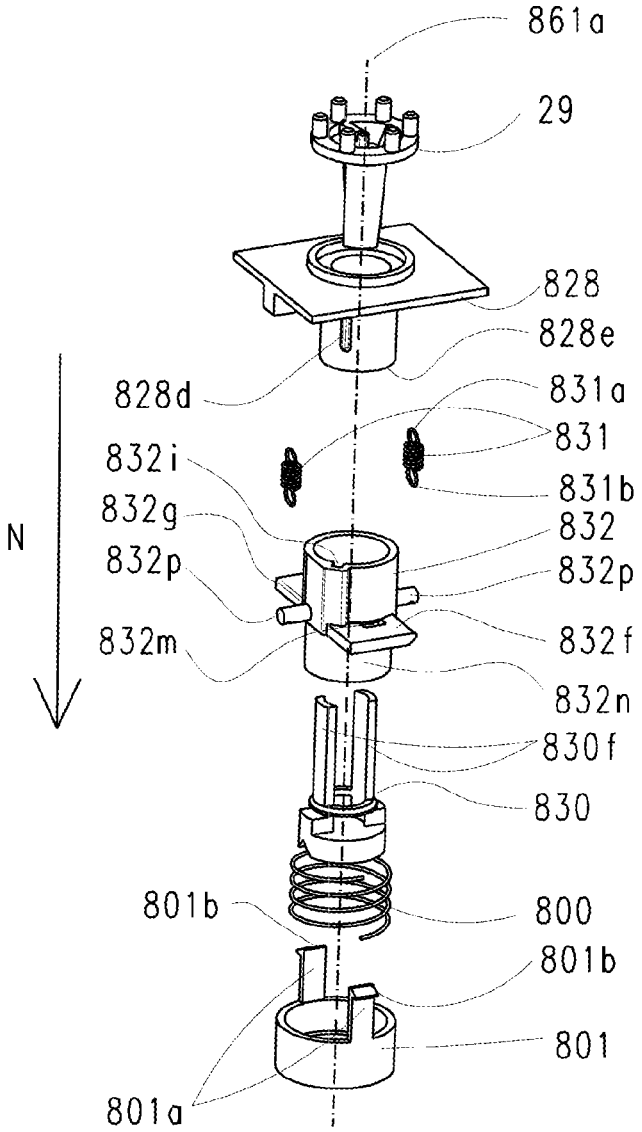

FIG. 51 is an exploded view illustrating mounting of the residual toner connecting portion and other parts in Embodiment 8.

Figure 52:
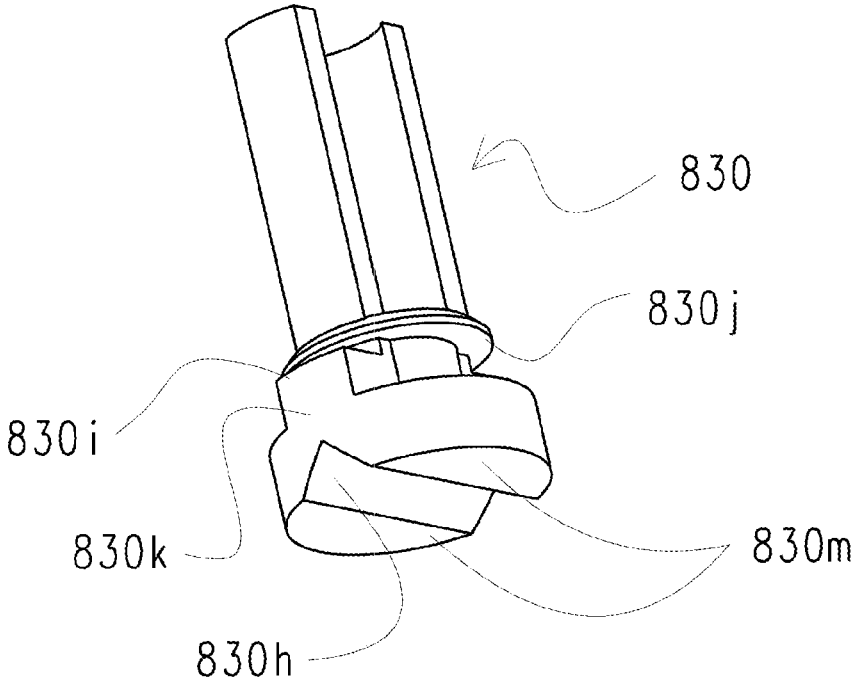

FIG. 52 is an outer appearance illustrating a configuration of a second coupling in Embodiment 8.

Figure 53:
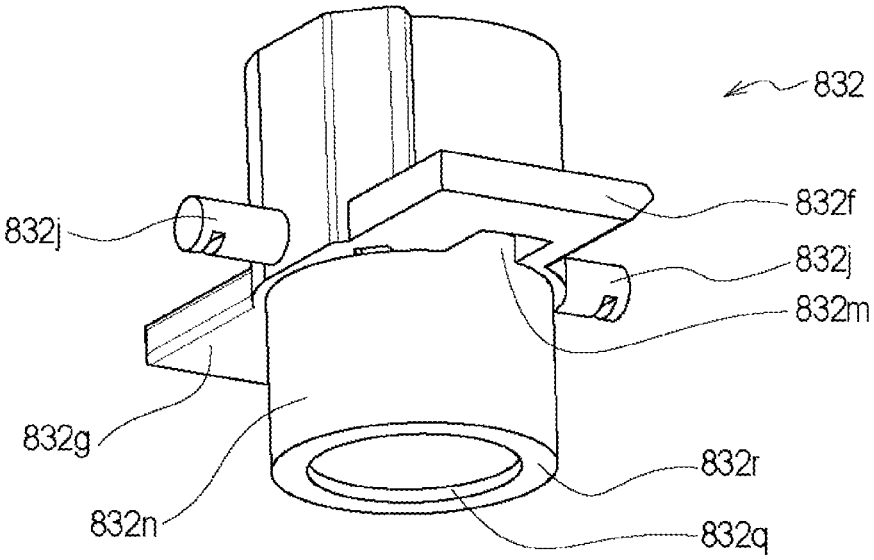

FIG. 53 is an outer appearance illustrating a configuration of a connecting operation portion in Embodiment 8.

Figure 54:
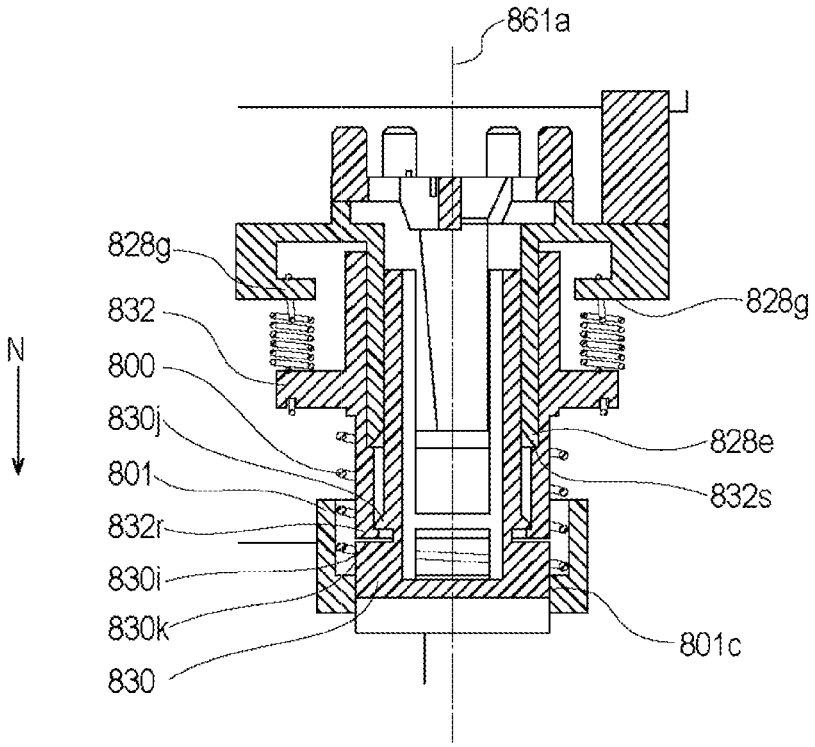
Figure 54:
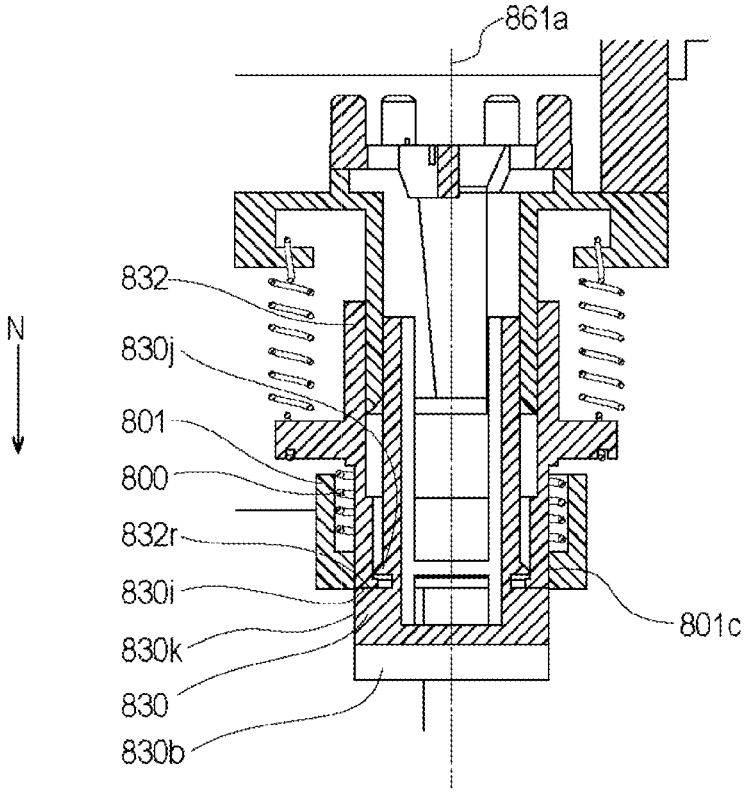

Parts (a) and (b) of FIG. 54 are sectional views of the neighborhood of the residual toner discharge opening before and after connection with the main assembly in Embodiment 8.

Figure 55:
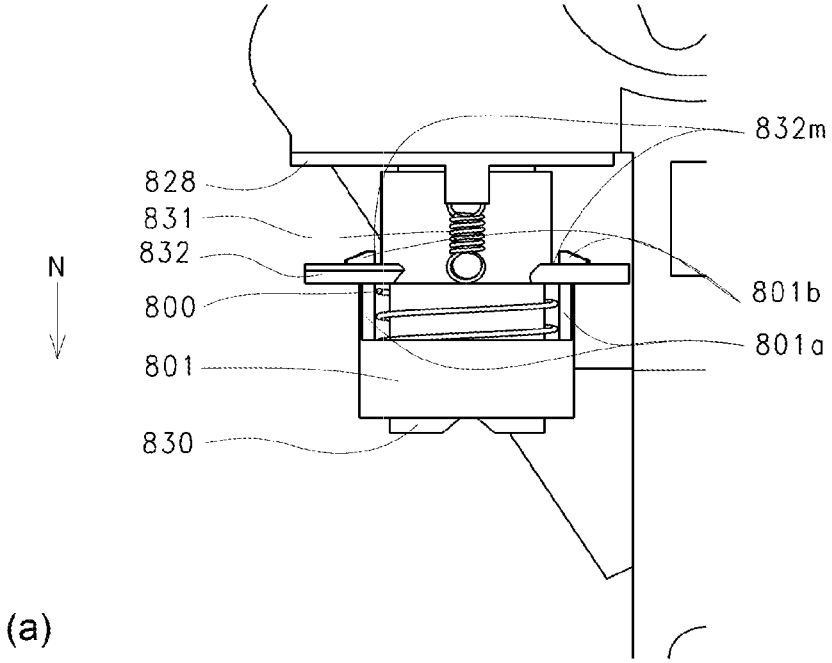
Figure 55:
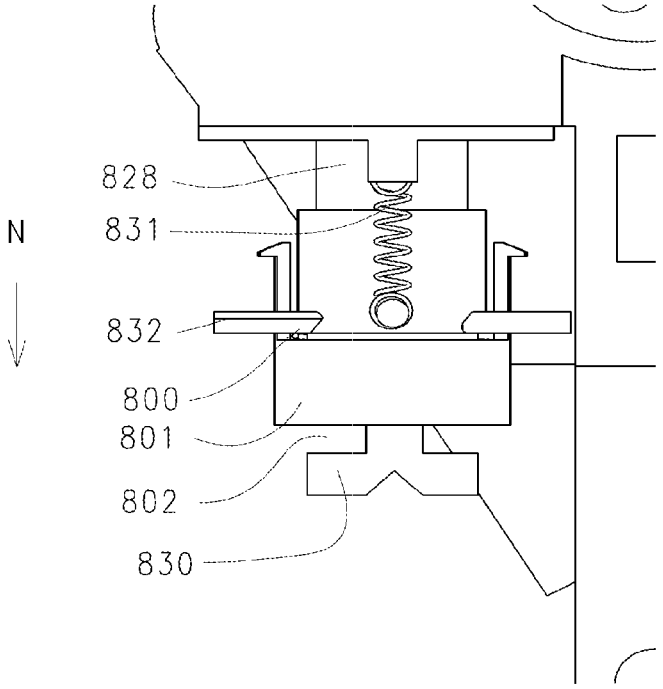

Parts (a) and (b) of FIG. 55 are side views of the cartridge in the neighborhood of the residual toner discharge opening before and after connection with the main assembly in Embodiment 8.

Figure 56:
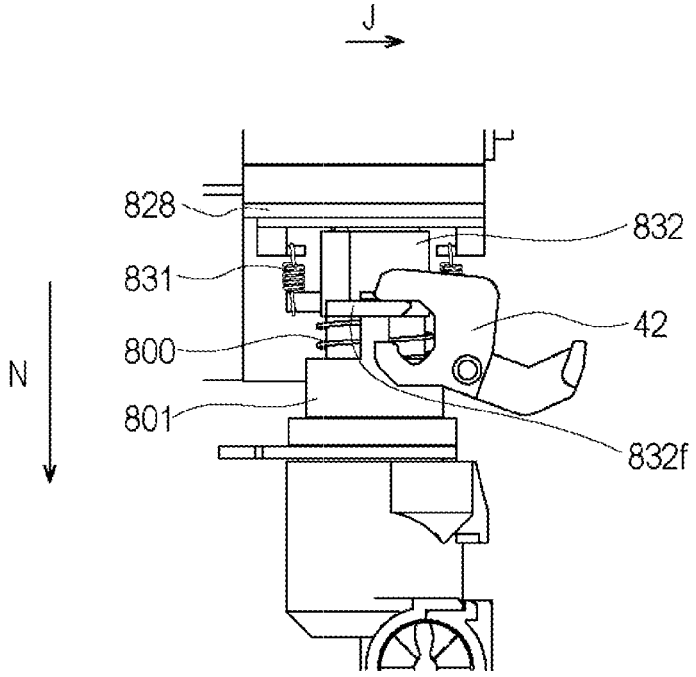
Figure 56:
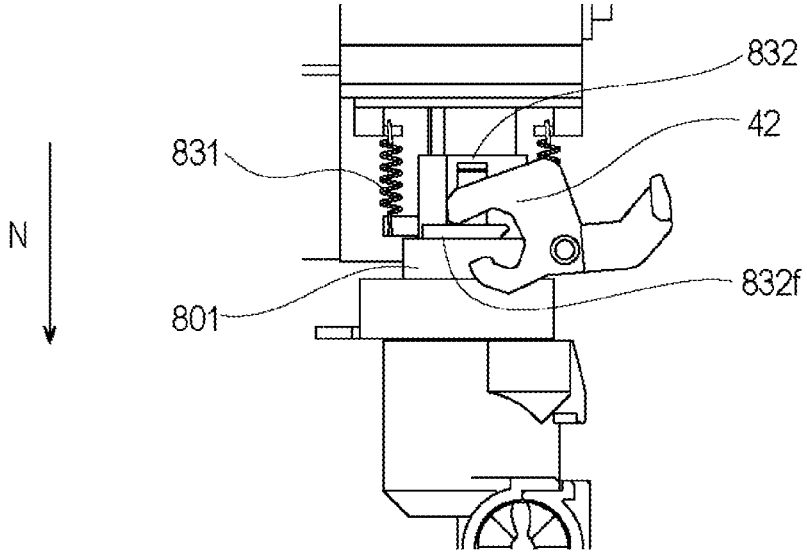

Parts (a) and (b) of FIG. 56 show outer appearances illustrating of a toner discharge opening to the main assembly in Embodiment 8.

Figure 57:
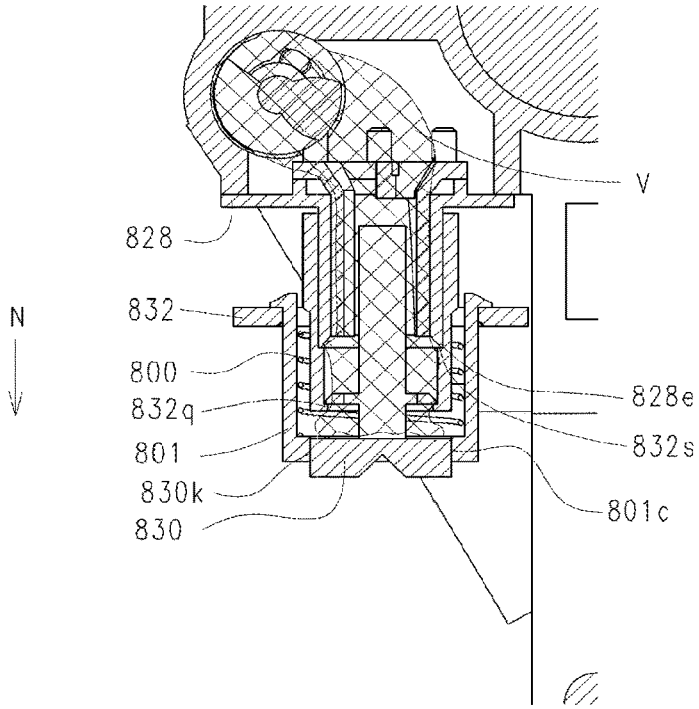
Figure 57:
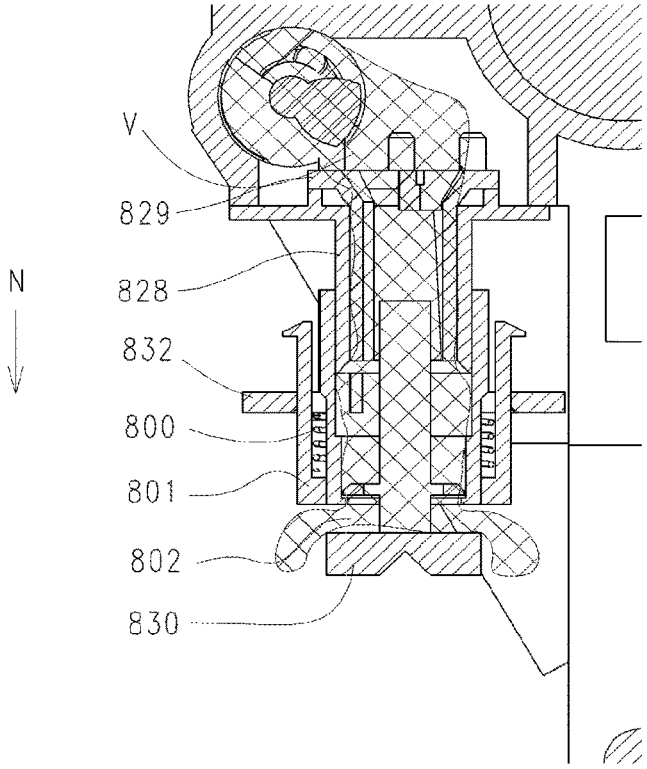

Parts (a) and (b) of FIG. 57 are sectional views illustrating a toner discharging passageway from the toner discharge opening of the process cartridge in Embodiment 8.

Figure 58:
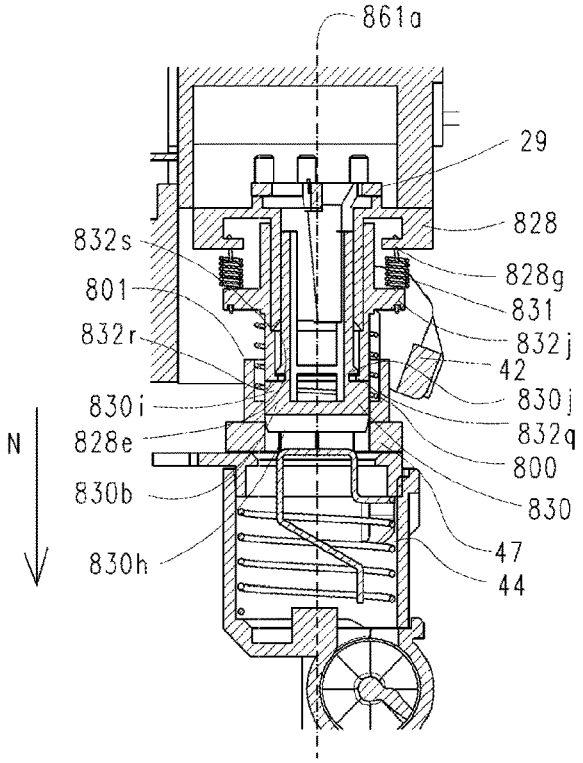
Figure 58:
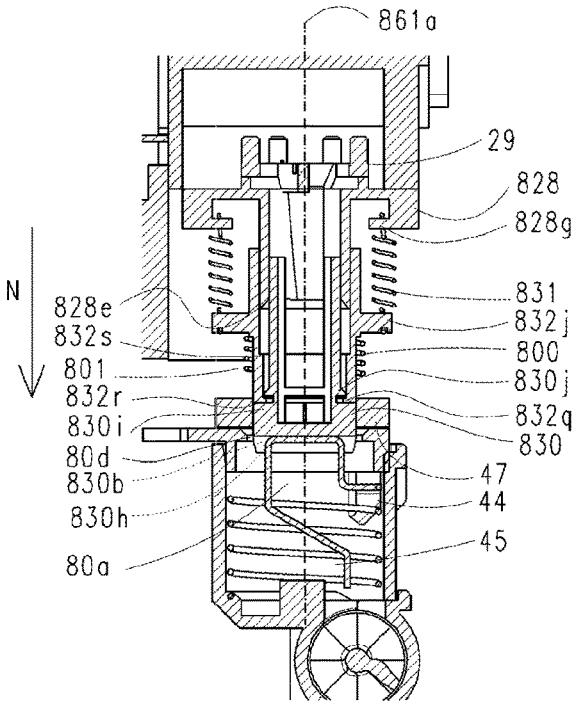

Parts (a) and (b) of FIG. 58 are sectional views illustrating an engagement method between the process cartridge and the main assembly in Embodiment 8.

Figure 59:
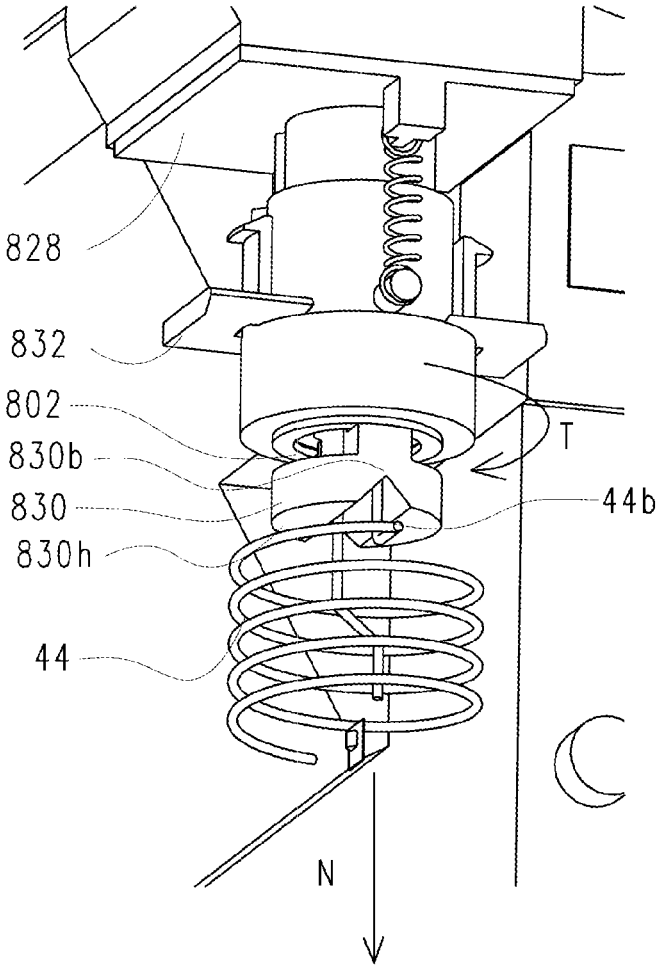

FIG. 59 is a schematic view illustrating the engagement method between the process cartridge and the main assembly in Embodiment 8.

Figure 60:
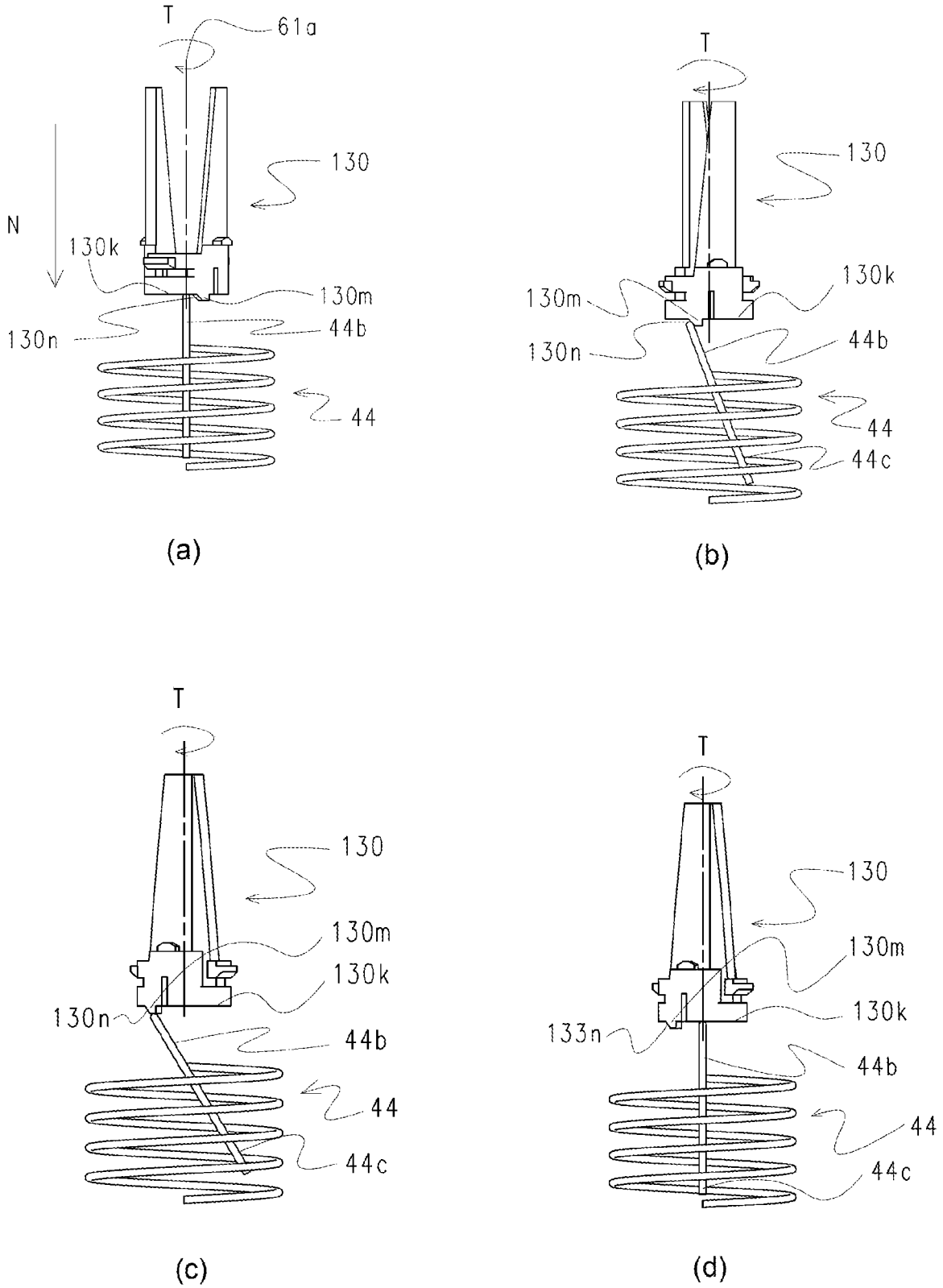

Part (a), (b), (c) and (d) of FIG. 60 is a schematic illustration of vibration transmission from the second coupling member to the vibration member in another shape according to Embodiment 1.

Figure 61:
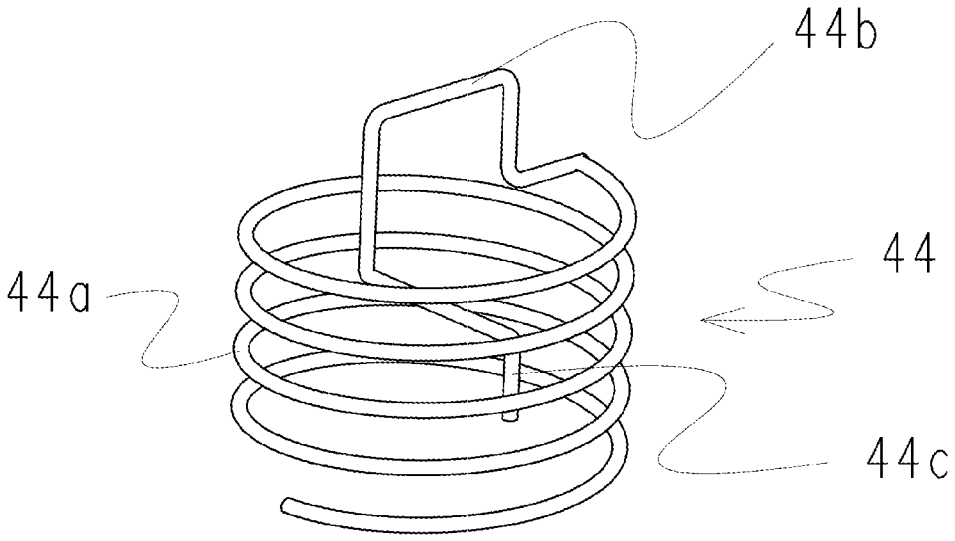

FIG. 61 is a perspective view illustrating the shape of the vibrating member according to the embodiment.

Figure 62:
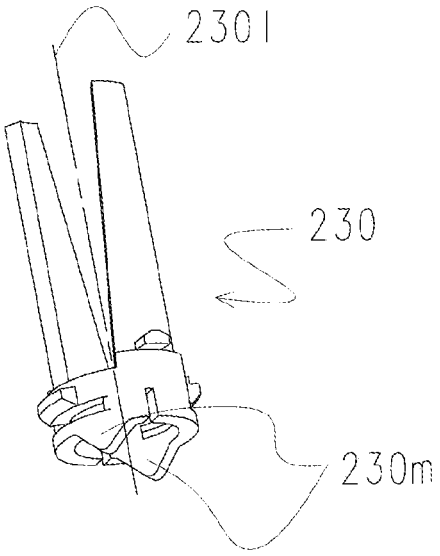

FIG. 62 is a perspective view illustrating another example of the vibration member according to the embodiment.

Figure 63:
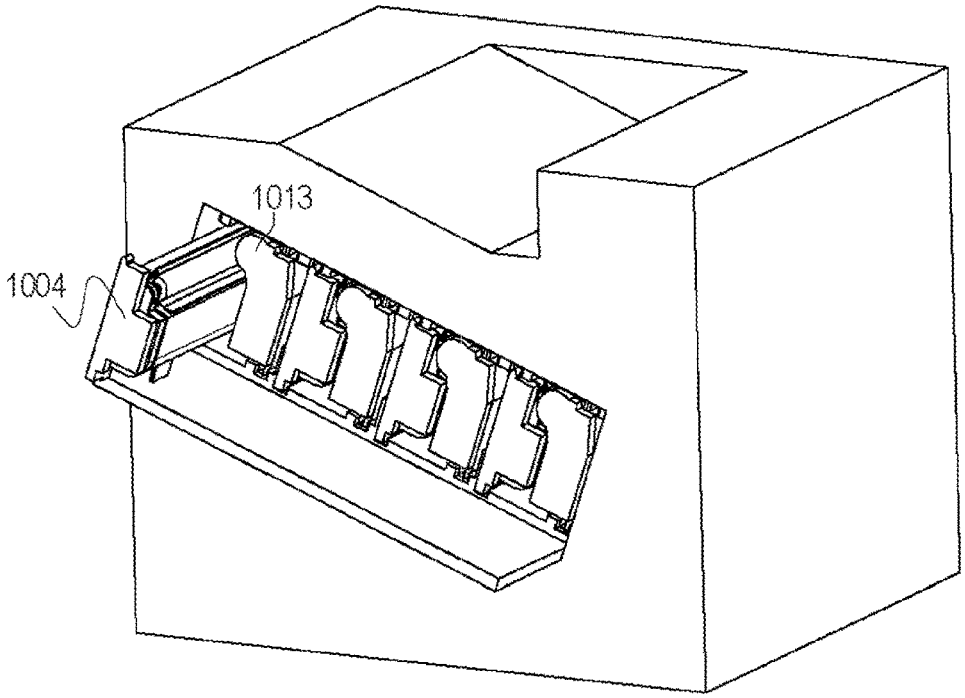

FIG. 63 is an illustration showing a modified example.

Figure 64:
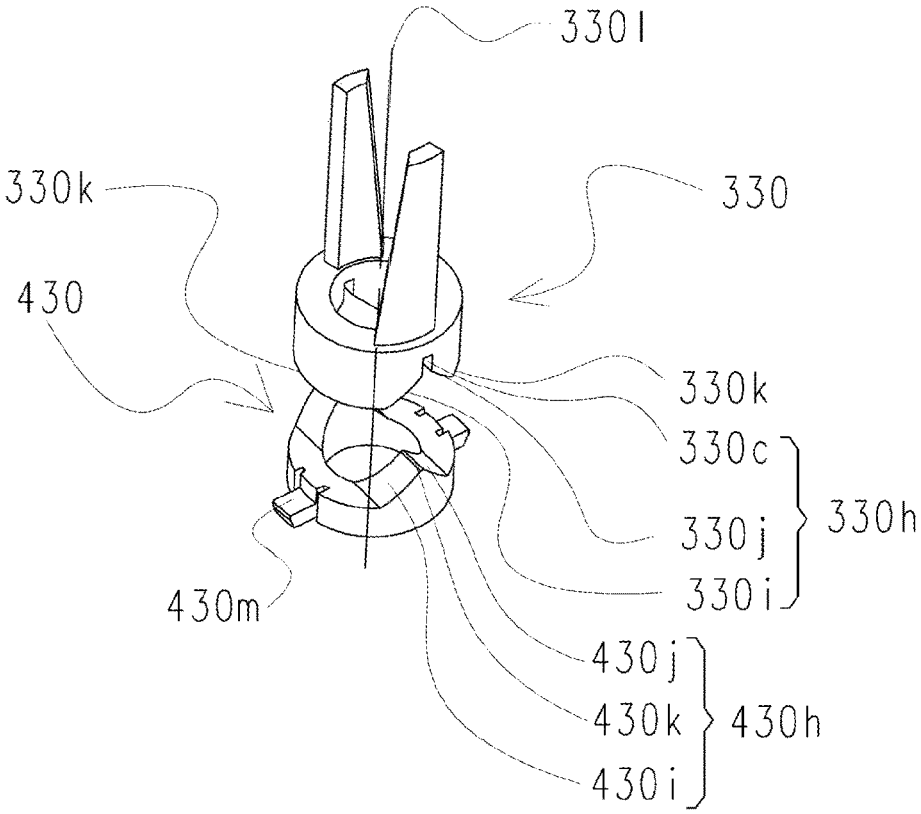

FIG. 64 is an illustration of Embodiment 9.

Figure 65:
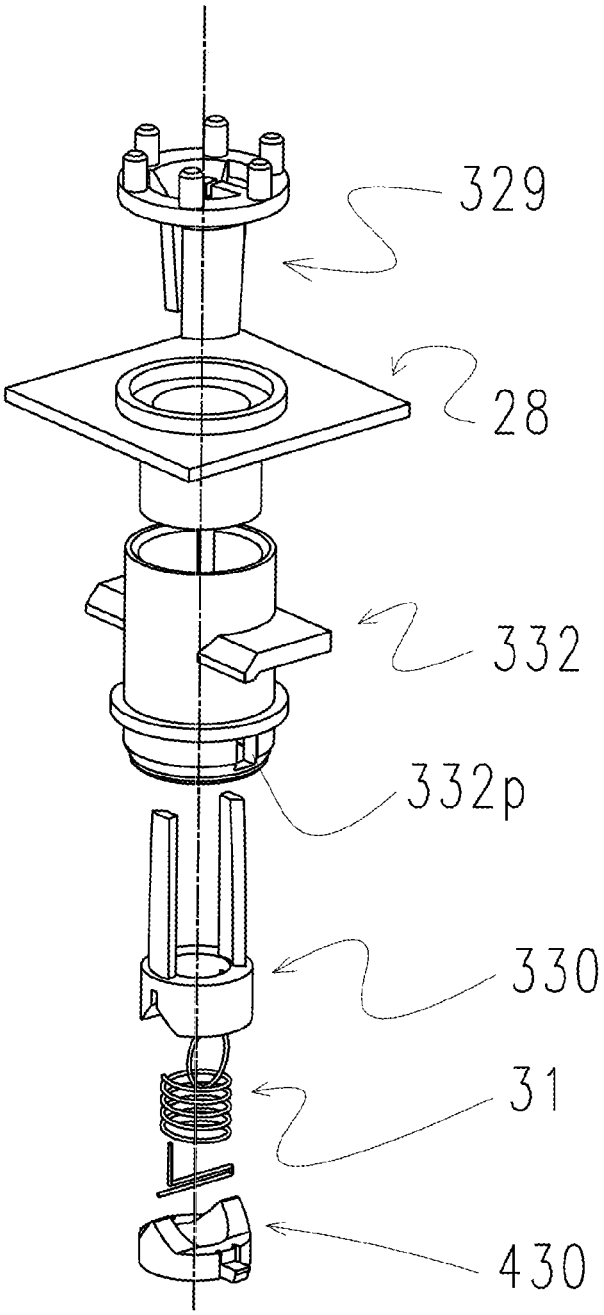

FIG. 65 is an illustration of Embodiment 9.

Figure 66:
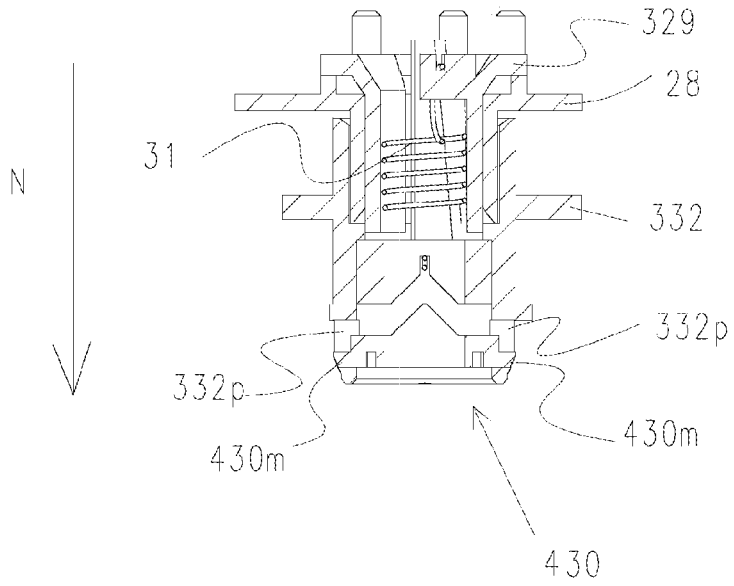
Figure 66:
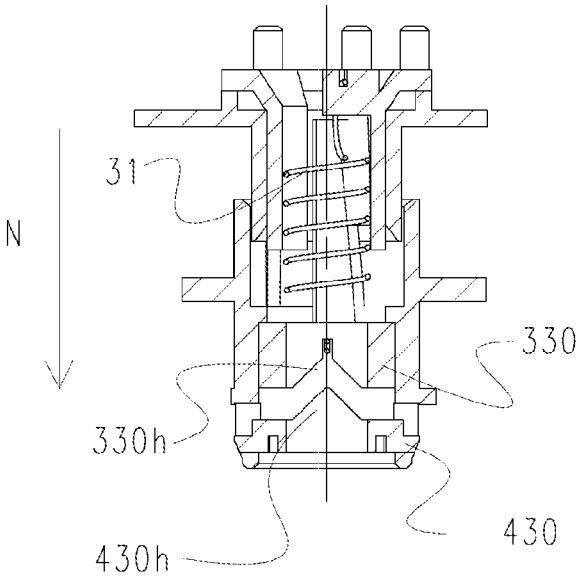

Parts (a) and (b) of FIG. 66 are illustrations of Embodiment 9.

Figure 67:
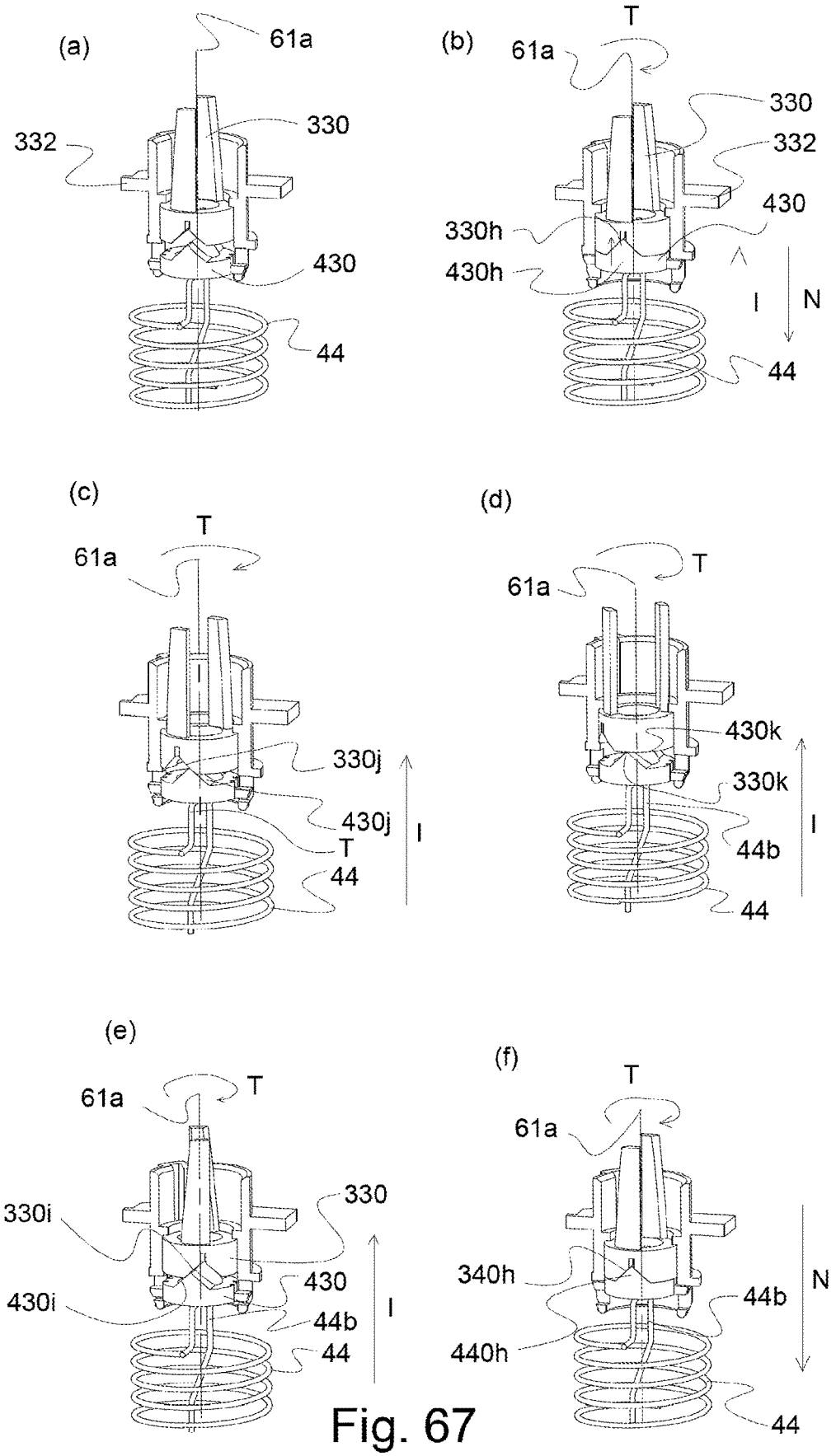

Part (a), (b), (c), (d), (e) and (f) of FIG. 67 are illustrations of Embodiment 9.

DETAILED DESCRIPTION OF THE INVENTION

Embodiment 1

In the following, an image forming apparatus and a cartridge of this embodiment will be described with reference to the drawings. Here, an image forming apparatus forms an image on a recording material by using, for example, an electrophotographic image forming process. For example, it includes an electrophotographic copying machine, an electrophotographic printer (for example, LED printer, laser beam printer, and so on), an electrophotographic facsimile machine, and the like. The cartridge can be mounted to or dismounted from the main assembly of the image forming apparatus (main assembly of the apparatus, main assembly of the electrophotographic image forming apparatus). In this embodiment, the process cartridge 7 will be described as an example of a cartridge. The process cartridge 7 has a photosensitive member and a process member (process means) acting on the photosensitive member.

In this embodiment, four process cartridges are detachably mountable to an exemplary full-color image forming apparatus. However, the number of the process cartridges mounted to the image forming apparatus is not limited to this example. Similarly, the dimensions, the sizes, the materials, the configurations, the relative positional relationships of the elements in the following embodiments and examples are not restrictive to the present invention unless otherwise stated. In the description, upper is based on the state in which the image forming apparatus it is installed.

[Image Forming Apparatus]

In the following, operations relating to image formation of the image forming apparatus according to this embodiment, and feeding of residual toner will be described briefly.

(Main Assembly of the Image Forming Apparatus)

Figure 2:
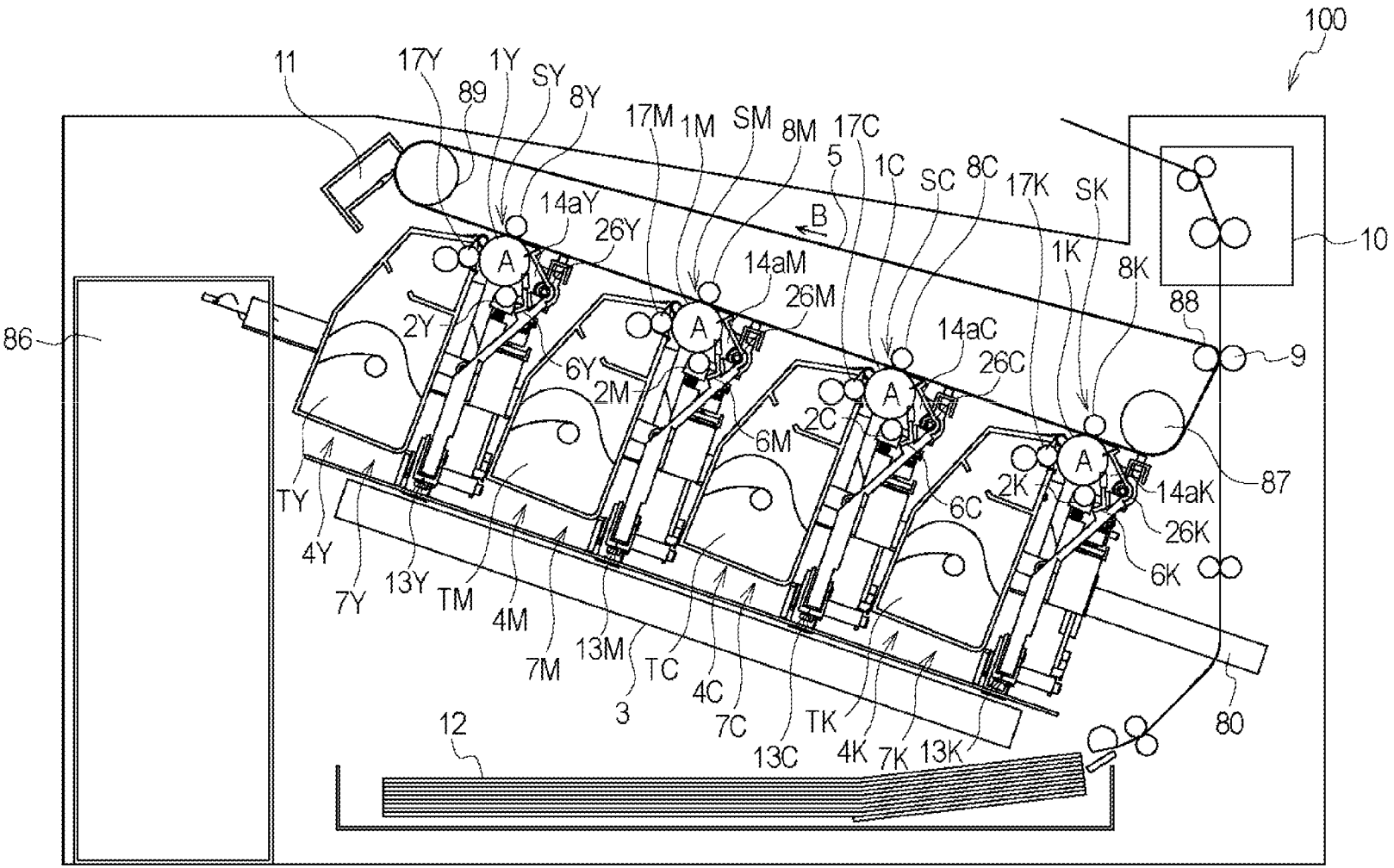
FIG. 2 illustrates schematically an electrophotographic image forming apparatus according to the embodiment of the present invention.
Figure 3:
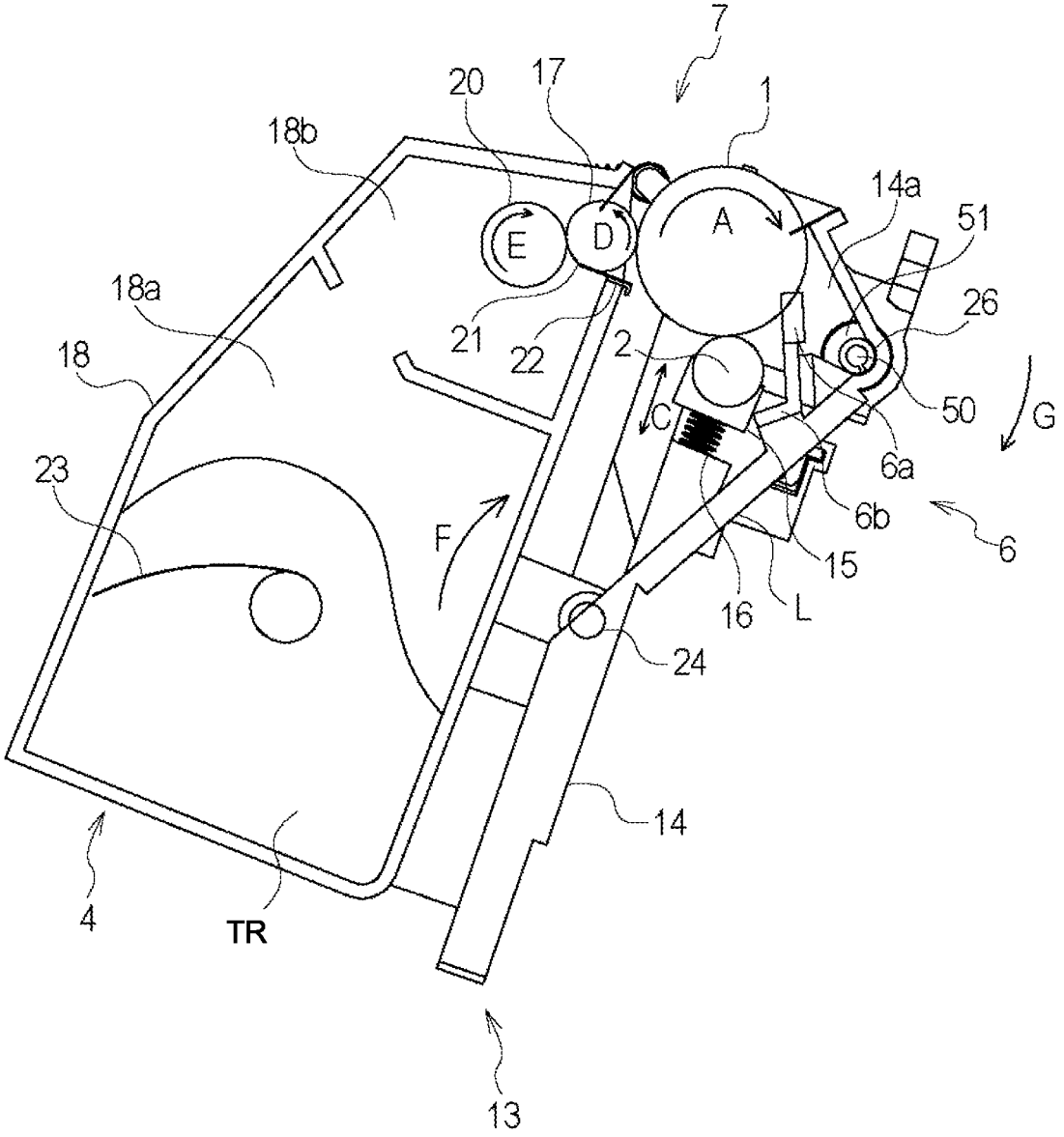
FIG. 3 is a schematic sectional view of a process cartridge according to the embodiment of the present invention.
Figure 4:
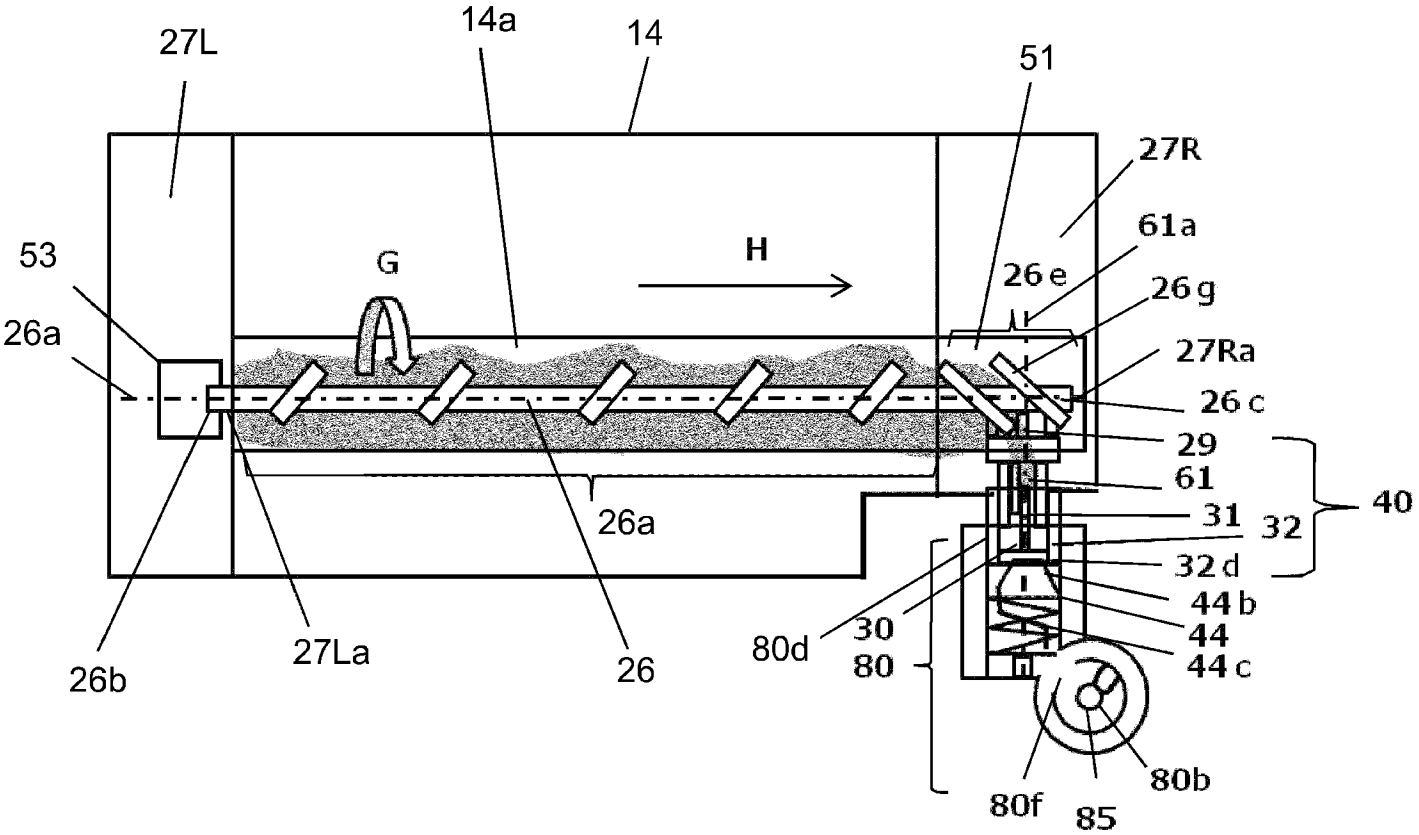
FIG. 4 is a sectional view illustrating a flow of the residual toner in the process cartridge in the embodiment of the present invention.
Figure 5:
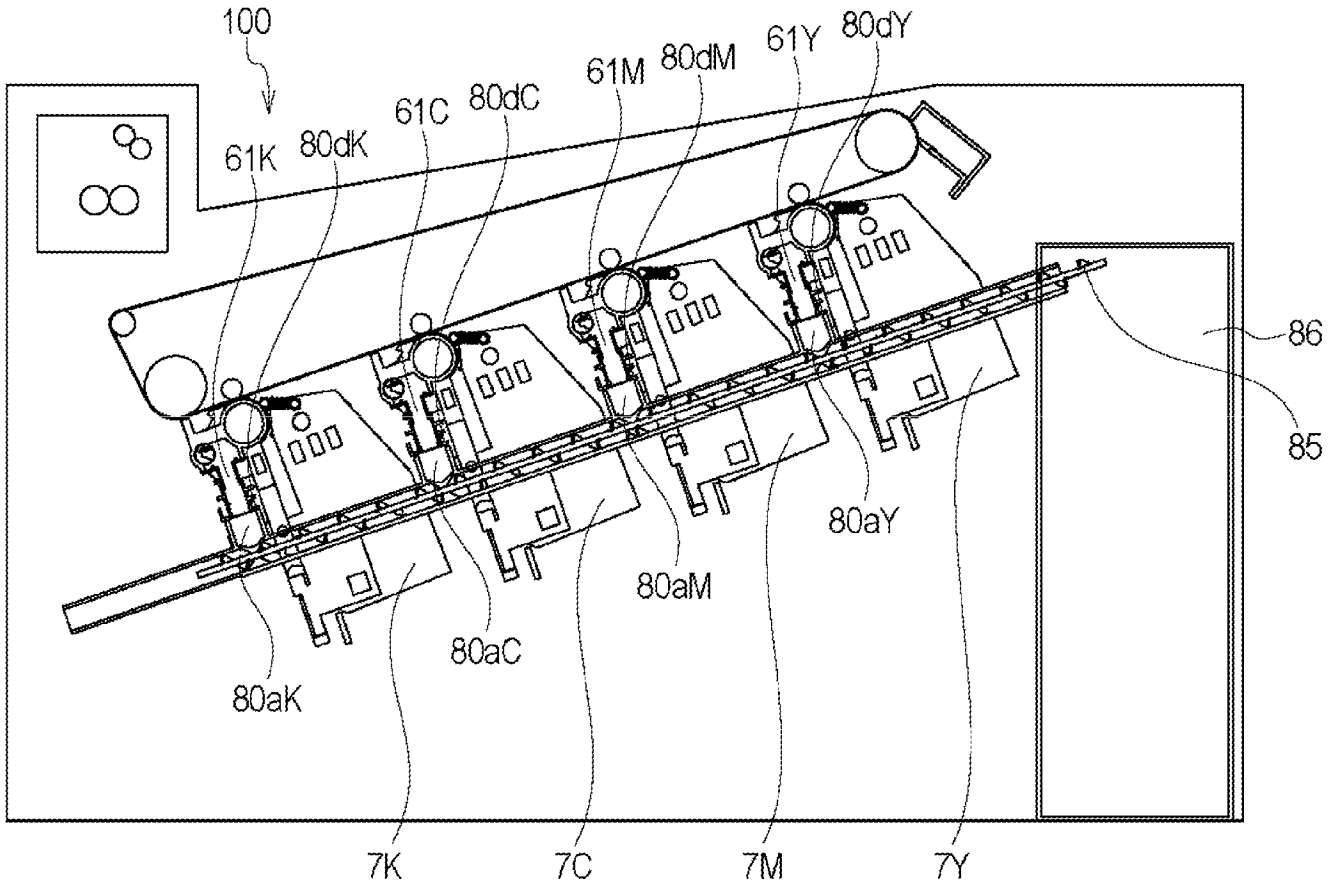
FIG. 5 is a schematic sectional view illustrating a feeding passageway of the removed toner in the embodiment.

Referring to FIGS. 2, 3, 4 and 5, a general arrangement of the electrophotographic image forming apparatus (image forming apparatus) according to an embodiment of the present invention will be described. FIG. 2 is a schematic sectional view of an image forming apparatus 100, and FIG. 3 is a main sectional view of the process cartridge, according to an embodiment of the present invention. FIG. 4 is a schematic sectional view illustrating a structure for residual toner discharging from a process cartridge 7. FIG. 5 is a substantial rear view illustrating a feeding passageway of the residual toner in the main assembly 100.

As shown in FIG. 2, the image forming apparatus 100 comprises a plurality of image forming stations. More particularly, it comprises first, second, third and fourth image forming stations SY, SM, SC, SK for forming yellow, magenta, cyan and the black images, respectively. In this embodiment, the first-fourth image forming stations SY, SM, SC, SK are arranged along a line crossing with the vertical direction.

In this embodiment, the structures and operations of the first-fourth image forming stations are substantially the same except that the colors of the formed images are different. Therefore, in the following, Y, M, C, K of the reference characters are omitted, and the descriptions are common, unless otherwise stated.

In this embodiment, the image forming apparatus 100 includes four photosensitive drums 1 (1Y, 1M, 1C, 1K). The photosensitive drum 1 rotates in the direction indicated by an arrow A in the Figure. Around the photosensitive drum 1, a charging roller 2 and a scanner unit (exposure device) 3 are provided.

The charging roller 2 is charging means for uniformly charging the surface of the photosensitive drum 1. A scanner unit 3 is exposure means for illuminating the surface of the photosensitive drum 1 with a laser beam in accordance with image information to form an electrostatic image (electrostatic latent image) on the photosensitive drum 1. Around the photosensitive drum 1, there are provided a developing device (developing unit) 4 (4Y, 4M, 4C, 4K) and a cleaning blade 6 (6Y, 6M, 6C, 6K) as cleaning means (cleaning member).

Opposed to four photosensitive drums 1, there is provided an intermediary transfer belt 5 as an intermediary transfer member for transferring toner images from the photosensitive drum 1 onto the recording material 12.

In this embodiment, the developing unit 4 uses a non-magnetic one component developer, that is, toner TR as a developer. In this embodiment, the developing unit 4 effects contact development in which a developing roller 17 as a developer carrying member is contacted with the photosensitive drum 1.

In this embodiment, a cleaning unit 13 comprises the photosensitive drum 1, the charging roller 2 and the cleaning blade 6 as the cleaning member. It also comprises a residual toner accommodating portion 14*a* (14*a*Y, 14*a*M, 14*a*C, 14*a*K) as an accommodating portion for accommodating untransferred toner (residual toner) having remained on the photosensitive drum 1 and removed by the cleaning blade 6.

Further, in this embodiment, the developing unit 4 and the cleaning unit 13 are unified into a cartridge to provide a process cartridge 7. The process cartridge 7 is detachably mountable to the image forming apparatus 100, using a mounting guide (unshown) provided in the main assembly of the image forming apparatus and mounting means (guide, guiding mechanism) such as a positioning member.

In this embodiment, the process cartridges 7 for the respective colors all have the same configurations. The process cartridges 7 contain yellow, magenta, cyan and black toner TR (TY, TM, TC, TK), respectively.

The intermediary transfer belt 5 contacts all of the photosensitive drums 1 and rotates in the direction indicated by an arrow B in the Figure. The intermediary transfer belt 5 is extended around a plurality of supporting members (driving roller 87, secondary transfer opposing roller 88, and follower roller 89).

Inside the intermediary transfer belt 5, there are provided four primary transfer rollers 8 (8Y, 8M, 8C, 8K) as primary transferring means opposed to the respective photosensitive drums 1. At a position opposing the secondary transfer opposing roller 88 outside the intermediary transfer belt 5, a secondary transfer roller 9 as secondary transferring means is provided.

In the image forming operation, the surface of the photosensitive drum 1 is first charged to uniformly by the charging roller 2. Then, the laser beam emitted by the scanner unit 3 in accordance with the image information is scanningly incident on the surface of the charged photosensitive drum 1. By this, an electrostatic latent image is formed on the photosensitive drum 1 in accordance with the image information. Then, the electrostatic latent image formed on the photosensitive drum 1 is developed into the toner image by the developing unit 4. That is, the photosensitive drum 1 is a rotatable member (image bearing member) for carrying an image (toner image) formed with the toner on the photosensitive drum 1. The toner image is transferred from the photosensitive drum 1 onto the intermediary transfer belt 5 (primary-transfer) by the function of the primary transfer roller 8.

For example, in the case of a full-color image, the above-described process is carried out by the first to fourth image forming stations SY, SM, SC, SK, sequentially. The toner images formed by the respective image forming stations are primary-transferred sequentially onto the intermediary transfer belt 5 superimposedly. Thereafter, the recording material 12 it is fed to the secondary transfer portion in synchronism with movement of the intermediary transfer belt 5. By the function of the secondary transfer roller 9 opposed to the intermediary transfer belt 5 with the recording material 12 therebetween, the four chromatic toner image is secondary-transferred from the intermediary transfer belt 5 onto the recording material 12 all together.

The recording material 12 having the transferred toner image is fed into a fixing device 10 as the fixing means. In the fixing device 10, the recording material 12 is subjected to the heat and the pressure, by which the toner image is fixed on the recording material 12. The primary-untransferred toner remaining on the photosensitive drum 1 after the primary transfer step is removed by the cleaning blade 6 as the cleaning member, and is collected.

The portion of the image forming apparatus except for the unit which is detachably mountable to the main assembly, such as the cartridge is called a main assembly of the image forming apparatus (main assembly), in some location, to particularly referring to the parts except for the cartridge.

(Residual Toner Feeding During Printing)

In the following, the description will be made as to the feeding of the collected residual toner. The residual toner collected from the image bearing member (photosensitive drum 1) by the cleaning blade is accommodated in the residual toner accommodating portion 14*a* (14*a*Y, 14*a*M, 14*a*C, 14*a*K) as the accommodating portion. The residual toner accommodating portion 14*a* has a function as an accommodating portion for temporarily accommodating the residual toner in the cartridge side.

In a first feeding passageway 51 (51Y, 51M, 51C, 51K) of the residual toner accommodating portion 14*a*, there is provided a feeding screw 26 (FIG. 3) as a feeding member (cartridge side feeding member). By this, the residual toner collected in the residual toner accommodating portion 14*a* is fed toward a one longitudinal end portion of the process cartridge 7 by the feeding screw 26 as the cartridge side feeding member. A longitudinal direction of the process cartridge 7 is substantially parallel with rotational axes of the photosensitive drum 1 and the feeding screw 26. Therefore, the longitudinal direction of the process cartridge, a rotational axis direction of the photosensitive drum 1 and the rotational axis direction of the feeding screw 26 are the same, unless otherwise stated particularly. The rotational axis direction (axial direction) is a direction of the rotational axis of the rotatable member and a line parallel with it.

The residual toner thus fed is further fed to a residual toner receiving opening (toner receiving port) 80*d* of the main assembly through a second feeding passageway 61 (FIG. 4). The second feeding passageway 61 is a discharging passageway for moving the toner toward the discharge opening (residual toner discharging portion) 32*d*. The toner discharged from the discharge opening 32*d* enters the residual toner receiving opening 80*d*.

The second feeding passageway 61 is disposed at one end portion side of the cartridge with respect to the rotational axis direction of the photosensitive drum 1. Second feeding passageway 61 moves the toner in a direction crossing with (substantially perpendicular to the axial direction in this embodiment) the axial direction.

The second feeding passageway 61 is provided with a first coupling member 29, a coupling spring 31, a second coupling member 30 and a residual toner connecting member 32. Here, the residual toner connecting member 32 is supported so as to be movable relative to the process cartridge 7 along the center line 61*a*. The residual toner connecting member 32 constitutes a terminal end of the second feeding passageway 61 and is provided with a discharge opening 32*d* for discharging the toner to an outside of the cartridge. As will be described in detail hereinafter, the residual toner fluid-communication member 32 is a connecting portion movable to connect the discharge opening 32 to a toner receiving opening 80*d* provided in the main assembly of the image forming apparatus.

Although the details will be described hereinafter, the residual toner connecting member 32 moves with the mounting operation of the process cartridge 7 to the image forming apparatus. At least when carrying out image forming operation, the residual toner connecting member 32 is in a state of being in connection with the main assembly residual toner receiving opening 80*d*. Here, in a state in which the process cartridge 7 is mounted to the image forming apparatus, it is preferable that the second feeding passageway 61 takes an angle such that the toner passing through the second feeding passageway 61 falls by gravity. In this embodiment, an attitude of the cartridge 7 is determined such that the center line 61*a* of the second feeding passageway 61 is inclined by about 19 degrees with respect to the direction of gravity.

The residual toner passes through the residual toner receiving opening 80*d* and the vibration member 44 and is fed to the second feeding passageway 80*b* of the apparatus main assembly.

Thereafter, it is discharged into and contained in a residual toner box 86 (FIG. 5) as a main assembly side toner storage portion of the image forming apparatus by the main assembly feeding screw 85 provided in the second feeding 80*b*.

Secondary-untransferred toner remaining on the intermediary transfer belt 5 after the secondary transfer step is removed by an intermediary transfer belt cleaning device 11 (FIG. 2). The image forming apparatus 100 is capable of forming a monochromatic or multi-color image using only one or more (not all) image forming stations as desired.

[Process Cartridge]

Figure 6:
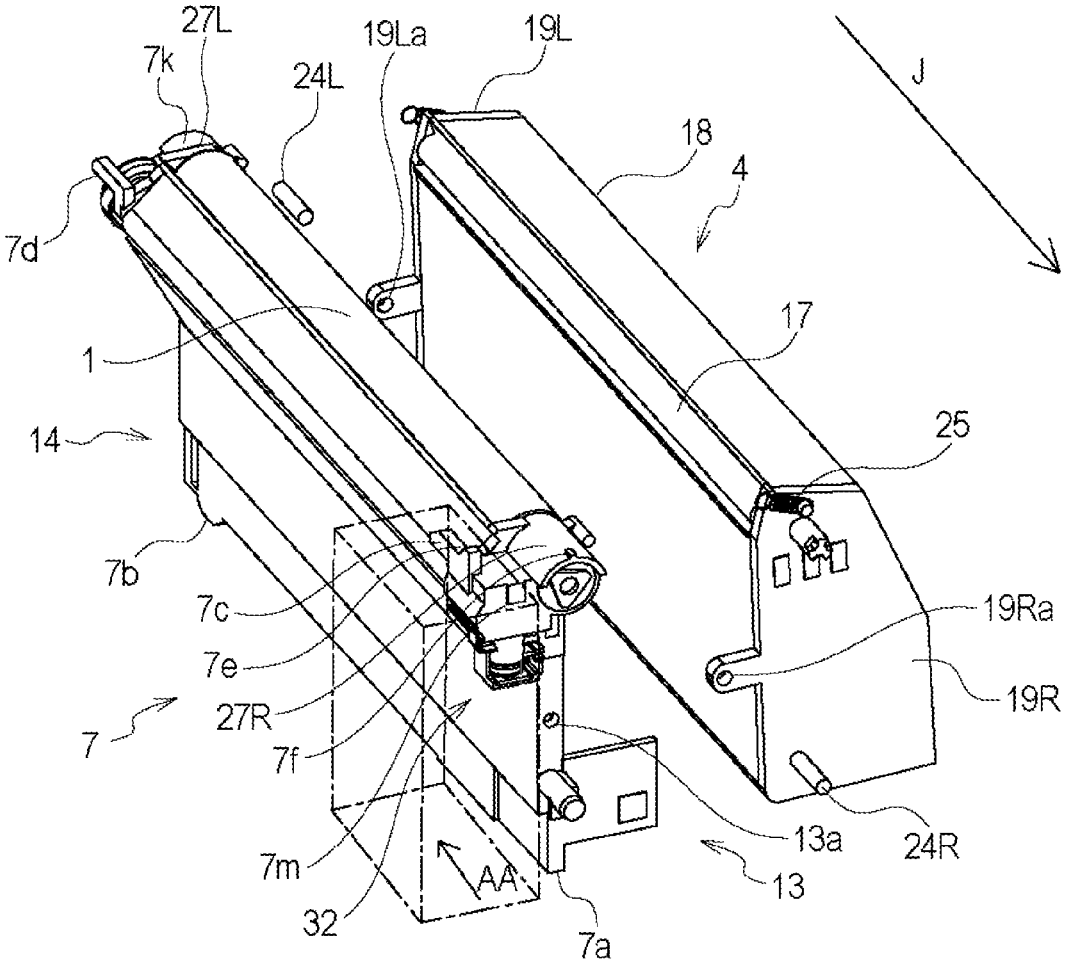
FIG. 6 is a perspective view of the process cartridge according to the embodiment.

Referring to FIGS. 3 and 6, a general arrangement of the process cartridge 7 according to this embodiment mountable to the image forming apparatus 100 will be described. FIG. 6 is an exploded perspective view illustrating the developing unit 4 and the cleaning unit 13. The process cartridge 7 is constituted by the developing device 4 and the cleaning unit 13 as a unit. As shown in FIG. 6, the developing unit 4 is provided with holes 19Ra, 19La formed in bearing members 19R, 19L. The cleaning unit 13 is provided with a holes 13*a* (one of which is shown in FIG. 6) provided in the frame of the cleaning unit 13. The developing unit 4 and the cleaning unit 13 are connected with each other so as to be rotatable relative to each other about an axis 24 (24R, 24L) engaging with the holes 19Ra, 19La and the holes 13*a*. The developing unit 4 is urged by an urging spring. Therefore, during the image forming operation, the developing unit 4 rotates in the direction indicated by an arrow F shown in FIG. 3 about the shaft 24, so that the developing roller 17 is in contact with the photosensitive drum 1. The developing roller 17 is a rotatable member (developer carrying member, developing member) carrying the toner (developer). The developing roller 17 develops the latent image on the photosensitive drum 1 by supplying the toner onto the photosensitive drum.

(Developing Unit)

Referring to FIGS. 3 and 6, the developing device 4 of the process cartridge 7 in this embodiment will be described.

As shown in FIGS. 3 and 6, the developing unit 4 includes a developing device frame 18 supporting various elements provided in the developing unit 4. The developing unit 4 includes a developing roller 17 as the developer carrying member rotatable in a direction indicated by arrow D (counterclockwise direction) in contact with the photosensitive drum 1. The developing roller 17 is supported rotatably by the developing device frame 18 through the developing device bearings 19 (19R, 19L) at the opposite ends with respect to the longitudinal direction (rotational axis direction) of the developing roller 17. The developing device bearings 19 (19R, 19L) are mounted at the sides of the developing device frame 18.

As shown in FIG. 3, the developing unit 4 includes the developer accommodating chamber (toner accommodating chamber) 18*a* and a developing chamber 18*b* in which the developing roller 17 is provided.

In the developing chamber 18*b*, there are provided a toner supplying roller 20 as a developer feeding member rotatable in a direction indicated by an arrow E in contact with the developing roller 17, and a developing blade 21 as the developer regulating member for regulating a toner layer on the developing roller 17. The toner supplying roller 20 functions to supply the toner onto the developing roller 17. The toner supplying roller 20 is a rotatable member carrying the toner, and therefore, is a toner supplying member. The developing blade 21 is mounted on the supporting member 22 for integration therewith, by welding, for example. In a toner accommodating chamber 18*a* of the developing device frame 18, there is provided a stirring member 23 for stirring the contained toner and for feeding it to the toner supplying roller 20.

(Cleaning Unit)

Referring to FIGS. 3 and 6, the cleaning unit 13 of the process cartridge 7 will be described.

The cleaning unit 13 comprises a cleaning frame 14 as a frame for supporting various elements in the cleaning unit 13. The cleaning frame 14 includes the photosensitive drum 1 which is supported by bearing members 27 (27R and 27L, FIG. 6) so as to be rotatable in a direction indicated by an arrow A as shown in FIG. 3. As shown in FIG. 3, the cleaning blade 6 integrally includes an elastic member 6*a* for removing the untransferred toner (residual toner) remaining on the surface of the photosensitive drum 1 after the primary-image transfer, and a supporting member 6*b* for supporting the elastic member. The cleaning blade 6 is fixed to the cleaning frame 14 by screws or the like at the longitudinal opposite ends.

The residual toner removed from the surface of the photosensitive drum 1 by the cleaning blade 6 falls due to the gravity through a space defined by the cleaning blade 6 and the cleaning frame 14 into the residual toner accommodating portion 14*a* where the residual toner is temporarily stored. The cleaning frame 14 is provided with charging roller bearings 15 along the rotation axis of the charging roller 2 and the rotation axis of the photosensitive drum 1.

Here, the charging roller bearing 15 is movable in a direction indicated by an arrow C as shown in FIG. 3. A rotation shaft 2*a* of the charging roller 2 is rotatably supported by the charging roller bearings 15. The charging roller bearings 15 are urged toward the photosensitive drum 1 by the charging roller urging spring 16 as urging means.

[Residual Toner Feeding Portion]

The feeding portion for feeding the residual toner will be described in detail. With the structure in which the residual toner transportation device for feeding the residual toner is disposed in a rear side of the image forming apparatus, it is preferable that the toner discharge opening of the cartridge is inserted to the rear side of the main assembly side rear side plate. To accomplish such a structure, a part of the cartridge is required to be provided with a projection for insertion to the rear side of the rear side plate. In other words, with the above-described structure, it is difficult to reduce the width of the cartridge measured in the longitudinal direction thereof.

For this reason, in this embodiment, the residual toner transportation device is provided in a space for mounting the process cartridge 7. By this, expansion of the width measured in the longitudinal direction of the process cartridge can be suppressed.

(Outline of Residual Toner Transportation Portion)

Referring to FIGS. 4 and 6, the position of a residual toner discharging portion 40 of the cleaning unit 13 will be described. As shown in FIG. 6, the residual toner discharging portion 40 is disposed inside (area AA) of the mounting abutment position 7*m* with respect to the photosensitive drum axial direction. By doing so, the residual toner is discharged in the process cartridge 7 side of the rear side plate 98 of the main assembly 100. In other words, in the space in the image forming apparatus provided for mounting the process cartridge, the residual toner is transferred to the main assembly side from the process cartridge 7 in the neighborhood of the rear side plate.

Referring to FIGS. 3 and 4, the structure of the residual toner discharging portion 40 will be described.

The photosensitive drum 1 is rotated by the driving force received from the main assembly 100 in the direction of the arrow A. The rotation of the photosensitive drum 1 is transmitted to the residual toner feeding screw 26 as a cartridge side feeding member by the way of a gear train which will be described hereinafter. The residual toner feeding screw 26 is provided in the residual toner accommodating portion 14*a* of the cleaning frame 14 and is rotatable in the direction indicated by an arrow G. The feeding screw 26 feeds the residual toner in the first feeding passageway 51 extending in the axial direction of the drum 1 toward one longitudinal end of the process cartridge 7 (arrow H direction in FIG. 4).

The fed residual toner is discharged from the residual toner discharging portion (discharge opening) 32*d* which is an opening provided in the residual toner connecting member 32 to the residual toner receiving opening 80*d* (unshown) of main assembly 100 through the second feeding passageway 61 extending in the direction substantially perpendicular to the first feeding passageway 51. The residual toner feeding screw 26 has a screw configuration in this embodiment, but it may have a coil spring configuration having feeding power, or a non-continuous blade configuration.

(Position and Cross Sectional Area of Feeding Passageway)

Referring to FIGS. 3, 4, 7, 8 and 12, the structure in the position of the residual toner transportation will be described. FIG. 7 illustrates a positional relation between the feeding screw 26 and the discharge opening 32*d*. FIG. 8 shows a view of the feeding screw 26 and the first coupling member 29 in the process cartridge 7, as seen in the direction of the center line 61*a*.

As shown in part (b) of FIG. 7, as seen in the direction of the rotational axis of the photosensitive drum 1, the second feeding passageway 61 is positioned such that the center line 61*a* of the second feeding passageway 61 passes between the center of the shaft of the residual toner feeding screw 26 and the axis center 1*a* of the photosensitive drum 1. That is, the rotation axis of the photosensitive drum 1 and the rotation axis of the first feeding member 26 are positioned in the opposite sides with respect to the center line 61*a*.

The center line 61*a* is substantially the same as the rotational axis of the second coupling member 30. That is, rotation axis 1*a* of the photosensitive drum 1 and rotation axis of the residual toner feeding screw 26 are in the opposite sides with respect to the rotational axis (axis) of the second coupling member 30.

By satisfying such a positional relationship, the photosensitive drum 1, the residual toner feeding screw 26 and the second feeding passageway (discharging passageway) 61 can be accommodated in a small space. Therefore, an amount of the projection from an outer configuration line L (FIG. 3) of the cleaning frame 14 can be reduced or eliminated. Therefore, as seen in the axial direction of the photosensitive drum 1, the cleaning unit or the process cartridge can be downsized.

As shown in part (b) of FIG. 8, as seen along the center line 61*a* of the second feeding passageway 61, the opening 61*b* of the second feeding passageway 61 is positioned so that it overlaps with an area which can be taken by a reverse screw portion 26*e* during rotation of the feeding screw 26, in a range K.

The opening 61*b* is a communicating portion between the first feeding passageway 51 and the second feeding passageway 61. The direction of the center line 61*a* is substantially perpendicular to the axis of the feeding screw 26. In other words, as the feeding screw 26 is seen in the perpendicular direction, the reverse screw 26*e* overlaps with the opening 61*b*.

By this, the feeding force of the feeding screw 26 can smoothly feed the residual toner from the first feeding passageway 51 to the second feeding passageway 61. As shown in part (a) of FIG. 7, in the longitudinal direction of the cartridge (left-right direction in part (a) of FIG. 7), the first feeding passageway 51 and the second feeding passageway 61 overlap with each other. By doing so, the width of the cleaning unit 13 measured in the longitudinal direction thereof can be reduced, while assuring the diameter of the feeding passageway required for the residual toner feeding. As a result, the process cartridge 7 can be downsized.

The reverse screw portion 26*e* can be deemed as a second feeding portion of the feeding screw 26. That is, the feeding screw 26 comprises a first feeding portion (feeding screw portion 26*a*) which is a major part for feeding the toner, and the second feeding portion (reverse screw portion 26*e*) for feeding the toner in the direction opposite from that of the first feeding portion (FIG. 4).

The feeding screw portion 26*a* of the feeding screw 26 functions to feed the toner toward the opening 61*b*. On the other hand, the second feeding portion (reverse screw portion 26*e*) is disposed downstream of the feeding screw portion 26*a* in the toner feeding direction of the feeding screw portion 26*a*. The reverse screw portion 26*e* as the second feeding portion is provided adjacent to the opening 61*b*, and a length of the reverse screw portion 26*e* is smaller than that of the first feeding portion.

As shown in FIGS. 4, 7 and 8, the bearing member 27 is provided with the second feeding passageway 61, as the residual toner discharging portion 40, in fluid communication with the first feeding passageway 51 and extends in the direction perpendicular to the axis of the photosensitive drum 1. The second feeding passageway 61 is provided with the discharge opening 32*d*.

As shown in part (a) of FIG. 7, the first coupling member 29 is disposed in the second feeding passageway 61. The first coupling member 29 is supported by the supporting portion 28*b* of a coupling receptor 28 so as to be rotatable about the center line 61*a*. As shown in FIG. 8, the first coupling member 29 is provided with a plurality of drive pins 29*b* which are sequentially engaged with the drive transmission blade 26*g* provided on the feeding screw 26. Therefore, the driving force is transmitted from the feeding screw 26 to the first coupling member 29. In this manner, the driving rotation for the photosensitive drum 1 is converted into the rotation about an axis perpendicular to the axis of the photosensitive drum 1 (center line 61*a* of the second feeding passageway 61) and is transmitted to the first coupling member 29. The drive transmission blade 26*g* is a blade (helical portion) constituting the above-described reverse screw portion 26*e*, and the first coupling member 29 receives the driving force (rotational force) from the reverse screw portion 26*e*.

(Detailed Structure in the Neighborhood of the Residual Toner Discharge Opening)

Referring to FIGS. 9 and 10, the structure of the residual toner transportation portion (residual toner transportation portion 40) from the first coupling member 29 of the process cartridge 7 to the discharge opening 32*d* will be described.

FIG. 9 is an exploded view illustrating the structure of the residual toner discharging portion. FIG. 10 is a sectional view illustrating mounting of the first coupling member 29 and the second coupling member 30 to the coupling receptor 28. The residual toner which is the untransferred toner removed from the photosensitive drum 1 is fed to the main assembly receiving opening 80*d* by way of the first coupling member 29, the coupling spring 31, the second coupling member 30 and the residual toner connecting member 32. As will be described hereinafter, the residual toner connecting member 32 can be engaged with and disengaged from the main assembly receiving opening 80*d*.

As shown in FIG. 9, the first coupling member 29, the second coupling member 30, the coupling spring 31, the coupling receptor 28 and the residual toner connecting member 32 are arranged substantially on a common axis along the center line 61*a*. The first coupling member 29 and the second coupling member 30 are connected with each other by the coupling spring 31. The residual toner connecting member 32 is mounted so as to be movable in a direction of an arrow N (FIG. 10) relative to the coupling receptor 28 together with the second coupling member 30 against an urging force of the coupling spring 31. For the connection of the process cartridge 7 with the main assembly 100, the residual toner connecting member 32 is movable in the direction indicated by the arrow N in FIG. 10.

Referring to FIGS. 7, 9, 10 and 11, the mounting of the residual toner transportation portion 40 will be described.

FIG. 11 shows the assembled residual toner connecting member.

As shown in FIG. 7, the second feeding passageway 61 is a toner feeding passageway formed in the residual toner discharging portion 40. As shown in FIG. 9, the residual toner discharging portion 40 comprises the coupling receptor 28, the first coupling member 29, the second coupling member 30, the coupling spring 31 and the residual toner connecting member 32.

As shown in FIG. 9, the first coupling member 29 is provided with a plurality of drive pins (engaging portions projections) 29*b* in the form of projections engageable with the feeding screw 26 for rotation. The drive pins 29*b* are substantially equidistantly arranged about the rotational axis of the first coupling member 29 substantially on a concentric circle. The drive pins 29*b* project in the axial direction of the first coupling member 29. The first coupling member 29 is provided with two drive claws 29*c* in the form of projections for transmitting the driving force to the second coupling member 30.

That is, the first coupling member 29 is a drive transmitting portion for transmitting the driving force (rotational force) of the feeding screw 26 to the second coupling member 30. The rotational axis of the first coupling member 29 crosses with the rotational axis of the feeding screw 26 (substantially perpendicular to each other). Thus, when the rotational force is transmitted, the first coupling member 29 changes the direction of rotation. The first coupling member 29 is provided in the toner feeding passageway.

The driving claw 29*c* of the first coupling member 29 is fitted into the inside circumference of the cylindrical portion 28*a* of the coupling receptor 28 so that the first coupling member 29 is rotatably supported. The driving claw 29*c* has a partly cut-away cylindrical configuration. The second coupling member 30 is provided with a driving claw 30*f* at each of two positions to receive the rotation drive from the driving claw 29*c* of the first coupling member 29. The second coupling member 30 is provided with a recess 30*h* and a spring hook groove portion 30*c* as opposed to the driving claw 30*f*.

The driving claw 30*f* also has a partly cut-away cylindrical configuration. The driving claw 30*f* has a substantially the same outer diameter as the driving claw 29*c*. As shown in FIG. 10, the second coupling member 30 is inserted into the cylindrical portion 28*a* of the coupling receptor 28 so that the driving claw 30*f* is opposed to the driving claw 29*c* of the first coupling member 29.

The driving claws 29*c*, 30*f* can be said to be projections by the partly-cutting-away of the cylindrical configuration, or bent plates having drive transmission surfaces. In this embodiment, the outer configuration thereof is trapezoidal such that one side is inclined, and the opposite side is parallel with the rotational axis. These configurations are not limited to the example, but it will suffice if phase deviation is permitted while transmitting the driving force.

On the other hand, the coupling spring 31 at the urging member is a twisted coil spring having a bent free-end 31*a* and a ring configuration 31*b* in the opposite direction. The coupling spring 31 is inserted into the second coupling member 30 in a direction of an arrow I, so that the end portion 31*a* is fitted in the spring hook groove 30*c* (FIG. 9).

The circular portion 31*b* of the coupling spring 31 is engaged with a groove portion 29*f* of the first coupling member 29. Here, the coupling spring 31 is expanded from the free length. In other words, the coupling spring 31 applies the urging force in the contracting direction. By this, the first coupling member 29 and the second coupling member 30 are urged toward each other. By the urging force, a supporting portion 29*d* of the first coupling member 29 abuts to the supporting portion 28*b* of the coupling receiving portion 28.

To the second coupling member 30, a supporting portion 28*c* provided at the free end portion of the cylindrical portion 28*a* of the coupling receptor 28 and a projection 30*d* provided on the driving claw 30*f* abut to each other. In this state of receiving the urging force of the coupling spring 31, is positioned with respect to the rotational moving direction T of the center line 61*a*.

In the state of being urged by the coupling spring 31, the first coupling member 29 and the second coupling member 30 are rotatably supported on the inner surface of the cylindrical portion 28*a* of the coupling receptor 28 through the driving claws 29*c* and 30*f*. The first coupling member 29 and the second coupling member 30 are integrally rotatable by the engagement between the engaging portion 29*e* and the engaging portion 30*g* in the direction of the arrow T of the center line 61*a*.

(Mounting of Coupling Receptor)

The coupling receptor 28 is mounted to the bearing member 27R by welding or bonding or the like at the welded portion 28*e*, in the state that the first coupling member 29, the second coupling member 30 and the coupling spring 31 are mounted thereto. By this, the leakage of the residual toner to the outside is reduced.

As shown in FIG. 11, the residual toner connecting member 32 is provided with a supporting portion 32*a* to be supported by the second coupling member 30 in the axial direction. As shown in FIG. 9, the coupling receptor 28 is provided with a rotation stopper rib 28*d* for positioning the residual toner connecting member 32 in the rotational direction. Furthermore, the residual toner connecting member 32 is provided with a recessed groove 32*i* for positioning in the rotational direction, at a part of the circumference. Second coupling member 30 is provided with a compression claw 30*e* at diametrically opposite positions.

As shown in FIG. 11, the coupling receptor 28 is provided with the first coupling member 29, the second coupling member 30 and the coupling spring 31. The residual toner connecting member 32 is coaxially fitted around the coupling receptor 28 in the direction indicated by the arrow I. By moving the residual toner connecting member 32 in the direction of the arrow I, the rotation stopper rib 28*d* of the coupling receptor 28 is engaged with the groove 32*i* of the residual toner connecting member 32 (FIG. 9). In this manner, the relative position between the coupling receptor 28 and the residual toner connecting member 32 with respect to the rotational moving direction about an axis 61*a* is limited.

When the residual toner connecting member 32 is further telescoped around the coupling receptor 28, the supporting portion 32*a* enters by deforming radially inwardly the compression claw 30*e* of the second coupling member 30 supported by the coupling receptor 28.

By further telescoping the residual toner connecting member 32, the supporting portion 32*a* rides over the compression claw 30*e* of the second coupling member 30, and the residual toner connecting member 32 is supported by the compression claw 30*e* of the second coupling member 30 by the supporting portion 32*a* in the vertical direction (part (b) of FIG. 11).

(Structure of Residual Toner Feeding Portion with Respect to the Longitudinal Direction)

Referring to FIGS. 4, 12 and 23, the structure of the residual toner transportation portion 40 with respect to the longitudinal direction will be described. FIG. 12 is a schematic view illustrating the driving connection structure for the residual toner discharging portion 40.

As shown in FIG. 4, the feeding screw 26 is provided in the first feeding passageway 51. The supporting portions 26*b*, 26*c* provided at the opposite ends of the feeding screw 26 are rotatably engaged with holes 27La, 27Ra provided in bearing members 27L, 27R, respectively.

The photosensitive drum 1 is also rotatably supported by the bearing member 27. As shown in FIG. 12, one end portion of the photosensitive drum 1 is provided with a coupling portion 1*c* for receiving a driving force from the main assembly 100. The other end thereof is provided with a photosensitive drum gear 1*b* for transmitting the driving force to the residual toner feeding screw 26, as will be described hereinafter.

As shown in FIG. 12, the cleaning unit 13 is provided at one axial end of the photosensitive drum 1 with the photosensitive drum gear 1*b*, an idler gear 52 rotatably supported by the bearing member 27 and a feeding screw gear 53.

The feeding screw gear 53 is engaged with the feeding screw 26, for driving force transmission. The rotational force is transmitted from a main assembly drum input coupling 81 (FIG. 23) of the image forming apparatus 100 to the coupling portion 1*c* at one end of the cleaning unit 13. The transmitted rotational driving force is in turn transmitted from the photosensitive drum 1 to the feeding screw 26 by the sequential engagement of the photosensitive drum gear 1*b*, the idler gear 52 and the feeding screw gear 53. The residual toner accommodated in the residual toner accommodation chamber 14*a* is fed in the direction of the arrow H (axial direction of the feeding screw 26) by the feeding screw portion 26*a* by the rotation of the feeding screw 26 in the direction of the arrow G.

At the downstream side end portion of the feeding screw 26 with respect to the residual toner feeding direction, the reverse screw portion 26*e* is provided. The reverse screw portion 26*e* is provided with a drive transmission blade 26*g* in the form of a screw. In this embodiment, the feeding screw 26 receives the driving force by the rotation of the photosensitive drum 1. However, the feeding screw 26 may be driven in interrelation with the rotation of the developing roller 17.

FIG. 29 shows such a modified example. FIG. 29 illustrates an example of a structure with which the feeding screw 26 receives the driving force from the developing roller 17. With the structure shown in FIG. 29, one end of the toner supplying roller 20 is provided with a coupling portion 57 for receiving the driving force from the main assembly 100. The other end thereof is provided with a toner supplying roller gear 58 for transmitting the driving force to the residual toner feeding screw 26, as will be described hereinafter. As shown in FIG. 29, the developing device 4 includes the toner supplying roller gear 58 and a developing roller gear 59. A drum bearing 27 supports the idler gear 52 and the feeding screw gear 53.

The feeding screw gear 53 is engaged with the feeding screw 26, for driving force transmission. The rotational force is transmitted from a main assembly development input coupling 82 of the image forming apparatus 100 to the coupling portion 57 provided at the end of the developing device 4. The transmitted rotational force is transmitted from the toner supplying roller 20 to the feeding screw 26 through the developing roller 17 by the sequential engagement of the toner supplying roller gear 58, the developing roller gear 59, the idler gear 52 and the feeding screw gear 53. The residual toner accommodated in the residual toner accommodation chamber 14*a* is fed in the direction of the arrow H by the feeding screw portion 26*a* by the rotation of the feeding screw 26 in the direction of the arrow G.

In this manner, the second coupling member 30 is rotated in interrelation with the toner supplying roller 20 and the developing roller 17. The developing roller gear 59, the developing roller gear 59, the idler gear 52, the feeding screw gear 53, the feeding screw 26 and the first coupling 29 constitute the drive transmitting portion for transmitting the driving force from the toner supplying roller 20 to the second coupling member 30.

(Position of the Feeding Passageway in the Longitudinal Direction)

FIG. 13 is a sectional view illustrating the position of the residual toner feeding in the main assembly 100.

As shown in FIG. 13, a main assembly feeding portion 80 is provided in the front side of the rear side plate 98 provided with the mounting direction abutting portion, with respect to the mounting direction of the process cartridge 7. Therefore, it is not required that a cut-away portion for the residual toner discharging portion or the like of the process cartridge 7, as compared with the case in which the main assembly feeding portion 80 is provided in the rear side of the rear side plate 98 with respect to the mounting direction (arrow J). Therefore, as compared with the case in which the cut-away portion is provided, strength of the rear side plate 98 is assured. Here, particularly noting only of the structure for feeding the residual toner, it is desirable that the second feeding passageway 80*b* is disposed right below the first feeding passageway 80*a*. However, as shown in FIG. 5, the main assembly second feeding passageway 80*b* extends over the process cartridges 7Y, 7M, 7C and 7K. Therefore, in the case that the main assembly feeding passageway 2 is disposed right below the main assembly feeding passageway 1, the result is that it enters toward the process cartridge 7 in the front side with respect to the mounting direction.

Therefore, from the standpoint of the toner filling volume of the process cartridge 7, it is difficult to place the second feeding passageway 80*b* right below the first feeding passageway 80*a*, as shown in FIG. 13. In other words, if the second feeding passageway 80*b* is disposed right below the first feeding passageway 80*a*, it is unavoidable to decrease the toner filling capacity of the process cartridge 7. In addition, in order to place the second main assembly feeding passageway 80*b* in the rear side with respect to the mounting direction, it is necessary to greatly cut away the rear side plate 98. Then, the strength of the rear side plate 98 becomes low. The rear side plate 98 functions to position the process cartridge 7, and therefore, a high-strength is desirable.

As described hereinbefore, the main assembly second feeding passageway 80*b* is desirably placed at a position as close as possible to the rear side plate as shown in FIG. 13. For this reason, the center lines of the first main assembly feeding passageway 80*a* and the second main assembly feeding passageway 80*b* are offset in the longitudinal direction, as depicted by AB in the Figure.

[Expansion and Contraction Mechanism]

The description will be made as to an expansion and contraction mechanism and an expanding-and-contracting operation for expansion and contraction of the toner feeding passageway.

Figure 1:
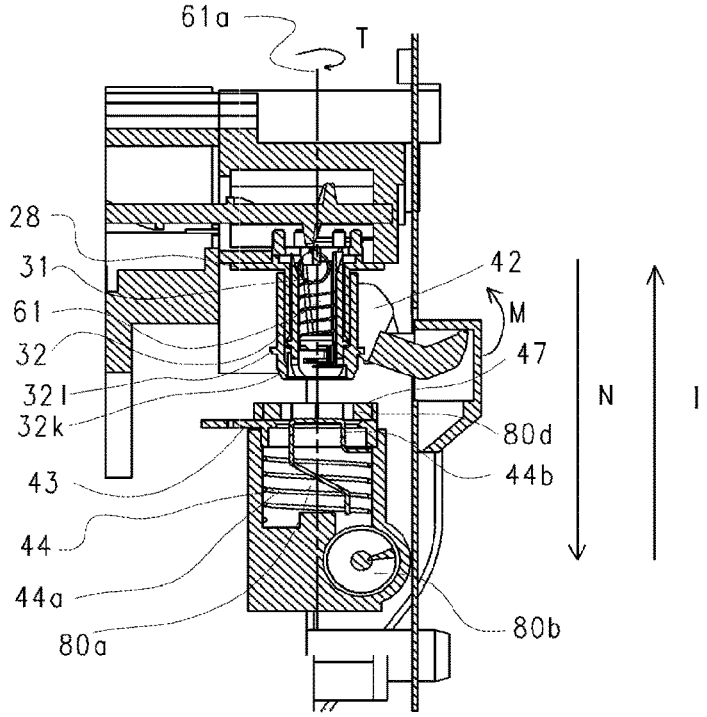
Figure 1:
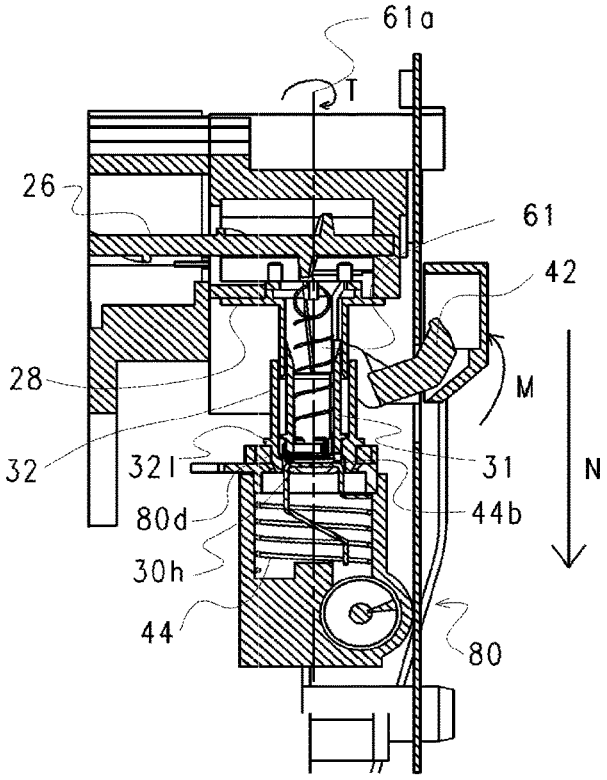

Referring to FIGS. 1, 7 and 10, the expanding-and-contracting operation of the residual toner connecting member 32 will be described. As shown in FIG. 7, the residual toner connecting member 32 is supported by the drum bearing 27 and the process cartridge 7 through the first coupling member 29, the second coupling member 30 and the coupling receptor 28.

The first coupling member 29 and the second coupling member 30 are connected with each other by the urging force provided by the coupling spring 31 in the direction of the arrow I. Therefore, the residual toner connecting member 32 supported by the second coupling member 30 is movable against the urging force of the coupling spring 31 in the direction of the arrow I within the range in which it is engageable with the cylindrical portion 28*a* of the coupling receptor 28.

Therefore, the residual toner connecting member 32 is movable together with the second coupling member 30 relative to the process cartridge 7 in the direction of the arrow N (part (b) of FIG. 1 and part (b) of FIG. 10).

In addition, as shown in FIG. 10, the driving claw 29*c* of the first coupling member 29 and the driving claw 30*f* of the second coupling member 30 are supported so as to be engageable in the rotational direction T in the inside circumference of the cylindrical portion 28 of the coupling receptor 28. Here, engaging portions 29*e*, 30*g* have projecting configurations extending in the axial direction. Therefore, even in the state that the second coupling member 30 has moved in the direction of the arrow N relative to the first coupling member 29 (part (b) of FIG. 1 and part (b) of FIG. 10), the engaging portions 29*e*, 30*g* are capable of transmitting the driving force in the rotational direction T. As shown in part (b) of FIG. 1 and part (b) of FIG. 10, when the cartridge is set in the main assembly and is operating for the printing operation, the residual toner connecting member 32 is in the state that the second coupling member 30 has moved relative to the first coupling member 29 in the direction of the arrow N (drive transmission position). By this, the residual toner discharging portion 32*d* at the free end of the residual toner connecting member 32 suppresses the leakage of the toner by entering the receiving opening 80*d* of the main assembly 100 by a predetermined amount. The details of feeding of the residual toner at this time will be described hereinafter.

On the other hand, in the free state of the process cartridge 7 (retracted position, part (a) of FIG. 1 and part (a) of FIG. 10), the first coupling member 29 and the second coupling member 30 attract to each other by the coupling spring 31. By this, the state is that the residual toner connecting member 32 has moved in the direction of the arrow I. By this, the free end of the residual toner connecting member 32 is within the outer configuration (outer configuration line L of FIG. 7) of the process cartridge 7.

The first coupling member 29 and the second coupling member 30 of the residual toner discharging portion of the process cartridge 7 are engaged with each other to rotate, in a main assembly connection state (drive connecting position, part (b) of FIG. 1) and main assembly retraction state (retracted position, part (a) of FIG. 1). Therefore, even in the free state of the process cartridge 7, the engagement between the first coupling member and the second coupling member can be checked by rotating the photosensitive drum 1.

[Driving Structure in Cartridge]

The description will be made as to a driving path of the driving force received by the cartridge from the motor provided in the main assembly, within the cartridge.

(Driving Connection Mechanism)

Referring to FIG. 8, the drive transmission method from the feeding screw 26 to the first coupling member 29 in this embodiment will be described in detail.

FIG. 8 illustrates the engagement between the drive transmission blade 26*g* and the first coupling member 29.

As shown in FIG. 8, when the residual toner screw 26 rotates in the direction of the arrow G, the drive transmission blade 26*g* moves in the direction of an arrow S. The drive transmission blade 26*g* moving in the direction of the arrow S and one (29*b*1) of the drive pins 29*b* of the first coupling member 29 are engaged with each other to move the drive pin 29*b* in the direction of the arrow S. By this force, the first coupling member 29 is rotated in the direction of the arrow T about the center line 61*a*.

The drive pins 29*b* are in the form of cylindrical projecting configurations arranged at equidistant angular positions about the axis of the coupling 29. In this embodiment, six drive pins 29*b* are arranged at 60° intervals, and each have 1.8 mm of diameter.

When the first coupling member 29 is rotated in the direction of the arrow T, two (29*b*1, 29*b*2) of the drive pins 29*b* come in the range capable of contacting with the drive transmission blade 26*g*.

A line (X) perpendicular to the axial direction of the feeding screw 26 passing through the center of the first coupling member 29 is in the center. At this time, the two drive pins 29*b* are at the same angular positions Y in the opposite side with respect to the line X. At this time, the drive pin 29*b*1 and the drive pin 29*b*2 are most distant from each other in the axial direction of the feeding screw 26 (part (a) of FIG. 8).

The drive transmission blade 26 rotates the drive pin 29*b*1 in the direction T in the downstream side of the drive pin 29*b* with respect to the rotational moving direction T. When the drive pin 29*b*1 is away from the drive transmission range of the drive transmission blade 26*g*, the first coupling member 29 temporarily stops until the drive transmission pin 29*b*2 which is upstream of the drive transmission pin 29*b*1 in the rotational moving direction is brought into contact to the drive transmission blade 26*g*. When the feeding screw 26 further rotates, the drive transmission blade 26*g* moving in the direction of the arrow S contacts to the drive transmission pin 29*b*. By a further movement of the drive transmission blade 26*g* (part (b) of FIG. 8) in the direction of the arrow S, the drive transmission pin 29*b*2 of the first coupling member 29 is moved in the direction of the arrow S. In this manner, the first coupling member 29 starts to rotate in the direction of the arrow T, again.

By repeating the above-described operation, the first coupling member 29 continues to be rotated by the rotation of the feeding screw 26.

Here, the pitch of the drive transmission blade 26*g* is larger than a distance Z between the drive pins 29*g* as measured in the axial direction. Thus, the drive pins 29*b* can be continuously pushed by the engagement between the drive transmission blade 26*g* and the drive pins 29*b*.

The closer the pitch of the drive pins 29*b* and the intervals of the feeding screw 26 in the axial direction of the feeding screw 26 to each other, the more continuously (more smoothly) the first coupling member 29 rotates.

(Driving Pin Configuration)

In this embodiment, the drive pin 29*b* has a cylindrical configuration, but another configuration is usable if the drive transmission is possible. For example, a blade configuration corresponding to the feeding screw 26 and a projecting configuration such as a gear or the like can provide the same effects. FIG. 14 schematically shows a modified example of the drive pin 29*b*.

As shown in FIG. 14, a drive pin 129*b* of the first coupling member 129 is integrally provided with a toner guide the surface 129*f*. The toner guiding surface 129*f* provided on the drive pin 129 is disposed outside the hole portion 129*a*.

The toner guiding surface 129*f* provides a surface connecting an outer circumference side 129*g* of the guiding surface and an inner circumference side 129*h* of the guiding surface. The outer circumference side 129*g* extends toward the downstream side with respect to the rotational moving direction T (clockwise direction) of the first coupling member 129, and the inner circumference side 129*h* is in the upstream side with respect to the rotational moving direction T. That is, with the rotation of the first coupling member 129, the toner guiding surface 129*f* produces a force for moving the toner inwardly. Thus, the toner guiding surface 129*f* functions as a toner feeding portion for feeding the toner.

With such a structure, by rotating the first coupling member 129 in the direction of the arrow T, the residual toner is guided into the hole portion 129*a*. By this, the residual toner is positively fed into the hole portion 129*a*. The hole portion 129*a* is an opening for permitting the toner toward the second feeding passageway 61.

(Residual Toner Driving Connection)

Referring to FIGS. 1, 16, the driving connection of the residual toner discharging portion to the main assembly 100 will be described.

FIG. 1 is a sectional view illustrating a connecting method between a residual toner discharging portion 23*d* and the main assembly residual toner receiving opening 80*d*. FIG. 16 is a schematic view illustrating a connecting method of a residual toner connecting portion 32. As shown in FIG. 1, the main assembly 100 comprises the residual toner receiving opening 80*d* for receiving the discharging toner from the process cartridge 7.

The residual toner receiving opening 80*d* is provided with an elastic sealing member 47 such as rubber sponge. When the residual toner connecting member 32 of the process cartridge 7 is pressed down, it enters a main assembly receiving opening sealing member 47 provided in the discharging toner receiving opening 80*d*, in a press-fitting state (part (b) of FIG. 1). Therefore, a gap between the residual toner connecting member 32 and the discharging toner receiving opening 80*d* is sealed by the main assembly receiving opening sealing member 47, by which the leakage of the residual toner is suppressed.

In this embodiment, the main assembly receiving opening sealing member 47 has an inner diameter Φ10.4 mm, and the residual toner connecting member 32 has a diameter of Φ11.4 mm. As shown in FIG. 23, the main assembly receiving opening sealing member 47 is provided with a plurality of slits 47*a* to accept the residual toner connecting member 32 easily. The residual toner connecting member 32 is provided with a tapered configuration 32*k* to accommodate a positional deviation between the residual toner connecting member 32 and the residual toner receiving opening 80*d* in the axial direction.

The residual toner connecting members 32 is provided with a rib configuration 32*l*, by which when it is mounted to the residual toner receiving opening 80*d*, the gaps is closed. As shown in FIG. 1, the main assembly residual toner transportation portion 80 is provided with the first main assembly feeding passageways 80*a* having the residual toner receiving opening 80*d* and the second feeding passageways 80*b* for feeding the residual toner into the residual toner container 86 of the main assembly 100.

The first main assembly feeding passageways 80*a* is provided with a spring stopper 43 adjacent to the receiving port. The vibrating member 44 having an elastic force provided in the first main assembly feeding passageway 80*a* is supported by the spring stopper 43 by abutment thereto at the spring portion 44*a*.

As shown in part (b) of FIG. 1, along with a closing operation of a front door 91 (FIG. 19) of the apparatus main assembly 100, the residual toner connecting member 32 is urged in the direction of the arrow N by the arm 42 and enters the residual toner receiving opening 80*d*. With this intrusion (entry), against the reaction force of the vibration member 44, the residual toner connecting member 32 presses the vibration member 44 in the direction of the arrow N (the direction of entering the residual toner connection port).

Furthermore, the vibration member 44 abuts against the second coupling member 30 in the residual toner connecting member 32 with an urging force. The abutted second coupling member 30 rotates in interrelation with the rotation of the photosensitive drum 1. By this, the abutment portion 44*b* of the vibration member 44 abuts against the recess 30*h* of the second coupling member 30, and the vibration member 44 moves in the vertical direction. Details will be described hereinafter.

Here, the spring coupling 44 is a compression spring having a wire diameter of Φ0.6 mm and an inner diameter Φ12.3 mm, approximately. The spring coupling 44 provides the urging forces of approx. 33 gf in the state of abutting to the spring stopper 43 (uncoupled state) and approx. 50 gf in the connection state of the second coupling member 30.

That is, in the state shown in part (b) of FIG. 16, the arms 42 rotates in the direction of an arrow M by the force exceeding a total approx. 120 gf of the coupling spring reaction force and the residual toner connection opening urging force. With this structure described in the foregoing, a drive transmission passageway of the residual toner transportation portion is as follows.

When the photosensitive drum 1 of the process cartridge 7 rotates in the direction of arrow A in accordance with the printing operation, the driving force is transmitted to the drum gear 1*b*, the idler gear 52, the feeding screw gear 53, and the feeding screw 26. Furthermore, the driving force is transmitted from the feeding screw 26 in the order of the first coupling member 29 and the second coupling member 30. In this manner, the residual toner is discharged from the process cartridge 7 to the main assembly 100. Furthermore, the vibration member 44 of the apparatus main assembly 100 is vibrated by the rotational driving force from the second coupling member 30. The residual toner fed to the vibration member 44 is loosened by the vibration of the vibration member 44 in the main assembly feeding portion 80 and it is fed to the main assembly feeding screw 85 and fed to the residual toner box 86 by the carrying force of the main assembly feeding screw 85.

[Flow of Residual Toner Accompanying Image Formation]

The description will be made as to how the residual toner produced as a result of the image forming operation is supplied into the residual toner box of the main assembly of the image forming apparatus.

(Flow of the Residual Toner into the Residual Toner Box)

Referring to FIGS. 1, 4 and 7, the entire flow of the residual toner from the production of the residual toner to the main assembly 100 will be described. As shown in FIG. 4, when the photosensitive drum 1 rotates with the printing operation, the residual toner is removed by the cleaning blade 6. The removed residual toner it is fed to the first coupling member 29 by the feeding screw 26. In the feeding passageway 51 of the residual toner accommodating portion 14*a*, the residual toner is fed in the direction of the arrow H.

The residual toner receives a feeding force in the direction opposite to the direction of the arrow H by the reverse screw portion 26*e*. Therefore, the residual toner is fed in the direction of the arrow H and the residual toner fed in the opposite direction by the reverse screw portion 26*e* collide to each other at the position between the feeding screw portion 26*a* and the reverse screw portion 26*e* and stagnates there.

Here, as shown in FIGS. 3 and 7, between the feeding screw 26 and the photosensitive drum 1, the residual toner accommodating portion 14*a* is provided. The first coupling member 29 is please in the residual toner accommodating portion 14*a*. The stagnating toner flows in the axial center direction of the first coupling member 29. And, it is fed to a hole 29*a* (part (a) of FIG. 7, FIG. 9) provided on the rotational axis of the first coupling member 29. The hole 29*a* is an opening for allowing movement of the toner. The toner which has passed through this hole 29*a* moves to the second feeding passageway 61. Furthermore, the residual toner is discharged through a discharge portion 32*d* provided at a lower portion of the first coupling member 29 which will be described hereinafter.

At this time, the residual toner flowing in the direction of the arrow H receives the feeding force in the opposite direction by the reverse screw portion 26*e*. By this, the residual toner is prevented from entering a contacting position V between the drive transmission blade 26*g* and the drive pin 29*b*. By this, the contact portion V between drive transmission blade 26*g* and the drive pin 29*b* is not easily influenced by the residual toner. Therefore, the stability of the drive transmission is improved.

(Toner Flow in the Residual Toner Discharging Portion)

As described in the foregoing, in the residual toner discharging portion 40 the residual toner is fed by the residual toner screw 26 along the axial direction of the photosensitive drum 1 toward one end portion side of the cartridge (arrow H in FIG. 4). The fed residual toner particles collide at the position between the feeding screw portion 26*a* and the reverse screw portion 26*e* to be fed into the hole portion 29*a* of the first coupling member 29.

As shown in FIG. 8, with the rotation of the feeding screw 26, the first coupling member 29 is rotated in the direction of the arrow T. As shown in FIGS. 7 and 9, the first coupling member 29 is provided with the hole portion (opening) 29*a*. The residual toner having passed through the hole portion 29*a* flows into the inner diameter portion of the coupling spring 31 of the first coupling member 29. In addition, the residual toner flows into the hole portion 30*a* of the second coupling member 30 engaged with the first coupling member 29. Simultaneously, with the rotation of the first coupling member 29, the driving force is transmitted from the engaging portion 29*e* to the engaging portion 30*g* of the second coupling member 30. By this, the second coupling member 30 and the coupling spring 31 rotate integrally with each other.

Here, the coupling spring 31 (FIG. 9) is wound in such a direction that the residual toner is fed in the direction of the arrow N in FIGS. 1, 7 when it rotates together with the first coupling member 29 and the second coupling member 30. For this reason, the residual toner is positively fed in the direction of the arrow N in addition to the free falling in the direction of the arrow N. In addition, the coupling spring 31 is effective to loosen the residual toner by the rotation in the second feeding passageway 61. Therefore, the feeding (movement) of the residual toner is made smoother. That is, the urging member (coupling spring 31) urging the second coupling member 30 is provided with a feeding portion for feeding the toner and a stirring portion effective to stir the toner as well.

The residual toner having passed through the coupling spring 31 and the hole portion 30*a* of the second coupling member 30 is discharged to the residual toner discharging portion 32*d* of the residual toner connecting member 32 supported in the direction of the arrow N by the second coupling member 30. The foregoing is the discharging of the residual toner in the process cartridge 7.

(Residual Toner Flow in Downstream Side of the Residual Toner Discharging Portion)

As shown in FIGS. 1, 4 and 7, the residual toner discharged from the residual toner discharging portion 32*d* enters the feeding passageway 80*b* from the residual toner receiving opening 80*d* provided in the main assembly of the image forming apparatus 100 below the residual toner discharging portion 32*d*. Then, the residual toner in the feeding passageway 80*b* is discharged into the residual toner box (main assembly side toner accommodating portion) 86 by the main assembly feeding screw 85 as the feeding member in the second feeding portion 80*b* which is the main feeding passageway.

The residual toner feeding method described above will be explained in detail.

The residual toner fed from the residual toner discharge opening 32*d* of the process cartridge 7 into the first feeding passageway 80*a* freely falls into the main assembly first feeding passageway 80*d*.

As shown in FIG. 4, a main assembly second feeding passageway 80*b* which is substantially perpendicular to the lower end of the main assembly first feeding passageway 80*d* is connected by a connecting portion 80*f*. The residual toner fed in the falling direction is fed to the main assembly second feeding unit 80*b*.

Here, the first feeding passageway 80*a* and the second feeding passageway 80*b* are arranged so as to shift the central axis in a substantially orthogonal position and clogging of the residual toner at the connecting portion 80*f* is likely to occur. In view of this, as will be described hereinafter, the vibration member 44 vibrates by the action imparted from the process cartridge 7 so that the residual toner is loosened, and the toner clogging at the connecting portion 80*f* is prevented, and therefore, the residual toner is conveyed stably. The residual toner fed to the main assembly second feeding portion 80*d* is fed in the direction of the arrow R upon receiving the feeding force of the main assembly feeding screw 85 as the feeding member shown in FIG. 5, and is fed to the residual toner box 86 and collected therein.

Here, as shown in FIG. 5, the second main assembly feeding passageway 80*b* extends over the respective color process cartridges. The residual toner box 86 is in the form of an exchangeable box.

(Configuration and Disposition of Coupling)

The inner diameter of the hole portions of the first coupling member 29 and the second coupling member 30 and the coupling spring 31 are selected such that the residual toner is stably discharged.

The residual toner connecting member 32 is mounted to the outside of the coupling receptor 28 provided with the first coupling member 29 and the second coupling member 30 therein. Therefore, the outer diameter of the cylindrical shape 28*a* of the coupling receptor 28 is approx. Φ9.2 mm, and the outer diameter of the residual toner connecting member 32 is approx. Φ11.4 mm. As described hereinbefore, the residual toner connecting member 32 enters the residual toner receiving opening 80*d* of the main assembly 100. In this embodiment, the inner diameter of the residual toner receiving opening 80*d* is Φ10.4 mm, and the residual toner connecting member 32 enters while compressing the main assembly receiving opening sealing member 47 to close the gap.

Here, the hole portion 29*a* of the first coupling member 29 and the hole portion 30*a* of the second coupling member 30 have the inner diameters of Φ5.4 mm through which the residual toner passes. The inner diameter of the coupling spring 31 is about 4.5 mm. In addition, the residual toner discharging portion 32 has about Φ 8.4 mm, and the main assembly receiving opening 80*d* is about Φ 10.4 mm as described above. Thus, the diameter of the feeding passageway increases toward the downstream side of the residual toner transportation. By doing so, the toner clogging in the residual toner transportation passageway from the process cartridge 7 to the main assembly feeding portion 80 is prevented, thus stabilizing the toner discharging.

(Residual Toner Clogging)

As shown in part (b) and (c) of FIG. 7, in the main assembly 100, the arrow N direction which is the residual toner feeding direction is inclined relative to the free falling direction of the residual toner by approx. 19° inclination.

Additionally, in the main assembly 100, the residual toner connecting member 32 and the second coupling member 30 are in the positions having moved in the direction of the arrow N against the urging force of the coupling spring 31, that is, they are in the drive transmission position.

In addition, the first coupling member 29 and the second coupling member 30 are engageable with each other in the rotational moving direction in the engaging portion 29*e*, 30*g* even in the state that they have moved in the direction of the arrow N which is the axial direction.

As shown in part (c) of FIG. 7, the residual toner fed into the hole portion 29*a* of the first coupling member 29 is further fed along the arrow N direction through the second coupling member 30, the coupling spring 31 and the residual toner connecting member 32.

At this time, by the free falling of the residual toner, it is accumulated at the end portion (U) of the residual toner connecting member 32 with respect to the direction of gravity. The residual toner connecting member 32 is provided with the projecting configuration supporting portion 32*a* supported by the above-described second coupling member.

Therefore, the residual toner is fed to the residual toner discharge opening 32 while accumulating on the projecting configuration supporting portion 32*a*. At this time, the residual toner connecting member 32 and the second coupling member 30 move toward the first coupling member 29 with the residual toner accumulated in the U-shaped portion of the residual toner discharging portion 32. The accumulated residual toner in U portion is pushed out in the direction of the arrow N to a tapered portion 28*f* of a cylindrical free end portion 28*c* of the coupling receptor 28. Thereafter, the residual toner flows through a plurality of slit portions 32*j* provided in the supporting portion 32*a* of the residual toner discharging portion 32 shown in FIG. 11 to be fed into the residual toner discharging portion 32*d*.

With the above-described the structures, the residual toner clogging can be prevented when the residual toner connecting member 32 and the second coupling member 30 returns to the positioning determining position from the position away from the first coupling member 29.

[Structure of Shutter]

Referring to FIG. 17, the description will be made as to the motion of the shutter (openable member) 34 provided on the residual toner connecting member 32 at the time of mounting. FIG. 17 is a perspective view illustrating a supporting structure for the shutter. In the rear side of the process cartridge 7 with respect to the mounting direction (arrow J), the residual toner connecting member 32 which is the above-described residual toner discharge opening is provided.

As shown in FIG. 17, the residual toner connecting member 32 is provided with guide portions 32*b*, 32*c* in the form of projections projecting in the axial direction. The shutter 34 is provided with groove portions 34*a*, 34*b* at the opposite end portions with respect to the direction along the cross-section plane.

Shutter 34 is guided by the projecting configuration guide portions 32*b*, 32*c* at the groove portions 34*a*, 34*b* so as to be movable in the mounting direction (arrow J direction), and seals the residual toner discharging portion 32*d*.

The shutter 34 is provided with an elastic sealing member 35 for sealing the residual toner discharging portion 32*d*. The shutter 34 is supported such that the elastic sealing member 35 is compressed by the discharge opening 32*d*. Therefore, as shown in part (a) of FIG. 17, the discharge opening 32*d* of the residual toner connecting member 32 is closed by the elastic sealing member 35 without gap, thus sealing against the residual toner.

As shown in part (b) of FIG. 17, the shutter 34 is urged toward the rear side in the mounting direction (arrow J direction) by the urging member 36 provided on the cleaning frame 14. A discharge opening abutting portion 34*d* of the shutter 34 is abutted to an abutting portion 32*e* of the residual toner connecting portion 32 by the urging member 36. In this manner, the shutter 34 is positioned and supported by the residual toner connecting member 32 on the process cartridge 7.

Furthermore, the cleaning frame 14 is provided with a shutter guide portion 14*b* supporting the shutter 34 movably in the mounting direction and extending in the mounting direction (arrow J direction) at the same position as the guide portion 32*b* of the residual toner connecting member 32 with respect to a plane of cross-section.

As shown in FIG. 17, the shutter engaging portions 34*a*, 34*b* of the shutter 34 is partly supported by the shutter guide portion 14*b* of the cleaning frame 14 in abutment to the abutting portion 32*e* of the residual toner connecting member 32. In other words, the shutter 34 is supported by residual toner connecting member 32 and the cleaning frame 14.

As shown in part (c) of FIG. 17, the shutter 34 moves in the direction opposite to the inserting direction (opposite to the arrow J direction) in the process cartridge 7 in the mounting to the main assembly 100. Thus, the shutter 34 is capable of opening and closing the opening (discharge opening 32*d*) for discharging the residual toner.

The shutter 34 is completely disengaged from the shutter guide portions 32*b*, 32*c* of the residual toner connecting member 32 by the movement in the direction opposite to the arrow J. Then, the shutter 34 is engaged with and is supported by only the guide portion 14*b* of the cleaning frame 14. Therefore, in the state that the cartridge is mounted in the main assembly 100, the shutter 34 does not obstruct the movement of the residual toner connecting member 32 in the direction along a plane of cross-section (arrow N direction).

To the contrary, when the shutter 34 closes the discharge opening 32*d*, the residual toner connecting member 32 is locked to be not movable. The shutter 34 is a locking member for locking the residual toner connecting member 32 to prevent the movement in the direction of the arrow N, as well.

[Mounting Operation of the Cartridge to the Main Assembly]

Referring to FIGS. 4, 19, 20, 21 and 22, the description will be made as to the mounting of the process cartridge 7 to the main assembly 100.

(General Description of Mounting Operation)

FIG. 19 is a front view in the state that the front door 91 of the main assembly 100 is open. FIG. 20 is a sectional view illustrating a structure of a lower guide 94 of the cartridge. FIG. 21 is a schematic view illustrating a mounting process of the process cartridge 7 to the main assembly 100.

Referring to FIG. 19, the mounting operation of the process cartridge 7 to the main assembly of the image forming apparatus 100 will first be described. As shown in FIG. 19, the process cartridge 7 is mountable to and dismountable from the main assembly 100 in the direction of the arrow J.

As shown in FIG. 22, the residual toner transportation portion 40 is provided in the rear side with respect to the mounting direction of the process cartridge 7. The residual toner produced during the image forming operation is fed from the process cartridge 7 to the receiving opening (unshown) of the main assembly 100.

The process cartridge 7 is inserted in the direction of the arrow J after the front door 91 of the main assembly of the image forming apparatus 100 is opened. Thereafter, the process cartridge 7 is inserted in the direction of the arrow J to the extent that it abuts to the rear side plate (unshown) in the rear side of the main assembly, thus completing the inserting operation. Thereafter, the front door 91 of the main assembly 100 is closed, by which the process cartridge 7 is positioned in place in the main assembly. And, the residual toner connecting portion (unshown) is connected with the main assembly 100, by which the mounting operation is completed. The details of the mounting operation will be described step-by-step.

(Operation of Insertion in the Longitudinal Direction)

As shown in FIG. 21, the process cartridge 7 is provided with lower guides 7*a*, 7*b* to be guided by the main assembly 100 during the mounting operation at the opposite end portions with respect to the longitudinal direction of the cartridge. In addition, the process cartridge 7 is provided with upper guides 7*c*, 7*d* to be guided by the main assembly 100 during the mounting operation at the opposite end portions with respect to the longitudinal direction.

The main assembly 100 is provided with a front cover 92 (FIG. 19) for restricting the sectional area of the process cartridge 7 at the entrance. In a cartridge mounting portion 93 of the main assembly 100, there are provided a lower guide 94 for guiding the lower portion of the process cartridge 7 and an upper guide 95 for guiding the upper portion of the process cartridge 7.

Additionally, as shown in FIG. 20, the lower guide 94 is provided with pressing blocks 96 and 97 to press the process cartridge 7 substantially in the upward direction which is substantially perpendicular to the mounting direction. The pressing block 96, 97 are provided at each of the front side and the rear side with the respect to the mounting direction of the cartridge.

As shown in FIG. 20, the cartridge rides on the lower guide 94 in accordance with the movement of the cartridge toward the rear side in the mounting direction J. By this, the process cartridge 7 can be inserted without contact to the intermediary transfer belt 5 disposed in the upper side.

As shown in part (a) of FIG. 21, the process cartridge 7 is inserted into the cartridge mounting portion 93 while being guided by a lower guide 91*a* of the front door. The process cartridge 7 having moved to the mounting portion 93 is restricted in the position thereof by a rough mounting guide portion 92*a* of the front cover 92 shown in FIG. 19 in the plane perpendicular to the mounting direction.

By this, the process cartridge 7 is mounted to the cartridge mounting portion 93 with the regulated attitude in the direction along a plane perpendicular to the mounting direction. In addition, at the position where the process cartridge 7 passes by the front cover 92, the process cartridge 7 is sufficiently away from the intermediary transfer belt 5. Furthermore, when the process cartridge 7 enters the main assembly 100, the projecting configuration of the lower guide 7*a* is engaged with the recessed configuration of the lower guide 94 so that the cartridge is guided thereby.

(Riding Operation)

Then, the process cartridge 7 is guided so that the projecting configuration of the guide portion 7*c* is engaged with the recessed configuration of the upper guide 95, while being guided by the lower guide 7*a*. As shown in part (b) of FIG. 21, the process cartridge 7 moves in the direction of the arrow J on the lower guide 94 while being restricted by the lower guide 7*a* and the upper guide 7*c* in the directions perpendicular to the mounting direction.

The lower guide 94 rises upwardly in accordance with the insertion toward the rear side by the configuration of the lower guide 94. Therefore, the process cartridge 7 is inserted into the main assembly 100 while being raised by the engagement with the lower guide 94.

Then, the lower guide 7*a* rise on the inclined portion 94*a* of the lower guide 94 in the direction perpendicular to the mounting direction. Therefore, with the insertion of the process cartridge 7 in the mounting direction (arrow J direction), the lower guide 7*b* rides on the lower guide 91*a* of the front door. Thereafter, with the continuing insertion of the cartridge, the lower guide 7*b* rise on the lower guide 94 and the pressing block 96 in the order named, similarly to the lower guide 7*a*.

Referring to FIG. 22, the structure of the portion of the main assembly 100 abutted by the process cartridge 7 will be described.

FIG. 22 is a perspective view illustrating the structure of the rear side of the process cartridge 7 with respect to the mounting direction. As shown in FIG. 22, the process cartridge 7 is provided with a shaft 7*g* for positioning the process cartridge 7 relative to the main assembly 100 in the direction perpendicular to the mounting direction, the shaft 7*g* extending toward the rear side in the mounting direction. The process cartridge 7 is provided in the rear side with respect to the mounting direction with an upper guide abutting portion 7*e* and a vertical abutting portion 7*f* for limiting the position of the process cartridge 7 substantially in the vertical direction during the inserting operation. The process cartridge 7 is provided with a retention groove 7*h* for preventing disengagement of the process cartridge 7 from the main assembly 100. As shown in FIG. 22, the retention groove 7*h* is in the form of a recessed configuration provided in the rear side of the process cartridge with respect to the mounting direction.

The photosensitive drum 1 of the process cartridge 7 is provided with a coupling portion 1*c* as a drive inputting portion for receiving a driving force from the main assembly 100 in the rear side with respect to the mounting direction. Furthermore, the toner supplying roller 20 (FIG. 3) is provided with the coupling portion 57 as the input portion for receiving a driving force from the main assembly 100.

(Structure in the Neighborhood of the Abutting Portion)

Referring to FIG. 23, the structure in the neighborhood of the abutting portion of the main assembly 100 relative to the process cartridge 7 will be described. FIG. 23 is a perspective view illustrating the rear side structure of the main assembly 100, with respect to the mounting direction of the process cartridge 7. As shown in FIG. 23, the main assembly 100 is provided on the rear side plate 98 with an abutting portion 98*a* as a longitudinal abutting portion at the time of mounting the process cartridge 7.

The rear side plate 98 is provided with V-shaped groove portion 98*b* and a positioning elongate hole portion 98*c* for positioning the process cartridge 7 in the direction perpendicular to the mounting direction, and they are provided at an upper and lower parts, respectively. A drum drive input coupling 81 for inputting the driving force to the photosensitive drum 1 is provided in a rear side of the rear side plate 98 with respect to the mounting direction. The drum drive input coupling 81 is supported so as to be movable in the direction of the arrow J by the urging member (unshown). In addition, in the rear side of the main assembly 100 with respect to the mounting direction, there is provided a development drive input coupling 82 for inputting a driving force to the coupling portion 57. The development drive input coupling 82 receives the driving force from the driving source (unshown) of the main assembly 100 and rotates.

In addition, in the rear side of the main assembly 100 with respect to the mounting direction, there is provided a voltage application member 83 for applying a voltage to the process cartridge 7. Here, the voltage application member 83 includes an elastic member such as a compression coil spring extending in the direction opposite to the direction of the arrow J.

Furthermore, in the rear side of the main assembly 100, there is provided a recording contact 84 for recording in a chip 33 as the storing element of the process cartridge 7. The recording contact 84 includes elastic projected portions 84*a* and 84*b* projecting in the direction opposite to the mounting direction and is supported by the rear side plate 98 so as to be movable substantially in the vertical direction.

In addition, the upper guide 95 of the main assembly 100 is provided with an upper guiding rail abutting portion 95*a* for being abutted by the upper guide abutting portion 7*e* of the process cartridge 7 to support it. Moreover, the rear side plate 98 is provided with a limiting portion 98*d* for being contacted by the vertical abutting portion 7*f* of the process cartridge 7 to contact and support it.

In addition, the rear side plate 98 supports the arm 42 for engaging with the residual toner connecting member in a state in which it is rotatable within a predetermined angular range about the arm rotation axis 42*c*. That is, the arm rotation axis 42*c* of the arm 42 is supported at both ends thereof by arm support portions 98*e*, 98*f* (FIG. 26) of the rear side plate 98. The arm supporting portion 98*e* has the same shape as the arm supporting portion 98*f*. The arm 42 is supported and positioned in the rotational moving direction by the lower guide 94 using a link mechanism (unshown).

(Operation from Riding to Contacting to the Main Assembly)

With the mounting operation, the process cartridge 7 is inserted toward the rear side of the main assembly in the state that the upper guide 7*c* and the lower guides 7*a*, 7*b* are supported by the upper guide 95 and the lower guide 94, as shown in part (c) of FIG. 21.

The lower guide 7*a* of the process cartridge 7 rides on the tapered portion 97*a* of the pressing block 97 provided on the lower guide 94. At this time, the positioning shaft 7*j* of the process cartridge 7 has passed by the intermediary transfer belt 5 in the mounting direction. Therefore, the process cartridge 7 can be mounted to the main assembly 100 without the positioning shaft 7*j* extending upwardly contacting the intermediary transfer belt 5. In addition, at this time, the process cartridge 7 is supported at two positions, namely a front side portion by the lower guide 94 and a rear side portion where it is ridden. Therefore, as shown in part (d) of FIG. 21, the process cartridge 7 is being mounted with the rear side thereof lifted by slanting (approx. 0.6°), in the main assembly 100.

The process cartridge 7 riding on the pressing block 97 receives an upward urging force from the pressing block 97. By the process cartridge 7 being urged outwardly by the pressing block 97, the upper guide abutting portion 7*e* abuts to an abutting portion 95*a* of the upper guide 95.

Referring to FIGS. 21 and 24, the mounting state after the riding on the pressing block 97 will be described.

FIG. 24 is a schematic view illustrating the movement of the process cartridge 7 up to the completion of the insertion to the rear side of the main assembly. As shown in part (a) of FIG. 24, the process cartridge 7 is inserted in the state that the upper guide abutting portion 7*e* thereof is in abutment to the contact surface 95*a* of the upper guide 95. As shown in part (b) of FIG. 24, the process cartridge 7 moves until the vertical abutting portion 7*f* abutted to the upper part limiting portion 98*d* of the main assembly rear side plate 98.

Suppose that in the abutment state between the upper guide abutting portion 7*e* and the vertical abutting portion 7*f*, the process cartridge 7 is further moved to the rear side. In such a state, the vertical abutting portion 7*e* is disengaged from the abutting portion 95*a* of the upper guide 95. As shown in part (c) of FIG. 24, only the vertical abutting portion 7*f* move in contact with the upper part limiting portion 98*d*.

At this time, the upper guide abutting portion 7*e* enters a hole portion 95*b* provided in the rear side of the upper guide 95 with respect to the mounting direction, so that it is supported only in the direction perpendicular to the mounting direction (left-right direction). At this time, the shaft 7*g* of the process cartridge 7 is inserted into the elongate hole portion 98*c* of the rear side plate 98 of the main assembly 100.

Then, arm contact portions 32*f* and 32*g* which is a projected wall portion of the residual toner connecting member 32 is inserted below the contact portions 42*a*, 42*b* of the arm 42 supported by the rear side plate 98 (part (c) of FIG. 24).

The free ends of the contact portions 42*a*, 42*b* of the arm 42 is provided with tapers 42*e*, 42*f*, respectively, so that the arm contact portions 32*f*, 32*g* of the residual toner connecting member 32 are assuredly introduced. In the process of mounting of the process cartridge 7 and at the time of completion of the mounting thereof, the arm 42 and the residual toner connecting member 32 are spaced from each other.

When the process cartridge 7 is further inserted into the main assembly 100, the development coupling 37 starts to engage with the main assembly development input coupling 82. With further insertion, the vertical abutting portion 7*f* is disengaged from the abutting portion 98*d* and is raised upwardly by the urging force of the pressing block 97. Simultaneously, by the pressure of the pressing block 97, the shaft 7*j* of the positioning is brought into the abutment to V-shaped groove portion 98*b* in the upward direction.

Thereafter, the contact portion 7*i* (FIG. 22) of the process cartridge 7 abuts to the voltage application member 83 of elastic electroconductive material. In addition, the recording contact 84 of the main assembly 100 is brought into contact to the chip 33 as the storing element of the process cartridge 7.

Then, the drum coupling 1*c* of the process cartridge 7 contact to the drum input coupling 81 of the main assembly 100 to push it out in the direction of the arrow J against the force of the urging member (unshown) of the drum input coupling.

Thereafter, the longitudinal abutting portion 7*m* of the process cartridge 7 abut to the abutting portion 98*a* of the rear side plate 98 of the main assembly, by which the movement in the mounting direction is completed. In this state, the process cartridge 7 is urged by the pressing block 97 in the rear side with respect to the mounting direction, and the pressing portion 7*b* is on the pressing block 96 in the front side with respect to the mounting direction (part (d) of FIG. 21, and part (d) of FIG. 24).

As described in the foregoing, the lower guide 94 has such a configuration that with the insertion of the cartridge, it rises. Therefore, as shown in part (d) of FIG. 21, in the state of completion of insertion of the process cartridge 7 (abutted state), the process cartridge 7 is inclined with the rear side with respect to the mounting direction being higher (approx. 0.6°).

(Shutter Operation when Mounted)

Referring to FIGS. 18 and 24, the movement of the shutter 34 until the abutment of the process cartridge 7 will be described.

FIG. 18 is a schematic view illustrating the movement of the shutter 34 shutter 34 at the time of mounting to the main assembly. As shown in part (a) of FIG. 24, when the cartridge further moves in the state that the upper guide abutting portion 7*e* abuts to the abutting portion 95*a* of the upper guide 95, the shutter 34 passes above the shutter contact portion 43*a* of the main assembly 100 as shown in FIG. 18.

As shown in part (a) of FIG. 18, the lower portion of the shutter 34 is provided with a projected main assembly contact portion 34*c*. After the shutter 34 rides over the shutter contact portion 43*a*, the main assembly contact portion 34*c* is abutted by the shutter contact portion 43*a*. Then, with the further insertion of the process cartridge into the main assembly, the shutter 34 moves relatively in the direction opposite to the mounting direction in the process cartridge 7 against the urging force of the shutter urging member 36 provided in the cleaning frame. Furthermore, when the process cartridge 7 is inserted into the main assembly abutment position which will be described hereinafter, the residual toner discharging portion 32*d* is completely opened as shown in) FIG. 18, by which the relative movement in the process cartridge 7 is completed.

Here, by the main assembly contact portion 34*c* contacting the shutter contact portion 43*a*, the shutter 34 is moved toward the front side (arrow J) in the process cartridge 7 in accordance with the mounting operation to the main assembly 100. The main assembly contact portion 34*c* is disposed upstream of the residual toner discharge opening 32*d* with respect to the mounting direction. Therefore, when the shutter 34 starts to be moved by the shutter contact portion 43*a* in the process cartridge, the spring stopper 43 having the shutter contact portion 34 is present in a part of the region below the residual toner shutter 34.

Therefore, when the process cartridge 7 is mounted in the state that the residual toner is in the second feeding passageway 61, the removed toner flows through the residual toner discharge opening 32*d*, at the time of the shutter 34 starting to be apart from the discharge opening 32*d*. At this time, the residual toner falls downward to the spring stopper 43. The spring stopper 43 is provided with falling prevention wall 43*b* for preventing the residual toner having fallen down from entering the main assembly 100. By this, the scattering of the residual toner in the main assembly 100 is reduced.

(Front Door Opening and Closing and Cartridge Up and Down Movement)

Referring to FIG. 21, a mechanism of the rating in interrelation with the opening and closing of the front door 91 of the image forming apparatus will be described. The image forming apparatus is provided with a space for accommodating the cartridge. The user can access the space (accommodating portion) for accommodating the cartridge, by opening the front door 91 which is a part of the outer casing of the image forming apparatus.

When the front door 91 of the main assembly 100 is closed, the cartridge lower guide 94 is moved upwardly by a link mechanism (unshown) with the movement of the front door lower guide 91*a* (part (e) of FIG. 21).

Then, with the movement of the cartridge lower guide 94, the process cartridge 7 receives the upward urging force from the pressing blocks 96 and 97. In this manner, the urging force with which the rear side shaft 7*j* of the process cartridge 7 abuts to the V-shaped groove portion 98*b* which provides the abutment of the process cartridge 7 of the with respect to the direction perpendicular to the mounting direction. Furthermore, by the urging force provided by the pressing block 96 in the front side with respect to the mounting direction, the front side abutment shaft 7*k* is abutted to the V-shaped groove portion 99*a* which is the abutment of the front side plate 99 with respect to the direction perpendicular to the mounting direction (part (e) of FIG. 21).

In the above-described the manner, the process cartridge 7 is positioned relative to the main assembly 100 by the V-shaped groove portion 98*b*, the elongate hole portion 98*c* and the V-shaped groove portion 99*a* with respect to the direction perpendicular to the mounting direction. By further closing the main assembly front door 91, the link mechanism (unshown) move the drum drive input coupling 81 to the engageable position in the process cartridge 7 side.

When the drum drive input coupling 81 is rotated by the motor (unshown), a groove portion 81*a* of the drum drive input coupling 81 is connected with the coupling portion 1*c* of the photosensitive drum 1 in the rotational moving direction. By closing the main assembly front door 91, a cartridge retaining portion 46 provided in the rear side of the main assembly is raised by the link mechanism (unshown) (part (e) of FIG. 21).

The raising retaining portion 46 enters the groove configuration of the retaining portion 7*h* of the process cartridge 7. By this, the movement of the process cartridge 7 toward the front side with respect to the mounting direction is limited.

(Operation of Residual Toner Connecting Member)

Referring to FIG. 16, the movement of the residual toner connecting member at the time when the front door 91 of the main assembly 100 is closed will be described. FIG. 16 is a sectional view illustrating the operation of the residual toner connecting member in the opening and closing of the front door.

In the rear side of the image forming apparatus 100 with respect to the mounting direction, the arm 42 rotatable by the link mechanism (unshown) in interrelation with the main assembly front door 91 is provided. The residual toner connecting member 32 of the process cartridge 7 is provided with the arm contact portions 32*f*, 32*g* contactable to the arm of the main assembly 100, the arm contact portions 32*f*, 32*g* projecting in the direction perpendicular to the mounting direction. The arm contact portions 32*f*, 32*g* are disposed below the contact portions 42*a*, 42*b* in the state that the process cartridge 7 is in abutment to the rear side plate 98 of the main assembly 100.

When the process cartridge 7 abuts in the mounting direction, the contact portions 42*a*, 42*b* of the arm 42 are overlapped with the arm contact portions 32*f*, 32*g* of the residual toner connecting member 32 by approx. 4 mm in the mounting direction. The arm 42 is rotatable about an axis of the arm rotation shaft 42*c* rotatably supported by the supporting holes 98*e*, 98*f* of the rear side plate 98. With the closing operation of the front door of the main assembly 100, the arm 42 is rotated in the direction of the arrow M by approx. 42° about the axis of the arm rotation shaft 42*c* by a link mechanism (unshown) connected with the cartridge lower guide 94.

With the rotating operation of the arm 42, the arm 42 abuts to the arm contact surfaces 32*f*, 32*g* of the residual toner connecting member 32. The residual toner connecting member 32 is moved to a connecting position (first position) in the main assembly toner receiving opening 80*d* side (arrow N direction). In this embodiment, the residual toner connecting member 32 move in the direction of the arrow N by approx. 7.7 mm by the rotating operation of the arm 42. In this manner, the residual toner connecting member 32 pushed down by the arm 42 enters the residual toner receiving opening 80*d* of the main assembly 100 by approx. 4 mm.

As described hereinbefore, the residual toner connecting member 32 is urged substantially upwardly by the coupling spring 31. In this embodiment, the spring portion 31 as the urging member is a tension spring having a wire diameter of Φ0.3 mm and an outer diameter Φ5.1 mm, approximately. In the state of non-connection with the main assembly 100, the urging force is approx. 30 gf, and in the connected state with the main assembly residual toner receiving opening 80*d*, the urging force is approx. 70 gf. Therefore, the arm 42 receives the upward force of approx. 70 gf in the closed state of the main assembly front door 91.

[Driving Connection of the Residual Toner Discharging Portion]

Referring to FIGS. 1, 5, 7, 15 and 16, the driving connection of the residual toner discharging portion will be described. FIG. 1 is a perspective view illustrating a connecting method between the residual toner discharging portion 23*d* and the main assembly residual toner receiving opening 80*d*.

(Drive Connecting Operation)

The main assembly 100 is provided with the residual toner receiving opening 80*d* for receiving the discharged toner from the process cartridge 7.

The residual toner connecting portion 32 enters the apparatus main assembly. By this, the second coupling member 30 provided in the residual toner connecting portion 32 moves the vibration member 44 in the main assembly first feeding passageway 80*a* of the main assembly feeding portion 80 provided in the apparatus main assembly 100 downward (in the residual toner connecting opening penetrating direction, arrow N direction).

Here, the vibration member 44 abuts against the second coupling member 30 with an urging force. The abutted second coupling member 30 rotates in interrelation with the rotation of the photosensitive drum 1 so that the groove-shaped recess 30*h* of the second coupling member 30 abuts against the acted-on portion 44*b* of the vibration member 44. The recess 30*h* is a part of the acting portion for acting on the acted (portion to be acted on) portion 44*b*. As the surface of the recess 30*h* contacts the acted-on portion 44*b*, the vibration member 44 vibrates.

Referring to FIG. 15, FIG. 30, and FIG. 62, the operation at this time will be described in detail.

FIG. 15 is a perspective view illustrating the acting portion of the second coupling member 30.

Further, FIG. 30 is a schematic view illustrating movement of the second coupling member 30 and the vibration member 44.

FIG. 61 is a perspective view illustrating the shape of the vibration member 44. First, referring to FIG. 15, the acting portion of the second coupling member 30 will be described. The free end of the second coupling member 30 is in the form of an edge of an annular shape (ring shape), and this edge portion is an acting portion acting on the vibration member 44.

On the second coupling member 30, an abutment surface (a first acting portion, a first portion, an urging portion, a pressing portion, a projecting portion) 30*k* which is a flat portion in the direction of the discharge opening (direction of arrow N) are provided at two symmetrical positions on the axis 301 of the cylinder portion. This abutment surface 30*k* is a portion (first portion, first acting part) of the acting portion. The abutment surface 30*k* applies a force so as to press the vibration member 44, so that the vibration member 44 is deformed to contract in a direction away from the second coupling member 30.

In addition, two recesses (depressions) 30*h* are provided at symmetrical positions of the axis 301 of the cylinder portion so as to cut away the abutment surface 30*k*. The recess 30*h* has a V-shaped recess shape formed by the inclined surface portion 30*i* and the reverse inclined surface portion 30*j* which are two inclined surface portions, and is recessed from the free end of the second coupling member 30.

At the deepest portion of the V-shaped portion of the recess 30*h*, two spring-loaded grooves 30*c* for engaging with the spring portion 31 are provided at symmetrical positions of the axis 301 of the cylinder portion at two positions, respectively.

Next, referring to FIG. 30, an acting (vibration transmission) method to the vibration member 44 by the second coupling member 30 will be described.

As described in the foregoing, the residual toner connecting portion 32 is inserted into the main assembly receiving opening 80*d* so that the second coupling member 30 is moved to a position where it can act on the vibration member 44 of the apparatus main assembly 100. The abutment surface 30*k* of the second coupling member 30 or a portion of the recess 30*h* that has moved to the operable position abuts against the acted-on portion 44*b* of the vibration member 44 in the direction of the arrow N. At this time, the vibration member 44 abuts against the second coupling member 30 by its own spring pressure due to intrusion of the second coupling member 30 in the arrow N direction.

Part (a) of FIG. 30 shows a state in which the acted-on portion 44*b* is in contact with the abutment surface 30*k*, as an example at the time of mounting. As described above, the second coupling member 30 rotates in the direction of the arrow T around the axis 61*a* in interrelation with the rotation of the photosensitive drum 1.

When the second coupling member 30 rotates in the direction of the arrow T, the acted-on portion 44*b* of the vibration member 44 abuts against the inclined surface portion (inclined portion) 30*i* of the groove-shaped recess 30*h* with its own spring pressure (part (b) of FIG. 30).

At this time, as previously mentioned, the recess 30*h* is a groove portion (recess) provided at positions symmetrical with respect to the axis 301 of the second coupling member 30. For this reason, as shown in part (b) of FIG. 30, the acted-on portion 44*b* is in contact with two inclined surface portions 30*i* arranged at symmetrical positions with respect to the axis 301 at the same time.

For this reason, with the rotation of the second coupling member 30, the acted-on portion 44*b* moves in the direction opposite to the arrow N by the spring pressure of the vibration member 44, without great tilting.

Furthermore, by rotating the second coupling member 30 in the direction of the arrow T, the acted-on portion 44*b* enters the recess 30*h*. The acted-on portion 44*b* moves along the inclined surface portion 30*i* to the bottom of the recess 30*h* by its own spring pressure.

At the point of contact, by its own spring pressure, to the bottom of the V portion formed by the two inclined surface portions (30*i*, 30*j*), it is in the state that it moves most in the direction opposite to the arrow N (part (c) of FIG. 30) By further rotating the second coupling member 30, the acted-on portion 44*b* abuts on the reverse inclined portion 30*j* with the spring pressure of the vibration member 44 (part (d) of FIG. 30), and thereafter it abuts against the abutment surface 30*k*, and the movement in the direction of the arrow N ends Part (a) of FIG. 30) is completed. That is, it is in the state of being depressed most in the arrow N direction.

By repeating the above-described operation, the acted-on portion 44*b* abuts against the second coupling member 30 by the spring pressure of the vibration member 44 so as to make a reciprocating motion (vibration) in the direction of arrow N. In this manner, the vibration member 44 vibrates in the direction of the arrow N by the rotation of the second coupling member 30 in the direction of arrow T.

Here, the abutment surface 30*k* is also disposed at positions symmetrical to each other with respect to the axis 301. That is, the free end (working portion) of the second coupling member 30 has a symmetrical shape with respect to the axis 301. Therefore, when the acted-on portion 44*b* is in contact with the free end (working portion) of the second coupling member 30, both ends of the acted-on portion 44*b* simultaneously contact portions of the same shape of the acting portion. For example, when one end of the acted-on portion 44*b* is in contact with the abutment surface 30*k*, the other end of the acted-on portion 44*b* is also in contact with the abutment surface 30*k*. The same is true when the acted-on portion 44*b* contacts with the inclined surface portion 30*i* and the inclined portion 30*j*.

Here, when the acted-on portion 44*b* enters into the recess 30*h*, the acted-on portion 44*b* moves along the inclined surface portion 30*i* and the inclined surface portion 30*j*. Therefore, the movement of the vibration member 44 is smooth. In particular, the reverse inclined surface portion 30*j* suppresses the vibration member 44 from tilting down due to the acted-on portion 44*b* being caught in the recess 30*h*. That is, by providing the reverse inclined portion 30*j*, the acted-on portion 44*b* can be pulled smoothly out of the recess 30*h* along the reverse inclined portion 30*j* and can move to the abutment surface 30*k*.

The structure of the second coupling member 30 will be further described.

The free end of the second coupling member 30 acts on the vibration member 44. The planar portion (abutment surface 30*k*) of the free end of the second coupling member 30 is the first portion (first acting portion) of the acting portion. And, the recess 30*h* depressed from the abutment surface 30*k* constitutes the second portion (second action portion) of the acting portion.

That is, the free end (connecting portion) of the second coupling member 30 has a first portion (abutment surface 30*k*) and a second portion (the recess 30*h*) arranged at different positions in the axial direction. The recess 30*h* (the second portion of the acting part) is on the inner side (the rear end side) than the abutment surface 30*k* (the first portion of the acting part), in the axial direction of the second coupling member 30. In other words, the abutment surface 30*k* (the first portion of the acting portion) is located on an outer side (the free end side) than the recess 30*h* (the second portion of the acting portion) in the axial direction of the second coupling member 30.

The inclined surface portion 30*i* and the reverse inclined surface portion 30*j* are portions which form the second portion (recess 30*h*) of the acting portion, respectively. At the same time, the inclined surface portion 30*i* and the reverse inclined surface portion 30*j* can also be said to be a connecting portion (boundary portion) for connecting the second portion (recess 30*h*) of the acting portion with the first portion (abutment surface 30*k*) of the acting portion.

That is, as a portion of the bottom side of the recess 30*h* is specifically defined as the second portion of the acting portion, a portion from the second portion (the bottom side of the recess 30*h*) of the action portion to the first portion (the abutment surface 30*k*) of the acting portion is connected by the inclined surface portion 30*i* or the reverse inclined portion 30*j*. The inclined surface portion 30*i* and the reverse inclined surface portion 30*j* are inclined surface portions inclined with respect to the axial direction of the second coupling member 30. The inclined surface portion (the inclined surface portion 30*i* and the reverse inclined surface portion 30*j*) is a portion for forming the second portion (the recess 30*h*) of the acting portion, and at the same time, it is also a connecting portion for connecting the second portion (the portion on the bottom side of the recess 30*h*) of the acting portion to a portion (abutment surface 30*k*). The inclined portion (the slanted surface portion 30*i* and the reverse inclined surface portion 30*j*) is also the boundary portion between the second portion (the bottom side portion of the recess 30*h*) and the first portion (the abutment surface 30*k*) of the acting portion.

Here, at the deepest portion of the recess 30*h*, a spring-loaded groove 30*c* for engaging with the coupling spring is formed. However, the spring-loaded groove 30*c* does not act on the vibration member 44, and therefore, it is unnecessary for the recess 30*h* to be provided with the spring-loaded groove 30*c*. For example, the coupling spring may be mounted to a portion different from the recess 30*h*.

Here, the above-described second coupling member 30 vibrates the vibration member 44 without tilting. However, it is also possible to vibrate by causing the second coupling member 30 to tilt the vibration member 44 to tilt. Such a structure will be described hereinafter, referring to FIG. 60.

Here, referring to FIG. 61, the shape of the vibration member 44 will be described. The vibration member 44 is provided with a loosening portion 44*c* extending for the purpose of loosening the residual toner in the spring portion 44*a* adjacent to the acted-on portion 44*b*.

As shown in FIG. 13, it is preferable that loosening portion 44*c* is disposed in the neighborhood of the feeding connecting portion 80*f* which is a connecting portion between the first feeding passageway 80*a* and the second feeding passageway 80*b*. As described in the foregoing, the acted-on portion 44*b* vibrates in the direction of the arrow N, so that the loosening portion 44*c* integrally formed vibrates in the arrow N direction. The loosening portion 44*c* vibrates in the direction of the arrow N, thereby scraping off the toner that has entered the inside of the spring portion 44*a*.

Thus, clogging of the residual toner at the feeding connecting portion 80*f* is suppressed and the residual toner can be stably discharged from the main assembly first feeding passageway 80*a* to the main assembly second feeding passageway 80*b*.

That is, the vibration member 44 is a stirring member (a feeding member, a loosening member) which conveys the toner to the main assembly feeding screw 85 by stirring (loosening) the toner. The vibration member 44 is also a moving member and an elastic member for performing vibration, that is, reciprocating movement by being elastically deformed. The vibration member 44 is also a member to be subjected to action from the second coupling member 30.

In addition, the second coupling member 30 is a driving member that is driven to rotate by receiving the rotational force from the first coupling member 29, and at the same time, an acting member (vibration imparting member) that acts on the vibration member 44 to vibrate, In addition, the second coupling member 30 is also a force transmitting member (a driving force transmitting member, a force applying member, a pressing member) that applies a force (driving force) to the vibration member 44 to elastically deform.

Here, in this embodiment, the acting portion of the second coupling member 30 has the recess 30*h* including the groove shape (recessed shape), but the acting portion is not limited to such a structure.

For example, also in the structure including two projections 230*m* as shown in FIG. 62 at positions symmetrical to each other with respect to the axis 2301, it is possible to vibrate the vibration member 44 in the vertical direction as by the recess 30*h*.

The projection 230*m* is a projection projecting from the free end of the second coupling member 230. The free end side of the projection 230*m* constitutes the first portion (first acting portion) of the acting portion. The area (planar abutment surface) of the free end (edge) of the second coupling member 30 where the projection 230*m* is not formed corresponds to the second portion (second action portion) of the acting portion. The first portion (the free end of the projection 230*m*) is arranged closer to the free end side of the second coupling member 230 than the second portion (abutting surface).

In addition, in order to connect the first portion and the second portion with each other, the inclined surface portion is disposed on each of both end sides of the projection 230*m*.

In addition, as shown in FIG. 41, one projection (projection) 130*m* may be provided at the free end of the second coupling member 130. In the second coupling member 130, the free end side of the projecting portion 130*m* corresponds to the first portion (first acting portion) of the acting portion. In addition, a region (abutment surface 130*k*) where the projection 130*m* is not formed in the free end of the second coupling member 130 corresponds to the second portion (second acting part).

The projection 130*m* which is the first portion of the acting portion is disposed closer to the free end side of the second cup member 130 than the abutment surface 130*k* which is the second portion. In addition, an inclined surface portion (inclined portion) 130*n* is provided on the downstream side of the projection 130 in the rotational direction of the second coupling member 130. As described above, the acting portion produces a force for pushing the loosened portion 44*b* of the vibration member 44 in the lateral direction. For this reason, the vibration member 44 can be vibrated so as to tilt the vibration member 44 in a direction perpendicular to the vertical direction (the direction of the arrow N).

Referring to FIG. 60, the specific movement will be explained. FIG. 60 is a schematic view illustrating a method of applying the second coupling member 130 to the vibration member 44 (vibration transmission).

As in the above-described structure, by the residual toner connecting portion 32 being inserted into the main assembly receiving opening 80*d*, the second coupling member 130 is moved to a position where it can act on the vibration member 44 of the apparatus main assembly 100.

A portion of the abutment surface 130*k* or the projection 130*m* of the second coupling member 130 which has moved to the operable position abuts against the acted-on portion 44*b* of the vibration member 44 in the direction of the arrow N. At this time, the vibration member 44 comes into a state where it abuts against the second coupling member 130 due to its own spring pressure as the second coupling member 130 intrudes in the direction of the arrow N.

Part (a) of FIG. 60 shows an example at the time of mounting, in which the acted-on portion 44*b* is in contact with the abutment surface 130*k*. Similarly to the second coupling member 30 described above, the second coupling member 130 rotates in the direction of the arrow T about the axis 61*a* in interrelation with the rotation of the photosensitive drum 1.

When the second coupling member 130 rotates in the direction of arrow T, the acted-on portion 44*b* of the vibration member 44 abuts against the inclined surface portion 130*n* of the acted-upon portion 130*m* with its own spring pressure.

Here, as explained referring to FIG. 30 and the like, the aforementioned second coupling member 30 has the recesses 30*h* of the same shape at positions symmetrical to each other with respect to the axis 301. For this reason, the acted-on portion 44*b* is pushed down at the same time, at two places symmetrical with respect to the arrow N direction with respect to the axis 301. Furthermore, the acted-on portion 44*b* receives a force in the direction perpendicular to the axis 301 (in the left-right direction in FIG. 30) when it is brought into abutment with the inclined surface portions 30*i*, 30*j*, but it has a symmetrical slope at the symmetrical position of the axis 301, and therefore, the forces in the left-right direction in FIG. 30 is canceled by each other. In this manner, the acted-on portion 44*b* of the vibration member 44 moves (vibrates) in the direction of the arrow N.

On the other hand, as shown in FIG. 41, the projection (first acting portion) 130*m* of the second coupling member 130 is provided only on one portion on the abutment surface 130*k*. For this reason, the acted-on portion 44*b* of the vibration member 44 tilts in a direction crossing with the axis 61*a* (substantially perpendicular direction, left-right direction) by a force by which it is brought into contact with the inclined surface portion 130*n* by its own spring pressure (part (b) of FIG. 61).

Furthermore, the acted-on portion 44*b* of the vibration member 44 is brought into a state where it is maximally tilted by the inclined surface portion 130*n* as the second coupling member 130 rotates in the arrow T direction (part (c) of FIG. 61). Furthermore, due to the rotation of the second coupling member 130 in the direction of arrow T, the acted-on portion 44*b* is released from the abutment to the projecting portion 130*m* and again abuts to the abutment surface 130*k* (part (d) of FIG. 60).

By repeating the above-described operation, the vibration member 44 vibrates inclining with respect to the axial direction of the second coupling member 130. That is, the acted-on portion 44*b* of the vibration member 44 vibrates in a direction intersecting with the axial direction (the left and right direction in the drawing, the direction substantially perpendicular to the axis of the second coupling member 130). Here, the vibration member 44 tilts along the inclined surface portion 130*n*, and therefore, the vibration of the vibration member 44 is performed smoothly.

As shown in FIG. 61, as with the structure described above, the vibration member 44 is provided with a loosening portion 44*c* extending for the purpose of loosening the residual toner, adjacent to the acted-on portion 44*b* inside the spring portion 44*a*.

As shown in FIG. 13, it is preferable that the loosening portion 44*c* is provided in the neighborhood of the feeding connecting portion 80*f* which is the connecting portion between the first feeding passageway 80*a* and the second feeding passageway 80*b*.

As described in the foregoing, the acted-on portion 44*b* vibrates in a direction perpendicular to the arrow N (left and right direction in FIG. 60) the loosening portion 44*c* formed integrally vibrates, so that the toner entering into the spring portion 44*a* is scraped and scraped. In this manner, clogging of the residual toner at the feeding connecting portion 80*f* shown in FIG. 13 is suppressed so that it is possible to stably discharge the residual toner from the main assembly first feeding passageway 80*a* to the main assembly second feeding passageway 80*b*. With the above-described structure, the vibration member 44 vibrates within the feeding passageway 80*a* of the apparatus main assembly 100.

The residual toner loosened by the vibration member 44 and discharged to the second feeding passageway 80*b* is fed in the direction of arrow R by receiving the feeding force of the main assembly feeding screw 85. And, the residual toner is fed to and collected in the residual toner box 86.

With the above-described structure, the residual toner feeding is performed while the clogging of the residual toner portion is suppressed.

As shown in FIG. 7, the moving direction of the residual toner connecting portion 32 toward the main assembly residual toner receiving opening 80*d* is indicated by the arrow N which is opposite to the riding direction at the time of mounting of the process cartridge 7 to the main assembly. With such a structure, the process cartridge 7 is prevented from shifting in the direction perpendicular to the mounting direction.

FIG. 7 is a schematic view as seen from the rear side of the main assembly 100, illustrating a movement range of the process cartridge 7 in the direction perpendicular to the mounting direction and in the moving direction of the residual toner connecting member 32. As shown in FIG. 7, the riding direction of the process cartridge 7 is perpendicular to the mounting direction, and therefore, a passage in the main assembly 100 is large enough to avoid the interference.

Therefore, the space for permitting the movement of the residual toner connecting member 32 in the riding direction can be easily assured. On the hand, with respect to the direction perpendicular to the riding direction in the plane perpendicular to the mounting direction, there are adjacent process cartridges 7, and therefore, it is difficult to move the residual toner connecting member 32. For this reason, it is desirable to move the residual toner connecting portion 32 in the riding direction of the process cartridge 7, from the standpoint of downsizing of the entirety of the main assembly 100.

In this embodiment, the residual toner connecting portion 32 is moved in the riding direction of the process cartridge 7 (the direction perpendicular to the mounting direction of the cartridge).

Referring to FIGS. 25, 26, 27 and 28, the description will be made as to the opening and closing operation interrelating mechanism of the arm 42 with the front door 91. FIG. 25 is a schematic view illustrating the interrelated movement between the arm 42 and the front door 91. Part (a) of FIG. 25 shows the state when the front door is open, and part (b) of FIG. 25 shows the state when the front door is closed.

FIG. 26 is a perspective view illustrating a supporting structure for the front door link part provided in the rear side of the main assembly with respect to the mounting direction. FIG. 27 is a perspective view illustrating the supporting structure for the front door link part provided in the rear side of the main assembly with respect to the mounting direction, and seen in another direction. FIG. 28 is a perspective view illustrating the supporting structure for the front door link part provided in the rear side of the main assembly with respect to the mounting direction, when the front door is open.

As shown in FIG. 26, the rotation shafts 42*c* of the arm 42 is rotatably supported by the arm supporting holes 98*e*, 98*f* of the rear side plate 98 at a constant angle.

The rear side plate 98 is provided with an engaging hole 98*g* for supporting an engagement shaft 48*a* of the link rotating member 48. The rear side plate 98 is provided with a supporting member 39 for supporting the engagement shaft 48*a* of the rink rotating member 48 and, the supporting member 39 being mounted to the rear side plate 98 using a screw or the like. The supporting member 39 is provided with an engaging hole 39*c* for supporting an engagement shaft 48*b* of the rink rotating member 48.

The engagement shafts 48*a* and 48*b* of the rink rotating member 48 are rotatably supported by the engaging hole 98*g* and the engaging hole 39*c*. As shown in FIG. 28, in the front side of the main assembly 100 with respect to the mounting direction, there are provided a rotation shaft 49 rotatable in interrelation with the front door 91 and a supporting member 54 engaged with and movable with the rotation shaft 49. The supporting member 54 is engaged with the rotation shaft 49 in the engaging portion 54*a*, and is supported so as to be rotatable in the same direction. The engagement shafts 94*c*, 94*d* of the cartridge lower guide 94 are rotatably supported by the engaging holes 48*c*, 48*d* of the rotatable member 48 in the rear side with respect to the mounting direction. In the front side with respect to the mounting direction, the engagement shaft 94*e* is supported by an engaging hole 54*b* of the supporting member 54.

In addition, the rotatable member 48 is provided with a lever engaging hole 48*e* which engages with and supports the supporting portion engagement shaft 38*c* of the arm link lever 38. The arm link lever 38 has elasticity in the bending direction. In addition, the deformation of the arm link lever 38 in the extending direction is small, although the information in the pending direction is possible. As shown in FIG. 25, the arm link lever 38 penetrates a through-hole portion 98*h* of the rear side plate 98 while an end thereof is supported by the rotatable member 48, and is mounted to the second rear side plate 51 while the movement in the mounting direction by the limiting portion 38*d* is limited.

As shown in part (a) of FIG. 25, an arm engagement shaft 42*g* of the arm 42 is engaged with a hole portion 38*a* of the arm link lever 38 and is positioned in the rotational moving direction (arrow M direction) of the rotation shaft or rotational axis 42*c*.

(Link Mechanism in Interrelation with Front Door)

Referring to part (b) of FIG. 25, the closed state to the front door 91 will be described.

By rotating the front door 91 in a direction indicated by an arrow AB by approx. 90°, the rotation shaft 49 interrelated with the front door 91 is rotated by 90° in the direction of the arrow AB. By the rotation of the rotation shaft 49, the supporting member 54 engaged with the rotation shaft 49 is rotated integrally about the axis of the rotation shaft 49 in the direction of the arrow AB. By the rotation of the supporting portion 54, the engagement shaft 94*e* of the cartridge lower guide 94 engaged with the supporting portion 54 is moved in a direction indicated by an arrow AC (toward the upper right side in the Figure. With this movement, a rear side engagement shaft 94*c* of the cartridge lower guide 94 supported by the rink rotating member 48 is also moved in the direction of the arrow AC about the engaging portion 48*a* of the rink rotating member 48. Therefore, the entirety of the lower guide moves in the direction of the arrow AC. The rink rotating member 48 having rotated with the movement of the cartridge lower guide 94 in the direction of the arrow AC pushes the arm link lever 38 supported by the engaging holes 48*b*, 48*c* in the direction of an arrow AD (part (a) of FIG. 25). The arm link lever 38 pushed in the direction of the arrow AD is moved in the direction of the arrow AD by the engaging hole portion 38*a* engaged with the arm engagement shaft 42*g* of the arm 42. By the arm engaging portion 42*g* being pushed up, the arm 42 is rotated in the direction of the arrow M by approx. 42°. In this manner, the arm 42 rotates the arm 42 in interrelation with the opening and closing of the front door 91.

With the above-described structure, the moving direction of the hole portion 38*a* of the arm link lever 38 is perpendicular to the axis of the arm rotation shaft or rotational axis 42*c* of the arm 42. Therefore, the hole portion 38*a* can stably receive the rotational motion of the arm caused by the movement of the arm link lever 38. Furthermore, the movement of the arm link lever 38 is perpendicular to the rotation shaft 48*a* of the rink rotating member 48. Therefore, it can receive the movement of the rotation shaft 48*a* of the rink rotating member 48 in the rotational moving direction.

In addition, the rink rotating member 48 is provided by the movement of the cartridge lower guide 94 in the direction of the arrow AC. With the above-described structure, it is desirable that the rotational axis direction of the arm 42 is perpendicular to the moving direction of the cartridge lower guide 94 indicated by the arrow AC. To accomplish this, the moving direction of the cartridge lower guide 94 and the moving direction of the residual toner connecting member 32 of the process cartridge 7 are substantially the same.

Furthermore, the cartridge lower guide 94 urges the process cartridge 7 in the direction indicated by the arrow AD by a pressing block (unshown). Here, the urging direction to the process cartridge 7 from the main assembly 100 is substantially the same as the moving direction of the residual toner connecting member 32. Therefore, the residual toner connecting member 32 can be stably moved. When the toner is used up, the process cartridge 7 is removed from the main assembly 100 so as to be exchanged.

The residual toner connecting member 32 is rotated in interrelation with the closing operation of the front door 91 by the arm 42, so that it is pushed down (part (b) of FIG. 16). The position to which it is pushed down by the arm is called connecting position (first position). When the main assembly front door 91 is opened for the purpose of removing the process cartridge 7, the arm portion 42 is rotated in the direction indicated by an arrow P (part (b) of FIG. 25) in interrelation with the movement of the front door. As shown in part (c) of FIG. 16, the arm 42 rotated in the direction of the arrow P is contacted by a second contact portion 32*h* of the residual toner connecting member 32 and the push-up portion 42*d*, so that the residual toner connecting member 32 is pushed up to an upper non-connecting position (retracted position, second position). Thereafter, the residual toner connecting member 32 and the push-up portion 42*d* of the arm 42 are disengaged, and the residual toner connecting member 32 receives the urging force of the coupling spring 31 through the second coupling member 30 to move upward. Thereafter, the residual toner connecting member 32 is raised to the retracted position (non-connecting position, second position). The unconnected position (second position) is located closer to the axis of the photosensitive drum 1 than the coupling position (first position). The line connecting the connecting position and the retracted position crosses with the cartridge mounting direction.

The cartridge lower guide 94 interrelated with the main assembly front door moves down in interrelation with the main assembly front door 91. At this time, as described hereinbefore, the process cartridge 7 is inclined by approx. 0.6 degree with the rear side with respect to the inserting direction taking an upper position.

Thereafter, it is supported in the order opposite to that in the case of the mounting, and is taken out of the main assembly 100. With the above-described the structure of the residual toner discharging portion 40 with respect to the longitudinal direction and in the direction perpendicular thereto, the discharge opening connecting portion does not project out of the process cartridge process cartridge, thus accomplishing downsizing. In addition, also when the residual toner discharge opening and the main assembly discharging container are in the separate position from each other, the residual toner can be discharged without toner clogging.

Furthermore, the vibration member 44 is vibrated by the process cartridge 724, the residual toner is loosened in the toner feeding passageway inside the apparatus main assembly so that clogging is prevented. For this reason, within the apparatus main assembly 100 including a long life relative to the process cartridge 7 which is an exchange product, eliminate the action (vibration transmission) at the position where toner exists reduction of scraping due to vibration transmission which should occur due to influence of toner intervention, the residual toner can be stably conveyed.

The structure of this embodiment is summarized in the following.

As shown in FIG. 3, the cartridge 7 of the embodiment includes the photosensitive drum 1 and the cleaning member (cleaning blade 6) for removing the toner from the photosensitive drum 1.

As shown in FIG. 4, the toner remove the by the cleaning blade 6 is fed in the first feeding passageway 51 by the feeding screw 26 which is the cartridge side feeding member into the second feeding passageway 61.

As shown in FIG. 1 and FIG. 11, the cartridge 7 is provided with the connecting member 32. The connecting member 32 is provided with the residual toner discharging portion (discharge opening) 32*d*. The connecting member 32 is a movable connecting portion for connecting the discharge opening 32*d* to the toner receiving opening 80*d* provided in the main assembly.

That is, as shown in part (a) of FIG. 1, in the free state of the cartridge 7 (no external force is applied to the cartridge 7), the connecting member 32 is in the non-connecting position not connecting with the toner receiving opening 80*d*. On the other hand, when the moving force receiving portion (arm contact portions 32*f*, 32*g*)) of the connecting member 32 receives the force from the arm 42 of the main assembly, the connecting member 32 is moved to the connecting position shown in part (b) of FIG. 1. As a result, the discharge opening 32*d* is connected with the toner receiving opening 80*d*.

As will be evident from parts (a) and (b) of FIG. 1, the connecting member 32 deforms the toner discharging passageway (second feeding passageway 61) by moving. That is, by the movement of the connecting member 32, the toner discharging passageway is expanded and contracted. By the connecting member 32 moving to the connecting position, the discharging passageway is expanded (part (b) of FIG. 1), and by the connecting member 32 moving to the non-connecting position, the discharging passageway is contracted (part (a) of FIG. 1).

In addition, as shown in as shown in FIG. 1, the second coupling member 30 is provided in the terminal end side of the toner discharging passageway (second feeding passageway 61).

The second coupling member 30 is a member that transmits vibration from the inside of the cartridge 7 to the outside. That is, the second coupling member 30 transmits vibration to the vibration member 44 (FIG. 13) which is a member to be operated (driven member, loosening member) provided in the image forming apparatus.

Here, the second coupling member 30 moves as the connecting member 32 moves. That is, when the connecting member 32 is in the connected position (part (b) of FIG. 1), the second coupling member 30 moves to the first position (transmission position, connection position), by the force received by the arm contact portions 32*f*, 32*g* from the arm 42 of the main portion assembly, as shown in part (b) of FIG. 7. The second coupling member 30 in this first position acts on the vibration member 44 to vibrate the vibration member 44.

On the other hand, when the arm contact portions 32*f*, 32*g* does not receive the force, the second coupling member 30 (in the free state) is retracted to the second position (non-transmitting position, non-connecting position, retracted position, part (a) of FIG. 1). At this time, the second coupling member is no longer connected with the vibration member 44.

The second coupling member 30 is disposed adjacent to the toner discharge opening 32*d* (FIG. 1). The words "adjacent to the discharge opening 32*d*" means the range in which the second coupling 30 is capable of connecting with the vibration member 44 when it is moved from the second position to the first position. That is, the vibration member 44 disposed adjacent to the toner receiving opening connected with the toner discharge opening. It will suffice if the second coupling member 30 is disposed at a position engageable with the vibration member 44.

In this embodiment, at least a part of the second coupling member is disposed in the toner discharging passageway defined by the second feeding passageway 61 and the connecting member 32, when it is in the second position.

The second coupling member 30 is urged toward the second position by the urging member (coupling spring 31, FIG. 9). Therefore, the second coupling member 30 is moved to the first position against the force of the coupling spring 31 only when the arm contact portions 32*f*, 32*g* receive the force from the arm 42 of the main assembly.

The second coupling member 30 is movable relative to the photosensitive drum 1 or the feeding screw 26. In other words, the second coupling member 30 is moved away from the axis of the photosensitive drum 1 (the distance from the axis increases) by moving from the second position to the first position. Similarly, the second coupling member 30 moves away from the axis of the feeding screw 26 (the distance from the axis increases) by moving from the second position to the first position.

The direction of the movement of the second coupling member 30 between the first position and the second position crosses with the axial directions of the photosensitive drum 1 and the feeding screw 26 (arrows I, N directions in FIG. 7).

More particularly, in this embodiment, the second coupling member 30 moves in the direction substantially perpendicular to the axial direction.

In other words, the second coupling member 30 moves along the axial direction of the second coupling member 30 per se (center line 61*a*, FIG. 7). That is, the second coupling member 30 moves so as to displace in the axial direction of the second coupling member 30.

In addition, the moving direction of the coupling member 30 crosses with the mounting direction of the cartridge 7 to the main assembly (inserting direction, arrow J direction in FIG. 6). In this embodiment, the coupling member 30 moves in the direction substantially perpendicular to the mounting direction. Therefore, in the process of mounting the cartridge 7 to the main assembly, the second coupling member 30 is capable of retracting to the position (second position) where it does not interfere with the main assembly. On the other hand, after the completion of mounting of the cartridge 7, the second coupling member 30 can move to the first position where it is capable of connecting with the main assembly side feeding member of the main assembly.

Here, the second coupling member 30 is on the flow path of the toner, and therefore, there is a possibility that the movement mechanism and the vibration transmission mechanism of the second coupling member 30 are affected by the elapse of time by the toner. However, the second coupling member 30 is provided in the cartridge 7, and therefore, with the replacement of the cartridge 7, the second coupling member 30 is also replaced with a fresh one. Therefore, even if the second coupling member 30 is temporarily affected by the toner, the second coupling member 30 may be used within the service life of the cartridge 7, and therefore, it is relatively easy to ensure the necessary durability for that purpose.

The second coupling member 30 can stably move between the first position and the second position and can transmit the vibration from the second coupling member 30 to the vibration member 44, from the beginning to the end of the use of cartridge 7.

In other words, as shown in FIG. 1, the second coupling member 30 moves in the direction along the second feeding passageway 61 (the direction along the moving direction of the toner passing through the second feeding passageway 61).

In addition, as shown in FIG. 12, the driving force (rotational force) received by the coupling portion 1*c* from the image forming apparatus main assembly is transmitted to the second coupling member 30 by way of the photosensitive drum 1 and the feeding screw 26. Therefore, the second coupling member 30 rotates, in interrelation with the photosensitive drum 1 and the feeding screw 26.

The second coupling member 30 has two recesses 30*h*. The two recesses 30*h* are arranged symmetrically with respect to the axis (rotation axis) of the second coupling member 30. Each of the recesses 30*h* has inclined surfaces 30*i*, 30*j*. The second coupling member 30 has two abutment surfaces (force application surface, first action portion, first portion) 30*k* arranged to be sandwiched between the two recesses 30*h*.

The bottom (the second acting portion, the first portion) of the recess 30*h* in the axial direction of the second coupling member 30 is recessed more toward the rear end side of the second coupling member 30 than toward the abutment surface (force application surface) 30*k*. In other words, the abutment surface 30*k* is arranged on the free end side (the outside in the axial direction) of the second coupling member 30 with respect to the recess 30*h*.

Instead of forming the recess 30*h* as the second acting portion (second portion) on the abutment surface, a projection (projection 230*m*) may be formed on the abutting surface (FIG. 62). According to the structure disclosed in FIG. 62, the leading end side of the projection 230*m* corresponds to the first acting portion (first portion), and the abutting surface corresponds to the second acting portion. That is, the projection 230*m* forming the first acting portion is arranged on the free end side of the second coupling member 230 as compared with the abutment surface as the second acting portion.

When the second coupling member 30 is rotationally driven in a state of being in contact with the vibration member 44, the strength of the force applied from the second coupling member 30 to the vibration member 44 periodically changes, so that the vibration member 44 elastically deforms periodically. That is, when the abutment surface 30*k* of the second coupling member 30 contacts the vibration member 44, the force applied to the vibration member 44 increases and the vibration member 44 elastically deforms greatly. As a result, the vibration member 44 contracts toward the back side (inner side) of the receiving opening 80*d*. On the other hand, when the vibration member 44 enters the recess 30*h* of the second coupling member 30, the force applied to the vibration member 44 is reduced and portion of the elastic deformation of the vibration member 44 is eliminated. That is, by reducing the degree of elastic deformation of the vibration member 44, the vibration member 44 is expanded toward the outside of the receiving opening 80*d*. Here, by deepening the recess 30*h*, it is also possible to prevent the recess 30*h* from coming into contact with the vibration member 44 when the vibration member 44 enters the recess 30*h*.

By vibration member 44 repeating extension and contraction, each time the second coupling member 30 rotates by 180°, the vibration member 44 reciprocates once. That is, the second coupling member 30 has two recesses 30*h* and two abutting surfaces 30*k*, and therefore, the vibration member 44 vibrates at a cycle of half of the rotation cycle of the second coupling member 30. Here, even if the second coupling member 30 rotates, the vibration member 44 itself does not rotate.

The recess 30*h* of the second coupling member 30 has two inclined portions (inclined surface 30*i*, reverse inclined surface portion 30*j*) inclined with respect to the axial direction of the second coupling member 30, and they are inclined in different directions. And, the vibration member 44 can contract along the inclined surface 30*i* and extend along the reverse inclined surface portion 30*j* (FIG. 30). By this, the vibration (reciprocating movement) of the vibration member 44 is made smooth. The inclined portions (30*i*, 30*j*) are connecting portions (connecting portions) connecting the first acting portion (abutment surface 30*k*) and the second acting portion (the depressed portion 30*h*).

The inclined surface 30*i* as the first inclined surface portion connects the upstream side of the abutment surface 30*k* and the downstream side of the recess 30*h* with each other, in the direction of rotation of the second coupling member 30. The inclined surface 30*i* is inclined so as to head toward the front end side of the second coupling member 30 as going toward the downstream side in the rotational direction of the second coupling member 30.

On the other hand, the reverse inclined surface portion 30*j* as the second inclined portion connects the upstream side of the recess 30*h* and the downstream side of the abutment surface 30*k*. The reverse inclined surface portion 30*j* is inclined so as to head toward the front end side of the second coupling member 30 as going toward the upstream side in the rotational direction of the second coupling member 30.

The first inclined portion and the second inclined portion face the free end side of the second coupling member 30.

Here, in the second coupling member 30, the inclined portions (30*i*, 30*j*) are provided in the recess 30*h*, but the inclined portion may be formed on a projecting portion. For example, in FIG. 62, both side surfaces of the projection 230*m* corresponding to the first action portion (first portion) are inclined portions. That is, the projection 230*m* is connected to the abutment surface by the inclined portion.

Also, the boundary between the first acting portion and the second acting portion is not necessarily an inclined portion. In the structure shown in FIG. 60, the side surface on the downstream side of the first acting portion (projection 130*m*) is a surface substantially parallel to the axial direction of the second coupling member 30. That is, the upstream side of the projection 130*m* (the first acting portion) and the downstream side of the abutment surface 130*k* (the second acting portion) are not connected by the inclined portion.

Here, in this embodiment, the cartridge 7 has developing means (developing roller) for developing the latent images on the photosensitive member and the photosensitive member. However, the structure of the cartridge 7 is not limited to this.

For example, FIG. 63 shows a modification in which the cartridge 7 is divided into two. The cleaning unit 13 including the photosensitive member and the developing unit 4 including the developing roller are independently mounted on the apparatus main assembly as a cartridge 1013 and a cartridge 1014, in this example. In this case, the second coupling member 30, the residual toner connecting portion 32 and the like are provided in the cartridge 1013 including the photosensitive drum.

Embodiment 2

A second embodiment will be described about a structure of a shutter.

The structure of the shutter and the opening and closing operation of the shutter are similar to those of Embodiment 1. Referring to FIGS. 31, 32 and 33, the description will be made as to the structure of a seal of the shutter.

As shown in part (a) of FIG. 31 and FIG. 32, the shutter 134 is provided with a hole 134*e* at the position opposed to the residual toner discharging portion (discharge opening) 32*d* in the state in which the shutter 134 closes the residual toner discharging portion 32*d* of the residual toner connecting member 32.

The shutter 134 is provided with an elastic sealing member (sealing member) 35, similarly to Embodiment 1. The elastic sealing member 35 is the seal portion for sealing the discharge opening 32*d* by contacting to the discharge opening 32*d* when the shutter 134 is closed.

A combination of the elastic sealing member 35 and the shutter 134 may be called a shutter member (openable member) as the case may be. In such a case, the shutter 134 is called seal supporting portion for supporting the elastic sealing member 35.

The hole 134*e* is an opening or a cut-away portion formed in the shutter 134. The hole 134*e* is a non-contact portion by which the shutter 134 does not contact the elastic sealing member 35.

The elastic sealing member 35 has elasticity, and therefore, is deformable. When the shutter 134 is closed, the elastic sealing member 35 is sandwiched between the edge of the discharge opening 32*d* and the shutter 134, by which it is deformed. Thus, the elastic sealing member 35 is closely contacted to the edge of the discharge opening 32*d* while being compressed by the shutter 134, and therefore, the leakage of the toner from the discharge opening 32*d* can be assuredly suppressed.

On the other hand, because the elastic sealing member 35 contact and the edge of the discharge opening 32*d* while being compressed, a certain frictional force is produced between the elastic sealing member 35 and the discharge opening 32*d*. Correspondingly to the frictional force, the force required for opening and closing the shutter 134 becomes large.

Under the circumstances, the shutter 134 is provided with the hole 134*e*, by which when the shutter 134 is opened and closed, the frictional force produced between the elastic sealing member 35 and the edge of the discharge opening 32*d* can be reduced by the amount corresponding to the area of the hole 134*e*.

The elastic sealing member 35 is not pressed by the shutter 134 in the area opposed to the hole 134*e*. Therefore, even when the elastic sealing member 35 is compressed by a certain amount by being sandwiched between the edge of the discharge opening 32*d* and the shutter 134, a repelling force of the elastic sealing member 35 is reduced in the area where the hole 134*e* is provided.

As a result, in the area where the hole 134*e* is provided, the frictional force is small even when the elastic sealing member 35 contact the edge of the discharge opening 32*d*. Thus, the force (load) required for opening and closing the shutter 134 is reduced, and therefore, the shutter 134 can be opened and closed by a relatively lighter force. For this reason, the load of the user to mount the cartridge is reduced, and the force of the urging member (spring or the like) required for closing the shutter 134 can be reduced.

Referring to FIG. 33, the state in which the shutter 134 closes the residual toner discharging portion (discharge opening) 32*d* (moves in the direction of an arrow Q) will be described.

Part (a) of FIG. 33 illustrates the state in which the shutter 134 closes the residual toner discharging portion 32*d*. Part (b) of FIG. 33 illustrates a state in which the shutter 134 passes the residual toner discharging portion 32*d*. Part (c) of FIG. 33 shows the state in which the shutter 134 closes the residual toner discharging portion 32*d*.

As described hereinbefore, the shutter 134 is provided with the hole 134*e*, which is covered with the elastic sealing member 35.

As shown in part (b) of FIG. 33, in the process of the movement of the shutter 134 in the direction of the arrow Q, the hole 134*e* passes by the residual toner discharging portion 32*d*. At this time, the edge (broken line portion) of the residual toner discharging portion (discharge opening) 32*d* is the area comprising the elastic sealing member 35.

On the other hand, in the area of the hole 134*e* of the shutter 134, the repelling force of the elastic sealing member 35 is relatively smaller. When the hole 134*e* of the shutter 34 passes by the residual toner discharging portion 32*d*, the frictional force between the elastic sealing member 35 and the edge of the residual toner discharging portion 32*d* reduces. As a result, the load for closing the shutter 134 can be reduced. In addition, also when the shutter 134 is moved from the close position to the open position, the same effects can be provided. By the structure, the opening and closing of the shutter 134 is smooth, thus assuring the stability of the opening and closing operation.

The hole 134*e* is smaller than the size of the residual toner discharging portion 32*d*, and the hole 134*e* is placed so as to be inside the residual toner discharging portion 32*d*.

That is, as the residual toner discharge opening 32*d* is projected onto the shutter 134 in the state that the shutter 134 is closed, the entirety of the hole 134*e* is within the projection area of the discharge opening 32. In the state that the shutter 134 is closed, the hole 134*e* does not overlap the projection area of the residual toner discharging portion 32*d*.

Therefore, in the state that the shutter 134 is closed, the close-contactness between the elastic sealing member 35 and the residual toner discharging portion (discharge opening) 32*d* can be assured, and therefore, the sealing property of the elastic sealing member 35 can be assured. That is, when the shutter 134 is closed, the hole 134*e* is not disposed in the area of the edge of the residual toner discharging portion 32*d*. In the area of the residual toner discharging portion 32*d* provided, the elastic sealing member 35 is pressed by the shutter 134. In other words, the elastic sealing member 35 is pressed against the edge of the residual toner discharging portion 32*d* by the shutter 134 closely contact the edge of the residual toner discharging portion 32*d*.

As described hereinbefore, the frictional force between the elastic sealing member 35 and the edge of the residual toner discharging portion 32*d* is decreased during the movement of the shutter 134, and the close-contactness between the elastic sealing member 35 and the edge of the residual toner discharging portion 32*d* is assured when the shutter 134 is closed. In this embodiment, the opening and closing operation property of the shutter can be improved, while assuring the sealing property.

In addition, in the case of the positional relation of the same size as the hole 134*e*, the similar effects can be provided by replacing the hole 134*e* with a recess 134*f* (as shown in part (b) of FIG. 31) on the shutter 134. The recess 134*f* is recessed in the direction away from the sealing member 35. In part (b) of FIG. 31, a gap (space, clearance) is provided between the recess 134*f* and the elastic sealing member 35. However, the present invention is not limited to the structure of the recess 134*f*, a certain degree of the effects can be provided even if the elastic sealing member 35 contacts to the bottom of the recess 134*f*. That is, a certain degree of the effects of the smoothness in the opening and closing of the shutter 134, if the contact pressure between the shutter 134 and the elastic sealing member 35 is reduced in the portion where the recess 134*f* is provided.

In summary, when the hole 134*e* or the recess 134*f* is provided in the shutter 134, the force received by the sealing member 35 from the shutter 134 is reduced in the area where they are provided. When the shutter 134 is opened and closed, the frictional force between the sealing member 35 and the edge of the residual toner discharging portion 32*d* is reduced in the area where the hole 134*e* or the recess 134*f*. As a result, the shutter 134 can be smoothly opened and closed. The hole 134*e* and the recess 134*f* are low pressure portions when the contact pressure between the sealing member 35 and the shutter 134 is lower than the other area.

Embodiment 3

In this embodiment, the structures are similar to the structures of the foregoing embodiments, and therefore, the description will be made as to the portions different from them. The materials, shapes and so on are similar to those of the foregoing embodiments unless otherwise stated particularly. The description will be omitted about such portions.

Referring to FIGS. 34, 35 and 36, Embodiment 3 of the present invention will be described. FIG. 34 is a schematic view illustrating motion of the shutter 234 in the mounting to the main assembly, and FIG. 35 is a perspective view illustrating a positional relationship between the shutter and the residual toner connecting member. FIG. 36 is a schematic view illustrating a positional relationship between the residual toner connecting member 232 and the shutter 234.

As shown in FIG. 34, the residual toner connecting member 232 is provided with a wall portion 232*m* in the form of a projection at the position downstream of the discharge opening 232*d* with respect to the process cartridge mounting direction (arrow J direction). In other words, the wall portion 232*m* is provided at the position downstream of the discharge opening 232*d* with respect to the closing direction of the shutter 234. When the shutter 234 is closed, the free end (abutting portion 234*d*) of the shutter 234 contacts the wall portion 232*m*.

The wall portion 232*m* is a projection (projected portion, cover portion) projecting that in a direction crossing with the shutter 234 closing direction of the shutter 234. More particularly, the wall portion 232*m* projects toward the downstream side with respect to the toner discharging direction through the discharge opening 232*d*.

In addition, the wall portion 232*m* is provided downstream of the main assembly contact portion (urged portion) 234*c* with respect to the direction of the arrow J (process cartridge mounting direction, shutter (234) closing direction).

The residual toner connecting member 232 is provided with an abutting portion 232*e* on a side surface of the wall portion 232*m* adjacent to the discharge opening 232*d*. The downstream side surface of the shutter 234 with respect to the direction of the arrow J (process cartridge mounting direction, shutter closing direction) is provided with a discharge opening abutting portion 234*d*. As shown in FIG. 35, the shutter 234 is urged in the mounting direction (arrow J direction) of the process cartridge by an urging member 36 provided on the cleaning frame 14. By this, in the state before the process cartridge is mounted to the main assembly, the discharge opening abutting portion 234*d* of the shutter 234 is abutted to the abutting portion 232*e* of the residual toner connecting member 232, as shown in part (a) of FIG. 34. By this, in the state in which the discharge opening 232*d* is closed, the position of the shutter 234 is determined.

FIG. 36 is a side view of the residual toner connecting member 232 as seen from the downstream side with respect to the opening direction of the shutter 234 (direction of arrow BA in FIG. 35). As shown in FIG. 36, the wall portion 232*m* of the residual toner connecting member 232 is disposed so as to overlap with a part of the shutter 234 in an area BB. More particularly, as the shutter 234 is projected onto the wall portion 232*m* in the closing direction of the shutter 234, at least a part (BB) of the projection area of the shutter 234 overlaps with at least a part of the wall portion 232*m*.

In other words, as wall portion 232*m* is seen in the opening direction of the shutter 234, the wall portion 232*m* is overlapped with at least a part of the shutter 234 in the opening direction. That is, as the wall portion 232*m* is seen in the opening direction of the shutter 234, the wall portion 232*m* covers at least a part of the shutter 234.

By placing the wall portion 232*m* relative to the shutter 234, the shutter 234 is prevented from being touched by the user handling the process cartridge. That is, when the user pushes the shutter 234 in the opening direction, the users hand contacts the wall portion 232*m* before contacting the shutter 234. Therefore, inadvertent opening of the shutter 234 is suppressed, thus reducing the residual toner discharging through the discharge opening 232*d*.

Namely, the wall portion (projection, projection, cover portion) 232*m* is a malfunction limiting portion suppressing the malfunction of the shutter 234. The configuration of the malfunction limiting portion is not limited to the wall configuration. For example, in place of the wall portion, a plurality of rod-like projections (projections) are usable. That is, the configuration of the malfunction limiting portion may be selected from various configurations if the unintended movement of the shutter 234 by the user can be suppressed.

However, the malfunction limiting portion in the form of a projection (wall portion) having a wall configuration as in this embodiment is advantageous as follows. More particularly, if the malfunction limiting portion includes the wall portion 232*m*, the movement of the toner which may scatter due to the closing of the shutter 234 (wind pressure, vibration or the like) may be locked by the wall portion 232*m*. That is, the wall portion 232*m* is effective to suppress scattering of the toner around the discharge opening when the shutter 234 is closed.

In order to suppress the scattering of the toner, the area BB (area of the shutter 234 covered by the malfunction limiting portion, FIG. 36) desirably has a certain width (a dimension in the longitudinal direction). For example, it is desirable that the width of the area BB is larger than the width of the discharge opening 232*d*.

Referring to FIGS. 37, 38 and 39, the configuration of a connecting portion between the process cartridge 7 and the main assembly 100 will be described.

FIG. 37 is an outer appearance illustrating a structure of the main assembly in this embodiment.

FIG. 38 is a sectional view illustrating the engagement between the cartridge and the main assembly in this embodiment.

FIG. 39 is an illustration of insertion mounting of the process cartridge.

As shown in FIG. 38, the residual toner connecting portion 232 of this embodiment is provided with the wall portion 232*m* as described above. As shown in FIG. 37, the receiving opening 280*d* of the main assembly is provided with a slit portion 280*g* for accepting the wall portion 232*m* in the mounting operation of the cartridge. In addition, the main assembly residual toner receiving opening 280*d* is provided with main assembly receiving opening sealing member 247 to cover the main assembly residual toner receiving opening 280*d*.

As shown in FIG. 37, adjacent to the main assembly receiving opening sealing member 247, there is provided a vertical sealing member 248 extending substantially perpendicularly to the main assembly receiving opening sealing member 247.

The main assembly receiving opening sealing member 247 and the vertical sealing member 248 are flexible sealing members mounted on a spring stopper 243 by double coated tapes or the like.

As shown in FIGS. 37 and 38, the first feeding passageway 280*a* of the main assembly 100 is provided with the vibration member 44, similarly to Embodiments 1.

Referring to FIG. 39, the mounting of the process cartridge 7 to the main assembly 100 and the connection of the connecting portion will be described.

As shown in FIG. 39, the process cartridge 7 is inserted into the main assembly 100 in the direction indicated by an arrow J. Similarly to Embodiment 1, below the shutter 234, there is provided a main assembly contact portion 234*c* in the form of a projection. In addition, the spring stopper 243 is provided with a shutter contact portion 243*a* in the form of a projection engaged with the main assembly contact portion 234*c*, the shutter contact portion 243*a* projecting in the direction opposite to the direction of the arrow J.

When the process cartridge 7 is mounted in the direction of the arrow J, the abutting portion 234*d* of the shutter 234 rides over the shutter contact portion 243*a*. Thereafter, when the process cartridge 7 is further inserted into the main assembly 100, the main assembly contact portion 234*c* contacts to the shutter contact portion 243*a*. Thereafter, the shutter 234 is moved relative to the process cartridge 7 in the direction opposite to the mounting direction (arrow J direction) against the urging force of the shutter urging member 36 (unshown) (similarly to Embodiment 1) provided in the cleaning frame, with the advancement of the process cartridge. In addition, when the process cartridge 7 is moved to the main assembly abutment position (part (b) of FIG. 39), the residual toner discharging portion 232*d* is completely released, thus completing the relative movement in the process cartridge 7.

Here, in the mounting to the main assembly 100, the shutter 234 is moved in the direction opposite to the mounting direction (arrow J direction) in the process cartridge 7, by the contact of the main assembly contact portion 234*c* to the shutter contact portion 243*a*. The main assembly contact portion 234*c* is disposed upstream of the residual toner discharge opening 232*d* with respect to the mounting direction. Therefore, when the shutter 234 starts to be moved by the shutter contact portion 243*a* in the process cartridge, the spring stopper 243 having the shutter contact portion 234 is present in part of the region below the residual toner shutter 234.

Therefore, if the process cartridge 7 is mounted in the state that the residual toner exists in the residual toner connecting portion 232, the shutter 234 starts to disengage from the residual toner discharge opening 232*d*, and therefore, the removed toner flows out through the discharge opening 232*d*. At this time, the residual toner falls downward to the spring stopper 243. The spring stopper 243 is provided with vertical sealing member 248 extending in the falling direction to prevent falling of the residual toner into the main assembly 100.

In the insertion of the process cartridge 7, the residual toner connecting portion 232 is in contact with the vertical sealing member 248 of the main assembly 100. As described hereinbefore, the vertical sealing member 248 is elastic, so that the residual toner connecting portion 232 is being inserted while deforming the vertical sealing member 248. Therefore, the wall (vertical sealing member 248) for limiting the falling direction of the residual toner can be placed close to the residual toner discharge opening 232*d*, and therefore, the falling of the residual toner into the main assembly 100 outside of the spring stopper 243 in the main assembly is suppressed. By this, the scattering of the residual toner in the main assembly 100 is reduced.

Thereafter, similarly to Embodiment 1, by closing the front door (unshown) of the main assembly 100, the residual toner connecting portion 232 of the process cartridge 7 is inserted into the main assembly residual toner receiving opening 280*d* in the direction indicated by a arrow N by an arm 42 (unshown) (part (c) of FIG. 39).

As described hereinbefore, the main assembly residual toner receiving opening 280*d* is provided with the slit portion 280*g*.

The slit portion 280*g* is provided at the position where the wall 232*m* of the residual toner connecting portion 232 is inserted at the time when the residual toner connecting portion 232 is connected with the receiving opening 280*d* of the main assembly.

Therefore, the wall portion 232*m* of the residual toner connecting portion 232 can be connected with the interference with the main assembly residual toner receiving opening 280*d*.

Referring to FIG. 40, the description will be made as to a supporting structure for the vibration member 44, and a configuration of the slit portion 280*g* of the main assembly residual toner receiving opening 280*d*. FIG. 40 shows an outer appearance of the main assembly residual toner receiving opening 280*d* with which the main assembly receiving sealing member 247 and the longitudinal seal 248 have been removed from the spring stopper 243.

Similarly to Embodiment 1, the elastic vibration member 44 in the first main assembly feeding passageway 280*a* is supported by abutting to the limiting surface 243*c* of the spring stopper 243 at the spring portion 44*a*, in the direction of the arrow N.

As shown in FIG. 40 the spring contact portion 243*c* is provided in a part of the circumference of the spring portion 44*a* with the slit portion 280*g* for accepting the wall portion 232*m*.

Therefore, the slit portion 280*g* is formed by cutting a part of the limiting surface 243*c* away to uncover a part of the vibration member 44 in a diametrical direction. Therefore, the limiting surface 243*c* cannot cover the entire inner circumference of the spring portion 44*a* of the vibration member 44.

However, the limiting surface 243*c* is large enough to cover the spring portion 44*a* in the radial direction. In this embodiment, the outer diameter of the spring is Φ15.3 mm, and the limiting surface 480*h* has Φ10 mm.

Therefore, tilting of the vibration member 44 in the engaging operation, and the disengagement from the limiting surface 243*c* are prevented. The size of the limiting surface 243*c* is dependent on the wire diameter, the outer diameter and the number of windings and the spring pressure of the spring, but it will suffice if the range of the movement of the vibration member 44 is limited.

Referring to FIG. 38, a driving connection structure between the process cartridge 7 and the main assembly 100 at the residual toner connecting portion will be described.

As described hereinbefore, the residual toner connecting portion 232 is moved in the direction of the arrow N to be inserted into the receiving opening 280*d* of the main assembly 100. The wall portion 232*m* of the residual toner connecting portion 232 is inserted into the main assembly residual toner receiving opening 280*d*.

At this time, the vibration member 44 of the main assembly 100 is abutted by the first coupling member 230 of the residual toner connecting member 232 with an urging force. The abutted first coupling member 229 is rotated in interrelation with the rotation of the photosensitive drum 1, similarly to Embodiment 1. By this, as in Embodiment 1, the vibration member 44 vibrates.

Here, the vibration member 44 is constituted by a compression spring including a wire diameter of 0.6 mm and an inner diameter of 12.3 mm. The vibration member 44 has an urging force of about 33 gf in a state that it is in abutment to the spring retainer 243 (coupling disconnected state) and about 50 gf in the connected state of the second coupling member 230.

With the above-described structure, the driving force is transmitted from the process cartridge 7 to the apparatus main assembly 100.

Here, the length measured in the axial direction (261*a*) of the acted-on portion 44*b* is made longer than the distance 1 from the free end portion 232*n* of the wall portion 232*m* to the recess 30*h*.

For this reason, in a state in which the residual toner connecting portion 232 is connected to the receiving opening 280*d*, the spring portion 44*a* of the vibration member 44 does not interfere with the wall portion 232*m*.

In this embodiment, the distance 1 is 3.25 mm, and a height of the engaging portion of the second coupling member 230 is approx. 4.7 mm.

By this, the interference between the residual toner connecting portion 232 and the wall portion 232*m* can be avoided while assuring the engagement amount relative to the second coupling member 230.

With this structure as described in the foregoing, a stabilized drive connection with the main assembly can be provided by the structure including the residual toner connecting portion 232 according to Embodiment 3.

Embodiment 4

In this embodiment, the structures are similar to the structures of the foregoing Embodiment 1, and therefore, the description will be made as to the portions different from Embodiment 1. The materials, shapes and so on are similar to those of the foregoing Embodiment 1 unless otherwise stated particularly. The description will be omitted about such portions.

Referring to FIGS. 12, 23 and 42, the structure of the drive transmission of this embodiment will be described.

FIG. 42 is a schematic view illustrating the drive transmission from the feeding screw to the first coupling in this embodiment.

As shown in FIG. 42, the photosensitive drum 401 is provided at one end portion thereof with a coupling portion 401*c* for receiving a driving force from the main assembly 100. The other end thereof is provided with a photosensitive drum gear 401*b* for transmitting the driving force to the residual toner feeding screw 426, as will be described hereinafter.

Similarly to Embodiment 1, the drum bearing 27L rotatably supports the idler gear 52 and the feeding screw gear 53 at one axial end of the photosensitive drum 401 (FIG. 12).

The feeding screw gear 53 is engaged with the feeding screw 26, for driving force transmission. The rotational force is transmitted from a main assembly drum input coupling 81 (FIG. 23) of the image forming apparatus 100 to the coupling portion 401*c* at one end of the cleaning unit 13. The transmitted to the rotational driving force is transmitted from the photosensitive drum 401 to the feeding screw 426 by the sequential engagement of the photosensitive drum gear 401*b*, the idler gear 52 and the feeding screw gear 53. The residual toner accommodated in the residual toner accommodation chamber 14*a* is fed in the direction of the arrow H by the feeding screw portion 426*a* by the rotation of the feeding screw 426 in the direction of the arrow G.

At the downstream side end portion of the feeding screw 426 with respect to the residual toner feeding direction, the reverse screw portion 426*e* is provided. In addition, the reverse screw portion 426*e* is provided with a blade 426*g* (drive transmission is not effected). In this embodiment, the feeding screw 426 receives the driving force by the rotation of the photosensitive drum 401. However, the same effects can be provided by the structure in which the feeding screw 426 is driven in interrelation with the rotation of the supply roller 17 as in Embodiment 1, for example.

Furthermore, as shown in FIG. 42, adjacent to the coupling portion 401*c* of the photosensitive drum 401, there is provided a second photosensitive drum gear 401*d*. A drum bearing 27R (unshown) supports a coupling idler gear 402 so as to be rotatable about an axis 402*c*. The coupling idler gear 402 is provided with a drum idler gear 402*a* at a position capable of driving force transmission with the second photosensitive drum gear 401*d*, and a warm gear 402*b* coaxial with the axis 402*c* of the drum idler gear 402*a*.

The coupling idler gear 402 is supported so as to be rotatable about axis 402*c*, by the drum bearing 27R (unshown).

Similarly to Embodiment 1, adjacent to the reverse screw portion 426*e* of the feeding screw 426, a first coupling member 429 is provided so as to be rotatable about an axis 461*a*.

A supporting method for the first coupling member 429 is similar to that in Embodiment 1, and therefore, the description thereof is omitted.

The first coupling member 429 is provided with a gear portion 429*g* at the outer periphery of the supporting portion 429*d*. The gear portion 429*g* is provided at the position suitable to be engaged with the warm gear 402*b* of the coupling idler gear 402, for driving connection.

The first coupling member 429 is a drive transmitting portion for transmitting the driving force from the photosensitive drum 401 to the second coupling member. Similarly, the coupling idler gear 402 is a drive transmitting portion for transmitting the driving force (rotational force) from the photosensitive drum 401 to the second coupling member.

In this embodiment, the drive transmitting portion is constituted by two members, namely first coupling member 429 and the coupling idler gear 402. However, it may be constituted by three or more members, or by one member. At least one of the drive transmitting portions is provided outside the toner discharging passageway. For example, the structure may be such that a part of the drive transmitting portion (first coupling member 429) is provided in the toner feeding passageway, and the other portion (coupling idler gear 402) is outside the toner feeding passageway.

When the rotational force is transmitted from the main assembly drum input coupling 81 (FIG. 23) of the image forming apparatus 100 to the coupling 401*c* at one end of the cleaning unit 13, the second photosensitive drum gear 401*d* rotates with the rotation of the photosensitive drum 401. The driving force is transmitted from the second photosensitive drum gear 401*d* to the drum idler gear 402*a* of the coupling idler gear 402, so that the coaxial warm gear 402*b* rotates. The rotation of the warm gear 402*b* is transmitted to the gear portion 429*g* of the first coupling member 429, so that the first coupling member 429 rotates about the axis 461*a*.

With the above-described structure, the first coupling member 429 can transmit the driving force to the main assembly without receiving the driving force from the feeding screw 426.

By the structure, a feeding amount of the feeding screw 426 can be adjusted finely because it is unnecessary to engage the feeding screw 426 with the first coupling member 429.

That is, the reverse screw portion 426*e* can be freely adjusted for the desired residual toner feeding performance.

In this embodiment, the warm gear 402 is used for the drive transmission from the photosensitive drum 401 to the first coupling member 429, but the structure is not limiting to the present invention.

For example, a drive transmission method using a bevel gear, a drive transmission method using a drive transmission belt or the like can be employed with the similar effects.

Embodiment 5

In this embodiment, the structures are similar to the structures of the hello-described Embodiment 3, and therefore, the description will be made as to the portions different from Embodiment 1. The materials, shapes and so on are similar to those of Embodiment 3 unless otherwise stated particularly. The description will be omitted about such portions.

Referring to FIGS. 43 and 44, the structure of this embodiment will be described.

FIG. 43 is an exploded view illustrating of parts of a residual toner connecting portion in this embodiment, and FIG. 44 is a sectional view illustrating of parts of the residual toner connecting portion in this embodiment.

As shown in FIG. 43, the residual toner connecting portion 532 used in this embodiment supports, similarly to Embodiment 1, the second coupling member 30 by the supporting portion 532*a* of the residual toner connecting portion 532 so as to be rotatable about an axis 61*a*. Similarly to Embodiment 1, the second coupling member 30 is mounted beyond the supporting portion 532*a* of the residual toner connecting portion 532 by deforming the compression claw 30*e*. At this time, in this embodiment, the second coupling member 30 is supported by a projection receiving portion 532*j* of the residual toner connecting portion 532 at the projection 30*d* in the direction of the weight (substantially arrow N direction) so as not to fall (FIG. 44).

That is, as shown in FIG. 44, the second coupling member 30 it is supported by the projection receiving portion 532*j* by the projection 30*d* in the direction of the weight direction (arrow N direction), and that in the opposite direction (opposite to the direction of the arrow N), the compression claw 30*e* is supported by the supporting portion 532*a*. The second coupling member 30 is movable between the supporting portion 532*a* of the residual toner connecting portion 532 and the projection receiving portion 532*j* within a range of play.

The compression spring 531 is fitted in the cylindrical portion 528*a* of the coupling receptor 528 and is supported while being compressed in the direction of the arrow N between the spring receiving portion 528*i* and the spring receiving portion 532*b* of the residual toner connecting portion 532. Adjacent to the free end of the cylindrical portion 528*a* of the coupling receptor 528 (free end with respect to the direction of the arrow N), a claw portion 528*g* for engagement with the residual toner connecting portion 532 is provided. In addition, the residual toner connecting portion 532 is provided with a recessed groove portion 532*i* in a part of the neighborhood of the spring receiving portion 532*b*.

The residual toner connecting portion 532 is supported by the coupling receptor 528 in the direction of the arrow N by engagement with the claw portion 528*g* of the coupling receptor 528 and the groove portion 532*i* in the state that it receives an urging force of the compression spring 531 in the direction of the arrow N.

Referring to FIGS. 43, 44 and 45, the movement of the residual toner connecting portion 532 at the time of mounting the process cartridge 7 to the main assembly 100 will be described. FIG. 45 illustrates a cartridge mounting to show the connecting method between the residual toner connecting portion 532 and the main assembly 100.

As shown in FIG. 43, the residual toner connecting portion 532 is provided with a movement rib 532*f* for engagement with the main assembly 100 to move the residual toner connecting portion in the direction opposite to the arrow N. The movement rib 532*f* is provided at the opposite end portions with respect to a direction of an arrow J with a taper 532*g* for mounting and a taper 532*h* for dismounting.

As shown in FIG. 45, a spring stopper 543 of the main assembly 100 is provided with an engagement wall 543*d* for engagement with the movement rib 532*f* to move the residual toner connecting portion 532 in the direction opposite to the arrow N in the mounting of the process cartridge 7. In addition, the engagement wall 543*d* is provided at opposite end portions with respect to the cartridge mounting direction (arrow J direction) with an engagement taper 543*e* for the mounting and an engagement taper 543*f* for the dismounting.

As shown in part (a) of FIG. 45, when the process cartridge 7 is mounted in the direction of the arrow J, the mounting taper 532*g* of the residual toner connecting portion 523 abuts to the mounting engagement taper 543*e* of the spring stopper 543.

When the process cartridge 7 is further inserted into the main assembly J, the mounting taper 532*g* rides on the mounting engagement taper 543*e* of the spring stopper 543 to move in the direction opposite to the arrow N against the urging force of the compression spring 531 (part (b) of FIG. 45).

When the process cartridge is further inserted in the direction of the arrow J, the dismounting taper of the residual toner connecting portion 532 starts to engage with the dismounting engagement taper 543*f*, by which it moves in the direction of the arrow N by the urging force of the compression spring 531.

When the process cartridge is further inserted in the direction of the arrow J, the residual toner connecting portion 532 lowers to the original position (the same position as shown in part (a) of FIG. 45 in the arrow N direction), by which the mounting is completed (part (c) of FIG. 45).

At this time, as will be described hereinafter, the second coupling member 30 is placed at a position capable of engaging with a vibration member 44 of the main assembly 100.

When the process cartridge 7 is dismounted from the main assembly 100 (moved in the direction opposite to the arrow J), the residual toner connecting portion 532 is moved in the order opposite to that described above.

The description will be made as to a vibration transmission method from the process cartridge 7 to the main assembly 100.

As described in the foregoing, by mounting the process cartridge 7 in the direction of the arrow J, the residual toner connecting member 532 enters the residual toner receiving opening 80*d*. Similarly to Embodiment 3, by this entering, the residual toner connecting member 532 compresses the vibration member 44 in the direction of the arrow N against the reaction force of the vibration member 44.

In addition, the vibration member 44 abuts to the second coupling member 30 in the residual toner connecting member 532 with an urging force. Similarly to Embodiment 1, the second coupling member 30 rotates in interrelation with the rotation of the photosensitive drum 1. By this, as in Embodiment 1, the recess 30*h* and the abutment portion 30*k* of the second coupling member 30 are brought into abutment with the acted-on portion 44*b* of the vibration member 44 alternately, so that the vibration member 44 vibrates in the direction of the arrow N.

Here, the vibration member 44 is constituted by a compression spring including a wire diameter of 0.6 mm and an inner diameter of 12.3 mm. The vibration member 44 has an urging force of about 33 gf in a state that it is in abutment to the spring retainer 343 (coupled unconnected state) and about 50 gf in the connected state of the second coupling member 30.

By employing the above-described structure, it is possible to engage the residual toner connecting portion 532 with the main assembly of the apparatus and vibrate the vibration member 44 without receiving the operation from the arm 42 of the apparatus main assembly 100 shown in Embodiment 1.

That is, in this embodiment, the second coupling member 30 is urged toward the first position by the urging member (compression spring 531) (FIG. 44). That is, as shown in part (a) of FIG. 45, in the spontaneous state, the second coupling member 30 is located at a first position operable with the vibration member 44. However, in the process of inserting the cartridge 7 into the main assembly, the second coupling member 30 is moved to the second position by the force received by the moving force receiving portion (movement rib 532*f*) from the engagement wall 543*d* (part (b) of FIG. 45). When a further advancement of the inserting operation of the cartridge 7 is made, the movement rib 532*f* disengages from the engagement wall 543*d*, so that the second coupling member 30 moves to the first position by the force of the urging member (compression spring 531). That is, the second coupling member 30 reciprocates between the first position and the second position.

Embodiment 6

In this embodiment, the structures are similar to the structures of the foregoing Embodiment 1, and therefore, the description will be made as to the portions different from Embodiment 1. The materials, shapes and so on are similar to those of the foregoing embodiments unless otherwise stated particularly. The description will be omitted about such portions. Referring to FIGS. 46 and 47, the structure of this embodiment will be described. FIG. 46 is an exploded view illustrating parts in this embodiment, and FIG. 47 is a sectional view illustrating a connecting method between the residual toner connecting portion and the main assembly. As shown in FIG. 46, the coupling receptor 628 is mounted to the drum bearing 27 similarly to Embodiment 1. The coupling receptor 628 is provided with a residual toner discharge opening 628*g* facing in a direction of an arrow N.

Similarly to Embodiment 1, the first coupling member 629 is supported by the coupling receiving portion 628*d* of the coupling receptor 628 at a supporting portion 629*d* in the weight direction (substantially arrow N direction).

The first coupling member 629 includes a cylindrical portion 629*e* which enters the inner diameter portion 628*h* a cylindrical portion of the coupling receptor 628 to be supported rotatably about the axis 61*a*.

Here, a cylindrical portion 628*a* of the coupling receptor 628 and the cylindrical portion 629*e* of the first coupling member 629 are made of flexible parts having elasticity, such as rubber, for example.

More particularly, it is preferably resin material having a high elasticity, such as silicone rubber, fluorinated resin material or the like.

Furthermore, in the structure of this embodiment, at the end portion on the arrow N side of the first coupling member 629, a recess 629*h* and a mounting abutment surface 630*k* including the same shape as that of the recess 30*h* and the abutment surface 30*k* of the second coupling member 30 of Embodiment 1 are provided.

Furthermore, as in Embodiment 1, a vibration member 44 is provided in the first feeding passageway 80*a* of the apparatus main assembly 100.

In addition, as shown in FIG. 47, the spring receiving portion 643 of the apparatus main assembly 100 is provided with a wall portion 643*e* engaging with the residual toner connecting portion 632. The wall portion 643*e* is provided in the neighborhood of the residual toner receiving opening 680*d* and projects from the vibration member 44 in the direction opposite to the arrow N.

The mounting of the process cartridge 7 will be described.

As shown in part (a) of FIG. 47, when the process cartridge 7 is mounted into the main assembly in the direction indicated by the arrow J, the cylindrical portion 628*a* of the coupling receptor 628 abuts to the wall portion 643*e* of the main assembly 100.

When the process cartridge 7 is further inserted in the direction of the arrow J, the coupling receptor 628 having flexibility is pressed against the wall portion 643*e* to deform in the direction opposite to the arrow J direction. Here, the first coupling member 629 provided in the coupling receptor 628 also has an elasticity similarly to the coupling receptor 628, and therefore, deforms along with the flex of the coupling receptor 628 (part (b) of FIG. 47). This is the state in which the first coupling member 629 is retracted to the second position. With further insertion of the process cartridge 7 in the direction of the arrow J, the coupling receptor 628 move over the wall portion 643*e*, so that the flex is released to restore the initial state. This is the state in which the first coupling member 629 is in the first position. That is, the first coupling member 629 is moved from the first position to the second position by the force received by the cylindrical portion (moving force receiving portion) 628*a* of the coupling receptor from the main assembly. Thereafter, the first coupling member 629 is moved to the first position by the elastic force of the first coupling member 629 and the coupling receptor 628.

By the coupling receptor 628 returning to the initial position, the free end of the coupling receptor 628 and the free end of the first coupling member 629 enters the main assembly toner receiving opening 80*d* which is the connecting portion of the main assembly 100.

At this time, the vibration member 44 of the main assembly 100 is abutted by the first coupling member 629 with an urging force. The abutted first coupling member 629 is rotated in interrelation with the rotation of the photosensitive drum 1, similarly to Embodiment 1.

By this, the recess 629*h* and the abutting portion 629*k* of the first coupling member 629 alternately abut against the acted-on portion 44*b* of the vibration member 44, by which the vibration member 44 vibrates.

Here, the vibration member 44 is a compression spring including a wire diameter of 0.6 mm and an inner diameter of 12.3 mm. The urging force of the vibration member 44 is about 33 gf in a state that it is in abutment to the spring retainer 643 (coupling disconnected state) and about 50 gf in the connected state of the second coupling member 30.

With the structure described above, the driving force is transmitted from the process cartridge 7 to the apparatus main assembly 100.

By employing the above-described structure, connection of the residual toner first coupling member 629 to the main assembly of the apparatus and vibration transmission are possible without receiving the operation from the apparatus main assembly 100 shown in Embodiment 1.

In addition, without moving the process cartridge 7, the coupling receptor 628 which is a connecting portion of the apparatus main assembly 100, and the first coupling member 629 in the process cartridge 7 vibration transmission with the main assembly of the device becomes possible.

However, in the state of the process cartridge 7, the discharge opening 628*g* which is the residual toner discharge portion has elasticity, and therefore, it may be difficult to seal it.

In addition, in order to move to the position where the first coupling member 629 deformed by the wall portion 643*e* is engaged with the vibration member 44, a space for eliminating deflection caused by hitting the wall portion 643*e* is required. For this reason, it may be difficult to arrange the seal member on the apparatus main assembly 100 side. In order to assure the toner sealing properties, it is preferable that the structure of Embodiment 1 and the like is employed.

The structure of this embodiment can be summarized as follows. The first coupling member 629 transmits vibration to the outside of the cartridge. The first coupling member 629 constitutes a part of the feeding passageway for the toner. That is, the first coupling 629 constitutes the portion of the second feeding passageway 61 (discharging passageway for the toner, part (a) of FIG. 1) of Embodiment 1.

The first coupling 629 is an elastic deformation portion capable of elastic deformation. By the elastic deformation of the first coupling 629, the discharging passageway also deforms, with which the second coupling 629 moves between the first position (part (c) of FIG. 47) and the second position (part (b) of FIG. 47).

The moving direction of the second coupling 629 crosses with the axial direction of the photosensitive drum (left-right direction in FIG. 47). That is, when the second coupling 629 moves from the first position to the second position, the free end of the second coupling member 629 moves toward the upper left portion.

That is, the moving direction of the first coupling 629 includes a left-right direction component and a vertical direction component. Therefore, the first coupling member 629 moves in the direction perpendicular to the axial direction of the photosensitive drum and also in the direction parallel with the axial direction of the photosensitive drum. In other words, the moving direction of the first coupling member 629 is as follows. The axial direction of the first coupling 629 at the time when the first coupling 629 is in the first position is the reference direction.

In this embodiment, the reference direction is the direction in which the center line 61*a* in part (c) of FIG. 47 extends, and is the vertical direction. The first coupling member 629 moves so as to displace at least in this direction. That is, when the first coupling member 629 moves from the first position to the second position, it moves at least upwardly, and therefore, it displaces in the referenced direction (vertical direction).

In addition, in this embodiment, the acting member for transmitting the vibration to the outside of the cartridge is disposed adjacent to the toner discharge opening, similarly to the foregoing embodiments. Particularly in this embodiment, as will be understood from FIG. 47 and FIG. 46, the first coupling member 629 constitutes the toner discharge opening. The toner having passed through the first coupling member 629 is directly moved into the toner receiving opening of the main assembly.

That is, the structure in which the acting member is provided adjacent to the toner discharge opening includes the structure in which the coupling member per se constitute at least a part of the discharge opening as in this embodiment. The first coupling member 629 is in the first position in the free state. The second coupling member 629 moves from the second position to the first position by the elastic force (urging force) of itself.

In other words, the first coupling member 629 is an acting member for transmitting the vibration to the outside of the cartridge and is a member constituting the toner discharging passageway and the discharge opening, and is also the urging member for urging to move the acting member. In addition, the first coupling member 629 is connected with the toner receiving opening provided in the main assembly of the image forming apparatus. Therefore, the first coupling member 629 is also the connecting portion for connecting the discharge opening to the receiving port. Furthermore, the first coupling member receives the rotational force for transmitting the vibration to the vibration member 44 from the toner feeding screw.

Thus, in this embodiment, the plurality of members are constituted into an integral first coupling member 629.

When the first coupling member 629 moves to the first position, the use is made with the elastic force of the cylindrical portion 628*a* of the coupling receptor 628. Therefore, the cylindrical portion 628*a* is also the urging member for urging the coupling member 629 to the first position.

Embodiment 7

Another embodiment in which the residual toner connecting portion is different will be described. This embodiment is similar to Embodiment 1, and therefore, the description will be made as to the portions different from it. The materials, shapes and so on are similar to those of the foregoing embodiments unless otherwise stated particularly. The description will be omitted about such portions.

Also in this embodiment, similarly to Embodiment 6, the coupling member (second coupling member 730) per se for transmitting the acting force (vibration) to the outside of the cartridge constitutes the toner discharge opening 730*d*.

FIG. 48 is an exploded view illustrating the residual toner connecting portion and other parts in this embodiment. FIG. 49 shows an outer appearance of the configuration of the second coupling in this embodiment, and FIG. 50 is a sectional view illustrating the connection with the main assembly 100 in this embodiment.

As shown in FIG. 48, in this embodiment, a coupling receptor 28 is provided with a connecting operation portion 732, a first coupling member 29, the second coupling member 730, the coupling spring 31 and a coupling seal 700.

The mounting of the first coupling member 29 to the coupling receptor 28 is similar to that of Embodiment 1, and therefore, the description is omitted. The connecting operation portion 732 has a shaped provided by cutting the discharge opening 32*d* away from the residual toner connecting portion 32 of Embodiment 1, and similarly to Embodiment 1, is movable in the direction indicated by an arrow N by the cylindrical portion 28*a* and the rotation stopper rib 28*d* of the coupling receptor 28. The detailed description will be omitted because of the similarity to Embodiment 1. In the position downstream of the connecting operation portion 732 with respect to the direction of the arrow N, there are provided a flexible cylindrical seal 700 and the second coupling member 730.

As shown in FIG. 48, the first coupling member 29, the second coupling member 730, the coupling spring 31, the coupling receptor 28, the cylindrical seal 700 and the connecting operation member 732 are arranged coaxially with the center line 61*a*. First coupling member 29 and the second coupling member 730 are connected with each other by the coupling spring 31 similarly to Embodiment 1. The connecting operation member 732 is mounted to the coupling receptor 28 together with the second coupling member 730 so as to be movable in the direction of the arrow N against the urging force of the coupling spring 31. Upon the connection of the process cartridge 7 to the main assembly 100, the connecting operation member 732 move in the direction of the arrow N.

As shown in FIG. 49, the second coupling 730 is provided with and a recess 730*h* similarly to the second coupling member 30 of Embodiment 1. A second coupling 730 is provided with a discharge opening 730*d* in the form of a hole, in place of the discharging portion 32*d* as the residual toner discharge opening of the process cartridge 7 in Embodiment 1. In addition, the second coupling member 730 is provided on the recess 730*h* with a spring hook groove 730*c* in the form of a recess for mounting the coupling spring 31 similarly to Embodiment 1.

Similarly to Embodiment 1, the coupling spring 31 as the urging member is a twisted coil spring having a bent free-end portion 31*a* and a ring configuration 31*b* in the facing direction. The coupling spring 31 is inserted into the second coupling member 730 in the direction opposite to the direction of the arrow J, and the end portion 31*a* is engaged with a spring hook groove 730*c*.

Furthermore, as shown in FIG. 48, there is provided a flexible cylindrical seal 700 between the second coupling member 730 and the connecting operation portion 732. The cylindrical seal 700 is telescoped around the outer periphery of a driving claw 730*f* of the second coupling member 730.

When the second coupling member 730 is urged by the urging force of the coupling spring 31 in the direction opposite to the arrow N, the cylindrical seal 700 is compressed between the second coupling member 730 and the connecting operation portion 732 by the urging force of the coupling spring 31. By the compression (deformation) of the cylindrical seal 700, the occurrence of the gap between the connecting operation portion 732 and the second coupling member 730 can be prevented.

Referring to FIG. 50, the drive transmission to the main assembly will be described. FIG. 50 is a sectional view of the process cartridge 7 and the main assembly 100 in the state of driving connection established.

The connecting operation portion 732 is provided with arm contact portions 732*f* and 732*g* similarly to the arm contact portions 32*f*, 32*g* of the residual toner connecting portion 32 of Embodiment 1.

The description as to the mounting to the main assembly 100 is omitted because it is similar to Embodiment 1.

After the process cartridge 7 is mounted to the main assembly 100, the main assembly arm 42 (unshown) operates in interrelation with the closing operation of the front door of the main assembly 100, so that the connecting operation portion 732 is urged in the direction of the arrow N.

By the movement of the connecting operation portion 732 in the direction of the arrow N, the cylindrical seal portion 700 and the second coupling member 730 are moved in the direction of the arrow N. Here, the cylindrical seal portion 700 urges the second coupling member 730 in the direction of the arrow N while being compressed.

The second coupling member 730 is pressed against the connecting operation portion 732 through the cylindrical seal portion 700 to enter the residual toner receiving opening 80*d* of the main assembly 100.

When the second coupling member 730 enters the residual toner receiving opening 80*d* of the main assembly 100, the second coupling member 730 is supported by the inner surface of the cylindrical portion 28*a* of the coupling receptor 28 so that the driving claw 730*f* is rotatable. Similarly to Embodiment 1, the first main assembly feeding passageway 80*a* of the main assembly 100 is provided with vibration member 44 so as to be centered on the center line 61*a*.

The second coupling member 730 enters the residual toner receiving opening 80*d* to compress the vibration member 44 in the direction of the arrow N against the reaction force of the vibration member 44.

Therefore, the vibration member 44 abuts to the second coupling member 730 with an urging force. Similarly to Embodiment 1, the second coupling member 730 rotates in interrelation with the rotation of the photosensitive drum 1. By this, the vibration member 44 vibrates in the direction of arrow N, by the recess 730*h* and the abutting surface 730*k* of the second coupling member 730 being alternately brought into abutment with the acted-on portion 44*b* of the vibration member 44.

Here, the vibration member 44 is a compression spring having a wire diameter of Φ0.6 mm and an inner diameter Φ12.3 mm, approximately. The vibration member 44 provides the urging forces of approx. 33 gf in the state of abutting to the spring stopper 43 (uncoupled state) and approx. 50 gf in the connection state of the second coupling member 730.

With the structure described above in which the second coupling member 730 is provided with the discharge opening 730*d*, the same effects as in Embodiment 1 are provided.

Embodiment 8

Another embodiment in which the residual toner connecting portion is different will be described.

In this embodiment, the structures are similar to the structures of the foregoing embodiments, and therefore, the description will be made as to the portions different from them. The materials, shapes and so on are similar to those of the foregoing embodiments unless otherwise stated particularly. The description will be omitted about such portions.

Referring to FIGS. 51, 52, 53, 54 and 55, the parts in this embodiment will be described.

FIG. 51 is an exploded view illustrating the residual toner connecting portion and the other parts in this embodiment, FIG. 52 is an outer appearance illustrating a configuration of a second coupling 830 in this embodiment, and FIG. 53 is an outer appearance illustrating a configuration of the connecting operation portion 832. FIG. 54 is sectional views in the neighborhood of the residual toner discharge opening in this embodiment before and after connection with the main assembly, and FIG. 55 is side views in the neighborhood of the residual toner discharge opening before and after the connection with the main assembly in this embodiment.

As shown in FIG. 51, the coupling receptor 828 is provided with a first coupling member 29, the connecting operation portion 832, a tension spring 831, a connecting operation spring 800, a second coupling receptor 801 and a second coupling member 830 which are arranged coaxially. That is, they are placed on the center line 861*a*.

The connecting operation portion 832 is provided with a second coupling portion 830 in the direction opposite to the arrow N. As shown in FIGS. 52, 53, the second coupling member 830 is provided with a cylindrical press-fitting portion 830*j*. As shown in FIG. 53, the connecting operation portion 832 is provided in the cylindrical portion with a projection 832*q* engaged with the press-fitting portion 830. When the second coupling member 830 is inserted into the connecting operation portion 832 in the direction opposite to the direction of the arrow N, the press-fitting portion 830*j* abuts to the projection 832*q*. Furthermore, by pushing the second coupling member 830 against the connecting operation portion 832, the press-fitting portion 830*j* enters beyond the projection 832*q*. In this manner, as shown in part (a) of FIG. 54, the second coupling 830 is limited in the movement relative to the connecting operation portion 832 in the direction of the arrow N by the press-fitting portion 830*j* abutting to the projection 832*q*. As shown in part (a) of FIG. 54, in the direction opposite to the arrow N, the projection 830*i* of the second coupling portion 830 abuts to a free end portion 832*r* of the connecting operation portion 832 so that the movement is limited. Therefore, the second coupling 830 is movable relative to the connecting operation portion 832 in the direction of the arrow N within the range of play. In addition, the second coupling member 830 is rotatable relative to the connecting operation portion 832 of a center line 861*a*.

As shown in FIG. 51, the connecting operation portion 832 is provided with the connecting operation spring 800 and the second coupling receptor 801 arranged along a common line. Furthermore, the connecting operation portion 832 is provided with the second coupling receptor 801 mounted from the upstream side with respect to the arrow N so as to cover the outer diameter of the connecting operation spring 800 along a common line.

As shown in part (a) of FIG. 54, in the opposite side where the second coupling receptor 801 is mounted, a hole portion 801*c* engaged with the cylindrical portion 830*k* of the second coupling 830 substantially without gap therebetween is provided.

When the second coupling receptor 801 is mounted to the connecting operation portion 832 in the direction opposite to the arrow N, two claw portions 801*a* of the second coupling receptor 801 are engaged with two hole portions 832*m* of the connecting operation portion 832, respectively (part (a) of FIG. 55). Here, the claw portions 801*a* are projected in the direction opposite to the direction of the arrow N from a part of an outer periphery of the second coupling receptor 801, and the free ends (opposite to the direction of the arrow N) are provided with hooking portions 801*b* extending outwardly.

The second coupling receptor 801 mounted on the connecting operation portion 832 is urged by the connecting operation spring 800 in the direction of the arrow N. The second coupling receptor 801 having moved by the urging force relative to the connecting operation portion 832 in the direction of the arrow N is brought into hooking engagement with the hole portion 832*m* the of the connecting operation portion 832 by the hooking portion 801*b* of the claw portion 801*a*. In this manner, the second coupling receptor 801 is supported so as to be movable relative to the connecting operation portion 832 in the direction of the arrow N within the range of engagement of the claw portion 801*a* in the state of the connecting operation spring 800 being urged (part (a) of FIG. 55).

In addition, in this state that the claw portion 801*a* engages with the hole portion 832*m* so as to be limited in the direction of the arrow N, the cylindrical portion 830*k* of the second coupling 830 is in engagement with the hole portion 801*c* of the second coupling receptor 801 substantially without a gap (part (a) of FIG. 54).

Then, the connection operating portion 832 is mounted to the coupling receptor 828.

As shown in FIG. 51, the connecting operation portion 832 has a cylindrical configuration, and the inside circumference thereof is fitted around the cylindrical portion 828*a* of the coupling receptor 828. At this time, a rotational position determination groove 832*i* of the connecting operation portion 832 is engaged with a rotation stopper rib 828*d*, so that the movement in the rotating direction is limited. Furthermore as shown in FIG. 53, the connecting operation portion 832 is provided with outwardly projecting spring hook projections 832*j* at each of two axial symmetry positions. As shown in FIG. 54, the coupling receptor 828 is provided with two spring hook portions 828*g* in the downstream side with respect to the arrow N.

After the connecting operation portion 832 is fitted with the coupling receptor 828 in the direction opposite to the arrow N, two tension springs 831 are mounted. The tension spring 831 has ring configurations 831*a*, 831*b* at the respective ends, and are engaged with the spring hook projection 832*j*, spring hook portion 828*g*, respectively. At this time, the connecting operation portion 832 is positioned by an inner wall 832*s* abutted to a free end portion 828*e* of the coupling receptor portion 828 by the urging force of the tension spring 831 (part (a) of FIG. 54).

In this manner, the connecting operation portion 832 is mounted to the coupling receptor 828. As for the mounting of the first coupling 29 to the coupling receptor 828 and the mounting of the coupling receptor 828 to the bearing 27R, they are similar to those in Embodiment 1, and the description thereof is omitted.

Referring to FIGS. 55, 56 and 58, the operation of the residual toner discharging portion of the process cartridge 7 will be described.

FIG. 56 is an outer appearance illustrating engagement of a toner discharging portion with the main assembly 100, as seen from a lateral side of the process cartridge 7, in this embodiment, and FIG. 58 is a sectional view illustrating the connecting method between the toner discharging portion and the main assembly 100 in this embodiment.

As described hereinbefore, the connecting operation portion 832 receives the urging force of the tension spring 831 to abut to the coupling receptor 828. Furthermore, the second coupling receptor 801 is supported in abutment to the connecting operation portion 832 in the state in which it receives the urging force from the connecting operation spring 800.

As shown in part (a) of FIG. 56, when the process cartridge 7 is inserted into the main assemblies 100, the connecting operation portion 832 is engaged with an arm 42 of the main assembly 100. After the completion of the mounting of the process cartridge 7, the connecting operation portion 832 is moved in the direction of the arrow N In interrelation with the closing operation of the front door 91 (parts (a) and (b) of FIG. 25) of the main assembly 100. That is, the connecting operation portion 832 is moved in the direction of the arrow N by the arm 42 interrelated with the front door (part (b) of FIG. 56).

At this time, the second coupling receptor 801 abuts to the main assembly receiving opening sealing member 47 (similarly to Embodiment 1, FIG. 26) of the main assembly 100, and therefore, the movement in the direction of the arrow N is limited. As a result, the second coupling receptor 801 moves relative to the connecting operation portion 832 in the direction toward the connecting operation portion 832 (opposite to the direction of the arrow N) against the urging force of the connecting operation spring 800.

In addition, the projection 830*i* abuts to the free end portion 832*r* of the connecting operation portion 832 in the direction of the arrow N, and therefore, the second coupling member 830 enters the main assembly receiving opening sealing member 47 and the residual toner receiving opening 80*d*, as will be described hereinafter (part (b) of FIG. 58).

Therefore, the second coupling receptor 801 moves relative to the second coupling 830 in the direction opposite to the direction of the arrow N (part (b) of FIG. 58).

By the operations described above, a gap 802 (residual toner discharge opening) is provided between the second coupling 830 and the second coupling receptor 801 (part (b) of FIG. 55). Referring to FIG. 57, the structure for discharging the residual toner from the process cartridge 7 to the main assembly 100 will be described.

FIG. 57 is a sectional view illustrating a stagnation position of residual toner V and a toner discharging passageway in this embodiment. As shown in part (a) of FIG. 57 and as described hereinbefore, before the mounting of the process cartridge 7 to the main assembly 100, the cylindrical portion 830*k* of the second coupling 830 is engaged with the cylindrical portion 801*c* of the second coupling receptor 801 so that they are connected with each other without gap. Therefore, the residual toner V does not leak through the second coupling 830 and the second coupling receptor 801.

As described hereinbefore, the gap 802 is produced by the movement of the second coupling receptor 801 relative to the second coupling 830 in the direction opposite to the arrow N after the mounting of the process cartridge 7 to the main assembly 100. The gap 802 is large enough to discharge the residual toner V, thus accomplishing the discharge of the residual toner V from the process cartridge 7 (part (b) of FIG. 57).

Referring to FIGS. 58 and 59, a driving connection structure relative to the main assembly 100 will be described. FIG. 59 is a schematic view illustrating an engagement method between the process cartridge 7 and the main assembly 100 after the completion of the mounting of the process cartridge 7 to the main assembly, in this embodiment.

Similarly to Embodiment 1, the process cartridge 7 is mounted in the direction of the arrow J.

At this time, the arm contact portions 832*f*, 832*g* of the connecting operation portion 832 are brought into engagement with the arm 42 of the main assembly 100 shown in FIG. 56. By the completion of the mounting and the closing operation of the front door (unshown) of the main assembly, the arm 42 rotates to engage with the arm contact portions 832*f*, 832*g* of the connecting operation portion 832, so that the connecting operation portion 832 is lower than in the direction of the arrow N (part (b) of FIG. 58), as in Embodiment 1.

The second coupling receptor 801 and the second coupling portion 830 mounted to the connecting operation portion 832 in this manner contacts to the main assembly receiving opening sealing member 47 (similarly to Embodiment 1, FIG. 26) of the main assembly 100. When the connecting operation portion 832 is further pushed down by the arm 42 in the direction of the arrow N, the second coupling receptor 801 is moved in the direction opposite to the direction of the arrow N against the urging force of the connecting operation spring 800. At this time, the second coupling member 830 contacts to the free end portion 832*r* of the connecting operation portion 832 by the projection 830*i* so that the movement in the direction of the arrow N is limited, as described hereinbefore. Therefore, by the movement of the connecting operation portion 832 in the direction of the arrow N, only the second coupling member 830 enters the main assembly receiving opening sealing member and the residual toner receiving opening 80*d* (part (b) of FIG. 58).

As shown in FIG. 54 and similarly to Embodiment 1, the vibration member 44 is provided centered on the center line 61*a* in the first main assembly feeding passageway 80*a* of the main assembly.

The vibration transmission between the main assembly 100 and the process cartridge 7 will be described.

As shown in FIG. 58, the second coupling 830 enters the main assembly receiving opening 80*d* of the main assembly 100. At this time, the second coupling 830 compresses the vibration member 44 in the direction of the arrow N against the reaction force of the vibration member 44.

As in Embodiment 1, the abutted second coupling member 830 rotates in interrelation with the rotation of the photosensitive drum 1.

By this, the vibration member 44 vibrates in the direction of arrow N, by the recess 830*h* and the abutting portion 830*m* of the second coupling member 830 being alternately brought into abutment against the acted-on portion 44*b* of the vibration member 44.

Here, the vibration member 44 is a compression spring having a wire diameter of Φ0.6 mm and an inner diameter Φ12.3 mm, approximately. The vibration member 44 provides the urging forces of approx. 33 gf in the state of abutting to the spring stopper 43 (uncoupled state) and approx. 50 gf in the connection state of the second coupling member 830.

Referring to FIGS. 57 and 58, the feeding of the residual toner to the main assembly 100 will be described. As shown in part (b) of FIG. 58, when the second coupling member 830 enters the main assembly receiving opening 80*d*, the gap 802 is produced between the second coupling member 830 and the second coupling receptor 801 in the circumferential direction (part (b) of FIG. 57). Through the gap 802, the residual toner produced in the process cartridge 7 can be fed to the main assembly 100.

In addition, in the state of not connecting with the main assembly, the second coupling member 830 is in the second coupling receptor 801 substantially without gap, and therefore, the leakage of the residual toner through the gap 802 is prevented.

In this manner, in the case that the outlet opening to the main assembly is not on the center line 861*a*, the same effects as in Embodiment 1 are provided. Furthermore, in the free state of the process cartridge 7, the leakage of the residual toner can be prevented without using a sealing member such as a shutter 34 of Embodiment 1, for example.

The structure of this embodiment is summarized in the following. As shown in part (b) of FIG. 55, the second coupling member 830 of this embodiment constitutes a part of the discharge opening 802 for the toner. The second coupling member 830 opens the toner discharge opening 802 by moving from the second position (part (a) of FIG. 55) to the first position (part (b) of FIG. 55), and closes the toner discharge opening 802 by moving from the first position to the second position. By the movement of the second coupling member 830, the discharge opening 802 is opened and closed.

Finally, representative structure examples scribal in the foregoing will be summarized. Reference numerals are given for some elements in the following. The reference numerals are intended to indicate the correspondence with the elements in the embodiments. The correspondence is merely an example. No limitation to the elements of the embodiments is intended.

Embodiment 9

Referring to FIGS. 64 to 66, this embodiment will be described. In this example, the differences from Embodiment 1 will be described in detail. Unless otherwise stated particularly, the material, the shape and the like are the same as in the above-described embodiment. For such portions, detailed explanation is omitted.

In Embodiment 1, an acting member (vibration imparting member) which acts on the vibration member 44 to vibrate the vibration member 44 is the second coupling member 30 which is rotationally driven. On the contrary, in this embodiment, the acting member (vibration imparting member) 430 acting on the vibration member 44 vibrates without rotation.

In other words, the cartridge 7 of Embodiment 1 has the second coupling member 30 as a driving member provided in the neighborhood of the toner discharge opening 32*d*. In this embodiment, the driving member provided in the neighborhood of the toner discharge opening 32*d* is divided into two members, namely, a second coupling member 330 and an acting member 430.

In this embodiment, the differences from the above-described embodiment will be described in detail. Unless otherwise stated in particular, the material, the shape and the like are the same as those in the above-mentioned embodiment. For such portions, detailed explanation is omitted. Referring to FIG. 64 to FIG. 67, Embodiment 9 of the present invention will be described.

Here, FIG. 64 is a structure illustration (corresponding to FIG. 9 of Embodiment 1) of the residual toner discharging portion of the process cartridge of this embodiment. FIG. 65 is an external view illustrating the shape of the second coupling of this embodiment. Furthermore, FIG. 66 is a cross-sectional view illustrating the movement of the process cartridge in the neighborhood of the residual toner discharge opening of this embodiment. FIG. 67 is a schematic view illustrating the transmission of the action from the process cartridge of this embodiment to the vibration member 44 which is the acted portion of the apparatus main assembly.

As shown in FIG. 64, in this embodiment, as in Embodiment 1, the first coupling member 329, the second coupling member 330, the coupling spring 31, the coupling receptor 28, the acting member 430, and the residual toner coupling member 332 are arranged along the center line 61*a*. That is, these are arranged on substantially coaxially.

The acting member 430 in this embodiment is a reciprocating member capable of advancing and retracting, a vibration imparting member imparting vibration to the vibration member 44 and also a vibrating member (cartridge side vibrating member) vibrating by itself. The acting member 430 is also a force applying member that applies a periodical force to the vibration member 44 by vibration.

The second coupling member 330 is a vibration applying member (second vibration imparting member) for vibrating the acting member 430 and is also a second acting member constituted to act on the acting member 430.

In addition, the first coupling member 329 and the second coupling member 330 are connected by a coupling spring 31. The residual toner connecting member 332 is mounted to the coupling receptor 28 so as to be movable in the direction of arrow N against the urging force of the coupling spring 31, together with the second coupling member 330. And, when the process cartridge 7 is connected to the apparatus main assembly 100, the residual toner connecting member 32 moves in the direction of the arrow N to establish the connection.

Here, referring to FIGS. 64, 65, and 66, a method of supporting the acting member 430 will be described. As shown in FIG. 64, a claw portion (a projecting portion, an engaging portion) 430*m* is provided on the acting member 430 so as to project from the outer circumferential direction of the cylindrical portion 430*a* about the axis 61*a*.

Furthermore, as shown in FIG. 65, in the residual toner connecting portion 332, a cut-away portion (hole, engaging portion) 332*p* is provided in a portion of the cylindrical portion of the connecting member 332. The acting member 430 is supported by the cylindrical portion of the connecting member 332 by the claw portion 430*m* of the acting member 430 engaging with the cut-away portion 332*p*.

Here, the cut-away portion 332*p* is larger than the claw portion 430*m*, and therefore, the acting member 430 is movable in a predetermined range along the center line 61*a* with respect to the connecting member 332.

In Embodiment 1, with movement of the connecting member 332 from the non-coupling position (second position, part (a) in FIG. 1) to the connected position (first position, part (b) in FIG. 1), the second coupling member 30 moves from the second position (part (a) in FIG. 1) to the first position (part (b) in FIG. 1).

On the other hand, in this embodiment, in addition to the second coupling member 330, the acting member 430 is also supported by the connecting member 332. Therefore, the second coupling member 330 and the acting member 430 can move integrally with the movement of the connecting member 332 to move from the second position to the first position.

Next, referring to FIGS. 64 and 65, the second coupling member 330 will be described. The second coupling member 330 has a recess 330*h* as in Embodiment 1. A spring catching groove portion 30*c* is further formed at the back of the recess 330*h*, and a coupling spring (coil spring) 31 is engaged with this spring engaging groove portion 30*c*.

In addition, similarly to Embodiment 1, the second coupling member 330 has inclined portions (inclined surface portion 330*i* and a reverse inclined surface portion 330*j*) for forming the recessed portion 330*h*. These inclined portions (the inclined surface portion 330*i* and the reverse inclined surface portion 330*j*) are also surfaces connecting the recessed portion 330*h* with the abutment surface 330*k*.

In the second coupling member 30 of Embodiment 1, the recess 30*h* and the abutment surface 30*k* provided on the second coupling member 30 have been described as being directly in contact with the vibration member 44. On the contrary, in this embodiment, the recess 330*h* and the abutment surface 330*k* of the second coupling member 330 are not in contact with the vibration member 44 but are in contact with the acting member 430.

In the acting member 440, a projection 430*h* is formed at a position corresponding to the recess 330*h* of the second coupling member. The projection 430*h* has an inclined surface 430*i*, a reverse inclined surface 430*j*, and an apex portion 430*k*. The inclined surface 430*i* is an inclined portion corresponding to the inclined surface 330*i*. The reverse inclined surface 430*j* is an inclined portion corresponding to the reverse inclined surface 330*j*.

That is, the acting member 440 and the second coupling member 330 constitute a cam mechanism That is, the second coupling member 330 is a cam member (driving side cam member, first cam member, rotating cam member) constituted to vibrate (move forward and backward) the action member 440 by the rotation of itself. The acting member 440 is a cam member (a second cam member, a driven side cam member, a reciprocating cam member, a reciprocating cam member, a vibrating cam member) driven by the force received by the second coupling member 330.

More particularly, the action member 440 reciprocates (vibrates) such that the state is switched between the state in which the recess 330*h* provided in the second coupling member 330 and the projection 430*h* provided in the acting member 440 are engaged and the state in which they are disengaged. The recess 330*h* and the projection 430*h* are the cam portions disposed between the second coupling member 330 and the acting member 440.

Referring to FIGS. 66 and 67, the description will be made as to how the acting member 430 and the second coupling member 330 are driven.

Similarly to Embodiment 1, the structure is such that the first coupling member 329 is engaged with a feeding screw 26 (not shown) to rotate in the direction of the arrow T about the axis 61*a*. The first coupling member 329 rotated in the arrow T direction transmits rotation to the second coupling member 330 similarly to Embodiment 1, so that the second coupling member 330 rotates in the direction of the arrow T around the axis 61*a*.

Here, similarly to Embodiment 1, the second coupling member 330 is rotatable in the direction of the axis 61*a* to the residual toner connecting member 332. The second coupling member 330 is fixed to the residual toner connecting member 332 in the direction of the arrow N and supported thereby. Furthermore, in the residual toner connecting member 332, the acting member 430 is supported movably (vibratably) within a certain range in the direction of the arrow N. The residual toner coupling member 332 is a support member constituted to support the second coupling member 330 and the acting member 430.

The residual toner connecting member 332 is moved from the unconnected position (second position: part (a) of FIG. 66, part (a) of FIG. 1) to the connected position (first position: part (b) of FIG. 66, part (b) of FIG. 1). In interrelation therewith, the second coupling member 330 and the acting member 430 also move from the second position (part (a) of FIG. 66) to the first position (part (b) of FIG. 66). That is, the residual toner connecting member 332, the second coupling member 330, and the acting member 430 simultaneously move away from the axis of the photosensitive drum.

At this time, as shown in part (a) of FIG. 67, the acting member 430 receives an elastic force from the vibration member 44 by contacting the vibration member 44. Then, the action member 440 moves in the direction of the arrow I (upward) and contacts the second coupling member 330 as shown in part (b) of FIG. 67.

In this state, when the second coupling member 330 is rotating, the acting member 440 moves in the direction of the arrow N (Downward), along the reverse inclined surface 330*j* provided on the second coupling member 330 and the reverse inclined surface 430*j* provided on the acting member 430. This is the state shown in part (c) of FIG. 67.

Furthermore, when the second coupling member 330 rotates, the apex portion 430*k* (abutting portion) of the acting member 430 comes into contact with the abutment surface 330*k* of the second coupling member, as shown in part (d) of FIG. 67. In this state, the second coupling member 330 and the acting member 430 are most remote from each other, when the second coupling member 330 is driven. That is, and the second coupling member 330 has moved the acting member 430 most in the direction of arrow N (toner discharging direction).

Furthermore, when the second coupling member 330 rotates, the acting member 430 approaches the second coupling member 330, along the inclined surface 330*i* provided on the second coupling member 330 and the inclined surface 430*i* provided on the acting member 430, as shown in part (e) of FIG. 67. That is, the resilient force of the vibration member 44 causes the acting member 430 to retract toward the upstream side in the moving direction of the toner discharging direction.

Furthermore, when the second coupling member rotates, the state of the part (f) in FIG. 67 where the acting member 430 comes closest to the second coupling member 330 is reached. In this state, the cam members of the second coupling member 330 and the acting member 430 engage with each other, so that the acting member 430 is most retreated toward the upstream side in the toner discharge direction. That is, the second coupling member 330 is in a state of allowing the acting member 440 to retract by the urging force (elastic force) of the vibration member 44.

From the state shown in part (b) in FIG. 67 to the state shown in part (e) in FIG. 67, the second coupling member 330 rotates by half a circle (180°), and the acting member 430 vibrates (reciprocates) once.

That is, every time the second coupling member 330 makes one revolution, the acting member 430 vibrates a plurality of times (twice in this embodiment).

Further, once the acting member 430 vibrates (advances and retracts) once, the vibration member 44 also vibrates once.

That is, an annular planar portion provided at the free end of the acting member 430 is an acting portion which contacts the vibration member 44 and acts on the vibration member 44. When the acting member 430 periodically advances and retracts as shown in part (b) of FIG. 67 through part (f) of FIG. 67, the force received by the vibration member 44 from the acting member 430 also periodically changes. As a result, the vibration member 44 is elastically deformed periodically. In the state shown in part (d) of FIG. 67, a relatively large force is applied from the acting member 430 to the vibration member 44, and therefore, the vibration member 44 is pushed downward (in the direction of the arrow N). On the other hand, in the state shown in part (f) of FIG. 67, the force applied from the acting member 430 to the vibration member 44 decreases, and therefore, the vibration member 44 is projected upward (in the direction of the arrow I) by its own elastic force (advancing movement).

The structure of this embodiment will be summarized. The acting member 430 and the second coupling member 330 of this embodiment are driving members disposed near the discharge opening 32*d*. The second coupling member 330 and the acting member 430 constitute a cam mechanism.

This cam mechanism is a mechanism for changing the direction of motion. More specifically, in the cam mechanism, the rotational motion of the second coupling member 330 is changed to the reciprocating motion (linear reciprocating motion) of the acting member 430.

And, of the driving members (330, 430), the acting member 430 is a vibration imparting member that vibrates the vibration member 44 by the vibration of itself.

On the other hand, the second coupling member 330 is a rotating member that vibrates the acting member 430 by the rotational driving. When the second coupling member 330 rotates, the recess 330*h* (first cam portion) of the second coupling member 330 is repeatedly engaged with and disengaged from the projection 430 (second cam portion) provided on the acting member 430. By this, the acting member 430 advances and retracts (vibrates). That is, the second coupling member 330 is a portion of the cam mechanism and linearly moves the acting member 430 by its own rotation.

More particularly, the second coupling member 330 periodically moves the acting member 430 by periodically changing the force applied to the acting member 430. When the second coupling member 330 urges the acting member 430 with a relatively strong force (part (d) of FIG. 67), the acting member 430 moves toward the vibration member 44, and the acting member 430 pushes in the vibration member 44. On the other hand, when the force applied to the acting member 430 by the second coupling member 330 becomes relatively weak (part (f) of FIG. 67), the acting member 430 withdraws away from the vibration member 44 by the elastic force of the vibration member 44.

Here, when the acting member 440 moves downward (in the direction of the arrow N), the force received from the recess 330*h* of the second coupling member 330 is utilized. Meanwhile, when the acting member 440 moves upward (in the direction of the arrow I), it utilizes the elastic force of the vibration member 44.

However, by providing an urging member (for example, an elastic member such as a tension spring) which attracts the second coupling member 330 and the acting member 440 toward each other, the elastic force of the vibration member 44 may not be utilized when the acting member 440 moves upward (in the direction of the arrow I). That is, the action member 440 may be moved upward by utilizing the urging force (elastic force) of the urging member which attracts the second coupling member 330 and the action member 440.

Here, in this embodiment, the acting member 440 is mounted to the structure of Embodiment 1, but the acting member 440 may be mounted to another embodiment.

INDUSTRIAL APPLICABILITY

A cartridge dismountably mountable to an electrophotographic image forming apparatus main assembly including a loosening member for loosening a developer is provided.

REFERENCE NUMERALS

1: photosensitive drum
4: developing device
6: cleaning blade
7: process cartridge
13: photoconductor unit
14: cleaning frame
14*a*: residual toner container
14*b*: shutter guide portion
17: developing roller
18: development frame
26: feeding screw
26*a*: feeding screw portion
26*b*: support portion
26*c*: support portion
26*d*: feeding blade
26*e*: reverse screw portion
26*f*: screw center line
26*g*: drive transmission blades
27: drum bearing
28: coupling receiving portion
28*a*: cylindrical portion
28*b*: support portion
28*c*: support portion
28*d*: rotation stop rib
28*e*: welded portion
28*f*: cylindrical free end tapered portion
29: first coupling member
29*a*: hole portion
29*b*: drive pin
29*c*: drive claw
29*d*: support portion
29*e*: engaging portion
29*f*: spring groove
30: second coupling member
30*a*: hole portion
30*b*: groove portion
30*c*: spring loaded groove
30*d*: projection
30*e*: compression claw
30*f*: drive claw
30*g*: engaging portion
30*h*: recess
30*i*: slope
30*j*: reverse slope
30*k*: abutment surface
31: coupling spring
31*a*: folded shape
31*b*: ring shape
32: residual toner connection portion
34: shutter
35: elastic seal member
36: shutter urging member
38: arm link lever
38*a*: hole portion
38*b*: engagement hole portion
38*c*: support portion engaging shaft
38*d*: restricting portion
39: support member
39*a*: engagement hole
39*b*: lever engagement hole
40: residual toner discharge portion
41: compression spring (drum coupling urging)
42: arm
43: spring holder
43*a*: shutter contact portion
43*b*: fall prevention wall
44: spring coupling
44*a*: spring portion
44*b*: coupling portion
45: feeding fin
45*a*: rotational axis
45*b*: feeding portion
45*c*: scraping portion
46: cartridge retaining portion
47: main assembly receiving opening sealing member
48: link rotating member
49: rotational axis
50: first feeding member
51: first feeding passageway
52: idler gear
53: feeding screw gear
54: support member
54*a*: engaging portion
54*b, c*: engagement hole
55: second rear side plate
56: development idler gear
57: coupling portion
58: toner supply roller gear
59: developing roller gear
61: second feeding passageway
61*a*: center line
80: main assembly feeding portion
80*a*: first main assembly feeding passageway
80*b*: second main assembly feeding passageway
80*d*: residual toner receiving opening
80*e*: fin bearing portion
80*f*: feeding connecting portion
81: drum drive input coupling

82: development drive input coupling
83: voltage applying member
84: recording terminal
85: main assembly feeding screw
86: residual toner box
87: driving roller
88: opposing secondary transfer roller
89: driven roller
91: front door of main assembly
92: front cover
93: cartridge mounting portion
94: lower cartridge guide
95: upper cartridge guide
98: rear side plate
99: front side plate
100: image forming apparatus
134: shutter

The invention claimed is:

1. A cartridge detachably mountable to a main assembly of an electrophotographic image forming apparatus, the cartridge comprising:

(1) a photosensitive member;

(2) a discharge opening for discharging developer removed from the photosensitive member to outside of the cartridge;

(3) a vibration member vibratably supported adjacent to the discharge opening; and (4) a cam member configured to act on the vibration member, wherein the cam member is movable relative to the photosensitive member.

2. A cartridge according to claim 1, wherein the cam member is movable between a first position and a second position closer to an axis of the photosensitive member than the first position.

3. A cartridge according to claim 1, wherein the cam member is capable of taking a phase for urging the vibration member and a phase for permitting movement of the vibration imparting member.

4. A cartridge according to claim 1, further comprising a discharging passageway along which the developer moves toward the discharge opening.

5. A cartridge according to claim 4, wherein the cam member is movable with deformation of the discharging passageway.

6. A cartridge according to claim 4, wherein the vibration member is disposed at a terminal end side of the discharging passageway.

7. A cartridge according to claim 1, wherein at least a part of the vibration member is placed inside of the discharging passageway.

8. A cartridge according to claim 1, wherein the vibration member constitutes at least a part of the discharge opening.

9. A cartridge according to claim 1, wherein the vibration member is capable of opening and closing the discharge opening.

10. A cartridge detachably mountable to a main assembly of an electrophotographic image forming apparatus, the cartridge comprising:

(1) photosensitive member;

(2) a discharging passageway for moving developer removed from the photosensitive member to outside of the cartridge, the discharging passageway being deformable; and (3) a vibration member vibratably supported adjacent to a discharge opening through which the developer is discharged, the vibration member being movable with deformation of the discharging passageway.

11. A cartridge according to claim 10, wherein the discharging passageway is deformable to expand and contract.

12. A cartridge according to claim 10, wherein the discharging passageway is elastically deformable.

13. A cartridge according claim 10, wherein the vibration member is movable, with deformation of the discharging passageway, between a first position and a second position closer to an axis of the photosensitive member than the first position.

14. A cartridge according to claim 10, further comprising an acting member configured to vibrate the vibration member.

15. A cartridge according to claim 14, wherein the acting member is rotatable.

16. A cartridge according to claim 14, wherein the acting member is a cam member.

* * * * *